US005790018A

United States Patent [19]

Takahashi et al.

[11] Patent Number: 5,790,018

[45] Date of Patent: Aug. 4, 1998

[54] FIRE ALARM SYSTEM

[75] Inventors: Kaoru Takahashi; Keiichi Takahashi; Yukihiko Usami; Kouichi Hishino, all of Tokyo, Japan

[73] Assignee: Nohmi Bosai Ltd., Tokyo, Japan

[21] Appl. No.: 321,756

[22] Filed: Oct. 12, 1994

[30] Foreign Application Priority Data

| | | | |
|---|---|---|---|
| Oct. 19, 1993 | [JP] | Japan | 5-284377 |
| Mar. 25, 1994 | [JP] | Japan | 6-079617 |
| Mar. 31, 1994 | [JP] | Japan | 6-087711 |

[51] Int. Cl.[6] ..... G08B 29/00

[52] U.S. Cl. ..... 340/506; 340/825.06; 340/825.07; 340/825.54

[58] Field of Search ..... 340/505, 506, 340/825.06, 825.07, 825.08, 825.16, 825.2, 825.21, 825.54

[56] References Cited

U.S. PATENT DOCUMENTS

| | | | |
|---|---|---|---|
| 4,610,012 | 9/1986 | Terada et al. | 370/110.4 |
| 4,996,518 | 2/1991 | Takahashi et al. | 340/506 |
| 5,017,905 | 5/1991 | Yuchi | 340/506 |
| 5,227,776 | 7/1993 | Starefoss | 340/825.36 |
| 5,302,941 | 4/1994 | Berube | 340/505 |

*Primary Examiner*—Jeffery A. Hofsass
*Assistant Examiner*—Daryl C. Pope
*Attorney, Agent, or Firm*—Wenderoth, Lind & Ponack, L.L.P.

[57] ABSTRACT

An object of the present invention is to provide a fire alarm system which is adaptable to form a large-size fire alarm system and is capable of causing a receiving portion to quickly detect fire information from a terminal unit, or the like, if the terminal unit has been operated. In a fire alarm system in which terminal units, such as fire detectors, are connected to the receiving portion, an address is given to the terminal unit to allow detection of terminal units that have a status change, wherein system polling or the like for a specific terminal unit, such as a transmitter, among the terminal units is performed prior to performing system polling of other terminal units.

31 Claims, 32 Drawing Sheets

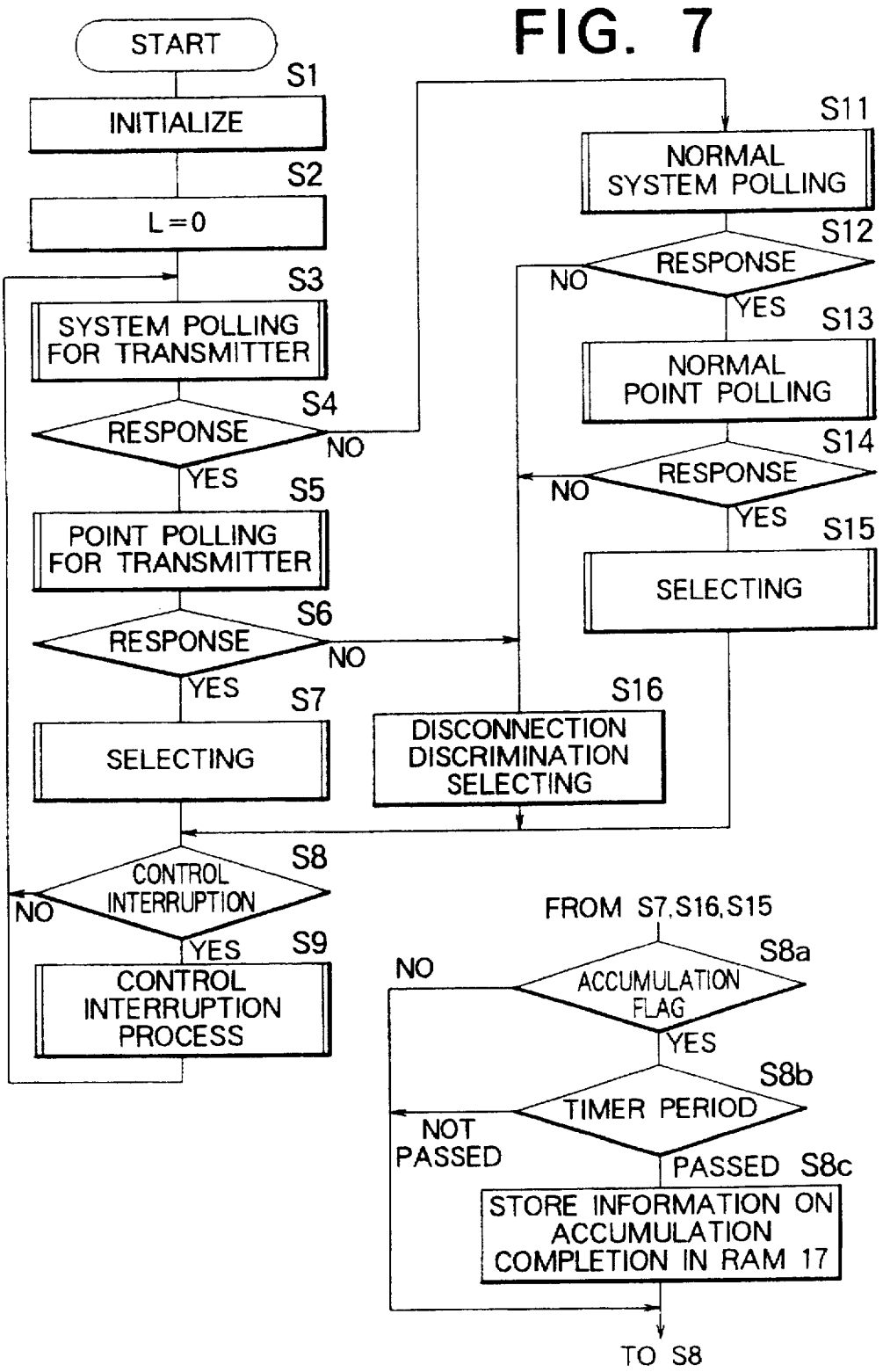
FIG. 7
START
S1
INITIALIZE
S2
L=0
S3
SYSTEM POLLING FOR TRANSMITTER
S4
RESPONSE
NO
YES
S5
POINT POLLING FOR TRANSMITTER
S6
RESPONSE
NO
YES
S7
SELECTING
S8
CONTROL INTERRUPTION
NO
YES
S9
CONTROL INTERRUPTION PROCESS
S11
NORMAL SYSTEM POLLING
S12
RESPONSE
NO
YES
S13
NORMAL POINT POLLING
S14
RESPONSE
NO
YES
S15
SELECTING
S16
DISCONNECTION DISCRIMINATION SELECTING
FROM S7,S16,S15
S8a
ACCUMULATION FLAG
NO
YES
S8b
TIMER PERIOD
NOT PASSED
PASSED
S8c
STORE INFORMATION ON ACCUMULATION COMPLETION IN RAM 17
TO S8

FIG. 14A

| | FIRE DISCRIMINATION LEVEL SET FOR FIRE RECEIVER RE | | |
|---|---|---|---|
| | LEVEL 1 | LEVEL 2 | LEVEL 3 |
| LEVEL WITH WHICH DETECTOR WAS OPERATED | | | |
| LEVEL 1 | FIRE ALARM | PREVIOUS ALARM | |
| LEVEL 2 | | FIRE ALARM | PREVIOUS ALARM |
| LEVEL 3 | | | FIRE ALARM |

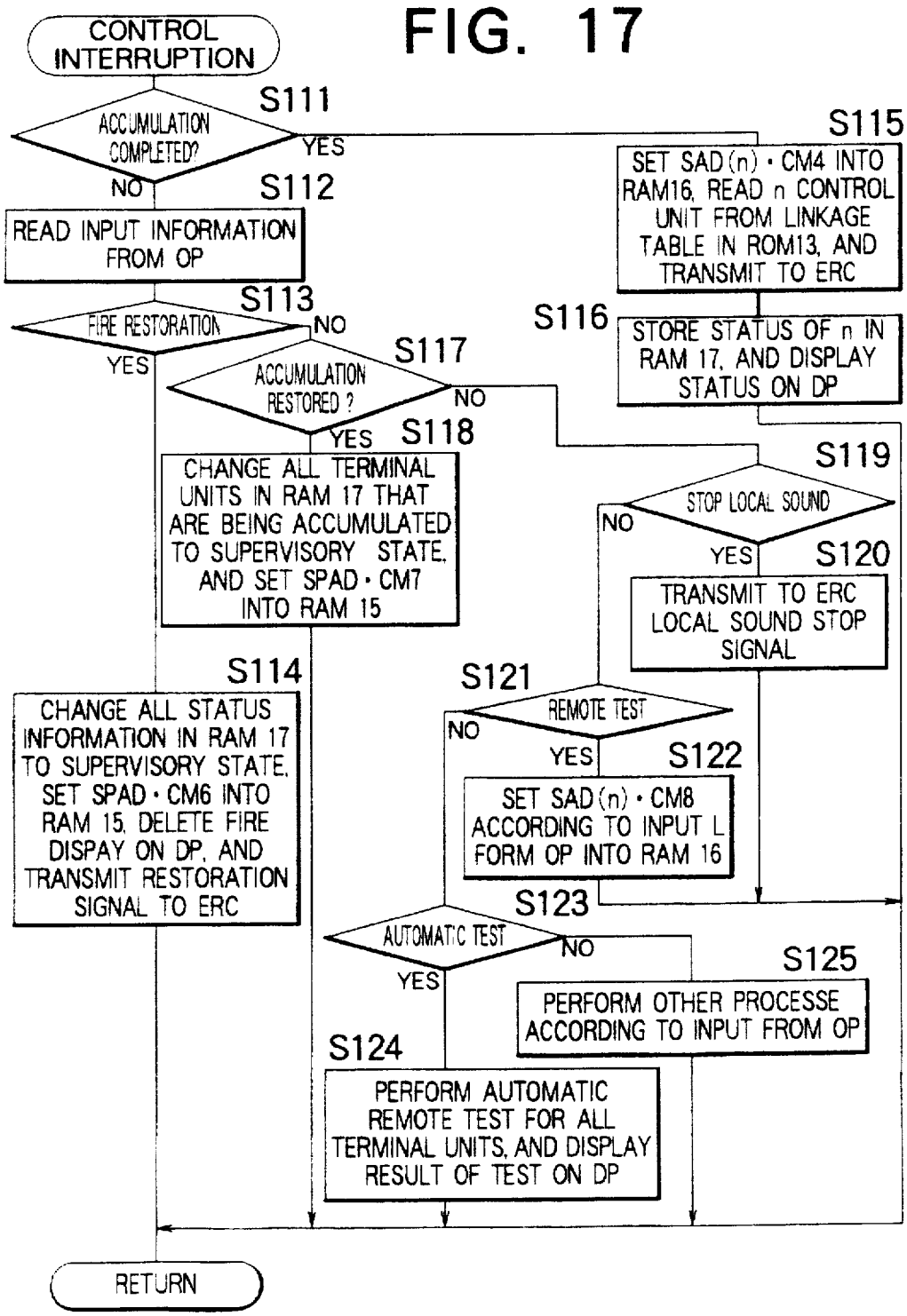
FIG. 17
CONTROL INTERRUPTION
S111
ACCUMULATION COMPLETED?
YES
NO
S112
READ INPUT INFORMATION FROM OP
S113
FIRE RESTORATION
NO
YES
S114
CHANGE ALL STATUS INFORMATION IN RAM 17 TO SUPERVISORY STATE, SET SPAD · CM6 INTO RAM 15, DELETE FIRE DISPAY ON DP, AND TRANSMIT RESTORATION SIGNAL TO ERC
S117
ACCUMULATION RESTORED ?
NO
YES
S118
CHANGE ALL TERMINAL UNITS IN RAM 17 THAT ARE BEING ACCUMULATED TO SUPERVISORY STATE, AND SET SPAD · CM7 INTO RAM 15
S115
SET SAD(n) · CM4 INTO RAM16, READ n CONTROL UNIT FROM LINKAGE TABLE IN ROM13, AND TRANSMIT TO ERC
S116
STORE STATUS OF n IN RAM 17, AND DISPLAY STATUS ON DP
S119
STOP LOCAL SOUND
NO
YES
S120
TRANSMIT TO ERC LOCAL SOUND STOP SIGNAL
S121
REMOTE TEST
NO
YES
S122
SET SAD(n) · CM8 ACCORDING TO INPUT L FORM OP INTO RAM 16
S123
AUTOMATIC TEST
NO
YES
S124
PERFORM AUTOMATIC REMOTE TEST FOR ALL TERMINAL UNITS, AND DISPLAY RESULT OF TEST ON DP
S125
PERFORM OTHER PROCESSE ACCORDING TO INPUT FROM OP
RETURN SYSTEM PROCESS
S23
S131
CM2
YES
NO
S142
CM6
YES
NO
S132
READ RAM 22 AND RAM 23
S143
RESTORE RAM 22, RAM 23 AND RAM 24
S133
COINCIDE
COLLATE
NOT COINCIDE
S144
PERFORM OTHER PROCESSES ACCORDING TO THE COMMANDS
S134
REFER TO RAM 24
S135
STOP FLAG
YES
NO
S136
READ g FROM RAM 25
S137
s=0
S138
s : g
=
≠
S140
SLOT UP
YES
NO
S141
s=s+1
S139
GENERATE RESPONSE PULSE
RETURN

POINT PROCESS
S27

S151
CM2
NO
YES
S152
READ RAM 22 AND RAM 23
S153
COINCIDE
COLLATE
NOT COINCIDE
S154
REFER TO RAM 24
S155
STOP FRAG
YES
NO
S156
READ m FROM RAM 25
S157
s=0
S158
s : m
≠
=
S160
SLOT UP
NO
YES
S161
s=s+1
GENERATE RESPONSE PULSE
S159
S162
PERFORM OTHER PROCESSES ACCORDING TO THE COMMANDS
RETURN

SYSTEM PROCESS
S503

S531
CM1
NO
YES
S542
CM6
NO
YES
S532
READ RAM 32 AND RAM 33
S543
RESTORE RAM 32, RAM 33 AND RAM 34
S533
COLLATE
COINCIDE
NOT COINCIDE
S544
REAFORM OTHER PROCESSES ACCORDING TO THE COMMANDS
REFER TO RAM 34
S534
S535
STOP FLAG
YES
NO
S536
READ g FROM RAM 35
s=0
S537
S538
s : g
=
≠
S540
SLOT UP
NO
YES
S541
s=s+1
GENERATE RESPONSE PULSE
S539
RETURN

POINT PROCESS
S507

S551
CM1
NO
YES
S552
READ RAM 32 AND RAM 33
S553
COLLATE
COINCIDE
NOT COINCIDE
S562
RERFORM OTHER PROCESSES ACCORDING TO THE COMMANDS
REFER TO RAM 34
S554
S555
STOP FLAG
YES
NO
S556
READ m FROM RAM 35
S557
s=0
S558
s : m
=
≠
S560
SLOT UP
NO
YES
S561
s=s+1
GENERATE RESPONSE PULSE
S559
RETURN

FIRE ALARM SYSTEM

BACKGROUND OF THE INVENTION

1. Field of the Invention

This invention relates to a fire alarm system in which terminal units, such as fire detectors, are connected to a receiving portion and the terminal units are given unique addresses so that a particular terminal unit having a status change can be detected.

2. Description of the Related Art

A conventional fire alarm system in which terminal units, such as fire detectors, are connected to a receiving portion thereof, and the terminal units are given unique addresses so that a terminal unit having a status change is detected, has been disclosed in Japanese Patent Laid-Open No. 2-201597. Such a system is capable of enabling the receiving portion to quickly detect a terminal unit among the terminal units that has a status change.

The structure of the foregoing system has an arrangement such that the terminal units are divided into a plurality of groups. The timings at which the terminal units respond to the receiving portion are made to be different among the groups of the terminal units. A terminal unit having a status change responds to the receiving portion (system polling) at a response timing for the group to which the terminal unit having the status change belongs. Timings at which terminal units belonging to the group to which the terminal unit that has responded to the receiving portion at the system polling belongs, are made to be different among the terminal units in the group. The terminal unit having the status change responds to the receiving portion at the response timing for the terminal unit (point polling), and the receiving portion collects specific information from the terminal unit that has responded to the receiving portion at the point polling (selecting).

Thus, the operation for obtaining predetermined information is performed for only the terminal unit having the status change. The operation for obtaining the predetermined information is not performed for the terminal units that are free from status changes. Therefore, the status change of a terminal unit can be detected in a shorter time as compared with a structure in which the predetermined information is intended to be sequentially obtained from all terminal units.

The foregoing terminal units which are connected to the receiving portion are fire detectors, smoke blocking and exhausting units and transmitters. If the transmitter is operated, a fire alarm is generated within a predetermined time from the commencement of the operation and a response lamp of the transmitter that has been operated must be turned on. If many terminal units have status changes in a system comprising a multiplicity of terminal units, there is a risk that the fire alarm cannot be generated within the predetermined time.

In a case where 256 terminal units are divided into, for example, four groups, polling is performed for each of the four groups and all four groups have responded to the polling (a status change that does not relate to a fire is included), point polling must be performed for all four groups. If many terminal units in one group have status changes, all the terminal units having the status changes must be subjected to the selecting operation so that the receiving portion collects predetermined information from each of the terminal units.

In the above example, if the operated transmitter belongs to, for example, the fourth group, information collection starts at the terminal unit (the terminal unit having the status change) belonging to the first group and therefore a problem occurs in that a long time is required to collect information from the transmitter after commencement of the information collection from the terminal unit belonging to the first group.

Also the fire detectors, gas detectors and the like that are connected together with the terminal units to be controlled have a similar problem in that a long time is required to collect information from a fire detector or a gas detector having a status change after commencement of the information collection from the terminal unit belonging to the first group and arranged to be linked to a smoke blocking and exhausting unit.

The fire detectors include, in its category, non-accumulative type fire detectors having no accumulating function. The system having the non-accumulative type fire detector has an arrangement such that the fire receiver performs the accumulating operation. That is, the fire receiver checks the level of the fire detector at each predetermined timing after the fire receiver has discriminated that the fire detector had detected a level higher than a fire level, accumulation of the fire detector is completed if the number of times exceeding the predetermined level is larger than a predetermined number of times, and a discrimination is made that a fire has been detected and thus the alarming operation is completed. After the accumulation has been completed, the operation of the fire detector has been determined. Therefore, the receiver does not need to collect information from the fire detector.

It the detected smoke density is lower than a fire level though the operation of the fire detector has been determined, a discrimination is made that the status of the fire detector has been changed. Since the foregoing conventional system has the arrangement such that a response to the fire receiver is made when the status of the fire detector has been changed, a response to the fire receiver is undesirably made even if a state of non-fire phenomenon has been restored. As a result, if the detected smoke density is lower than the fire level, a response to the fire receiver is undesirably repeated. If the detected smoke density is raised higher than the fire level, the fire detector discriminates that the status has been changed and responds to the receiver.

If the detected smoke density is repeatedly raised and lowered in the vicinity of the fire level even after the operation of the fire detector has been determined and the fire receiver has issued an alarm in response to the fire detector, the fire detector frequently responds to the fire receiver. Thus, the number of the responses to the fire receiver becomes too large and therefore the process to be performed by the fire receiver is undesirably delayed.

The accumulative type fire detector has an arrangement such that the fire detector performs the accumulating operation and the operation is determined in response to the fire receiver after the accumulation has been completed. If the detected smoke density is lower than the fire level afterwards, the status is changed and a response to the fire receiver is made. If the detected smoke density is raised afterwards higher than the fire level, the accumulation is again started. After the accumulation has been completed, a response to the fire receiver is made. Therefore, the accumulative type fire detector also experiences the problem of repetition resulting from the rising and lowering of the detected smoke density in the vicinity of the fire level. This repetition undesirably increases the number of response times to the fire receiver and thus the process to be performed by the fire receiver is critically delayed.

The transmitter is the same as the accumulative fire detector from the viewpoint that the operation has been determined when it transmits the response signal to the fire receiver. Therefore, the transmitter has a problem similar to that of the accumulative type fire detector. That is, a discrimination is made that the status of the transmitter is changed if the switch is switched off after the switch has been switched on. Thus, the transmitter responds to the fire receiver and again responds to the fire receiver if the switch is again switched on. As a result, the repetitive switching of the switch of the transmitter undesirably increases the number of response times to the fire receiver and thus a problem arises in that the process to be performed by the fire receiver is delayed.

The fire detectors which are connected to the fire receiver include a multi-signal-type fire detector having at least two fire levels of the following three levels: a fire level 1 (a level in which a fire is discriminated if a smoke density converted into an obscuration ratio is 5% /m), a fire level 2 (a level in which a fire is discriminated if a smoke density is 10% /m) and a fire level 3 (level in which a fire is discriminated if a smoke density is 15% /m). In the case in which the fire detector transmits a signal corresponding to the fire levels 2 and 3 and as well as in a case where the fire receiver is arranged to discriminate a fire when, for example, the fire level 2 is realized, the fire detector transmits a signal denoting the fire level 2 and the operation is discriminated with the fire level 2 after the smoke density has been raised gradually. If the smoke density is later raised to reach the fire level 3, the fire detector again responds to the fire receiver. Also in this case, the number of responses to the fire receiver is increased undesirably and a problem arises in that the process to be performed by the fire receiver is critically delayed. A similar problem arises in the case where a phenomenon, such as heat, light, gas or smell is detected.

Since the conventional system issues a fire alarm only when the fire level transmitted from the fire detector has been raised to the level set in the fire detector, a desire to detect a fire prior to the foregoing moment cannot be satisfied.

The value of the smoke density to be detected by the multi-signal-type fire detector is not monotone-increased even in an increase tendency and usually repeats increases and decreases in the form of waves. The detected smoke density is sometimes raised and lowered in the vicinity of the fire level. In the foregoing case, if the detected smoke density exceeds the fire level, the fire detector experiences a status change and responds to the fire receiver. If the detected smoke density is lower than the fire level, the fire detector will have a status change and will respond to the fire receiver. The foregoing operations are repeated. Therefore, the repetitive rising and lowering of the detected smoke density in the vicinity of the fire level excessively increases the number of responses made to the fire receiver.

If a desired fire level for the multi-signal-type fire detector is the fire level 2, a response to the fire receiver is made when the fire level 1 has been realized in a case where the smoke density is raised gradually. If the detected smoke density repeatedly rises and lowers in the vicinity of the fire level 1 (the multi-signal-type fire detector is repeatedly turned on/off at the fire level 1), the number of responses to the fire receiver is increased excessively and a problem arises in that the process to be performed by the fire receiver is delayed. A similar problem arises in the case where heat, light, gas or smell is detected to discriminate a fire phenomenon.

In a case where the accumulating function is exhibited at the detection of a fire by causing the fire detector to have the accumulating function, a problem arises in that the number of parts of the fire detector increases excessively because the parts for the accumulating function must be provided. In addition, a memory capacity required to perform the accumulating operation must be provided for the fire detector. That is, a problem arises in that the fire detector must have a large memory capacity.

In a case in which the conventional system has the arrangement such that the address to be given to the terminal units is composed of, for example, 8 bits, 256 addresses can be created. Thus, a maximum of 256 terminal units each having an inspection function can be used.

If a fire alarm system having greater than 256 terminal units is desired, the 8-bit address will be insufficient to constitute the system. Thus, 9 bits or more must be provided for forming the addresses and a longer time would be required to call each address. Since a microprocessor is usually operated in units of 8 bits, use of incomplete bits, such as 9 bits or 10 bits, poses a problem in that a uniform process cannot easily be performed.

As described above, the conventional fire alarm systems experience the foregoing problems.

SUMMARY OF THE INVENTION

An object of the present invention is to provide a fire alarm system which is capable of causing a receiving portion to quickly receive fire information that is transmitted from a transmitter or the like in a case where a terminal unit, such as the transmitter, having a priority has been operated even if the fire alarm system has a large size.

Another object of the present invention is to provide a fire alarm system which is capable of preventing delay in the process to be performed by a fire receiver even if a detected level is repeatedly raised and lowered in the vicinity of a fire level after the operation of the terminal unit has been determined.

Another object of the present invention is to provide a fire alarm system having an arrangement such that a level at which a fire alarm is issued is stored in a receiving portion for cases in which the fire detector is a multi-signal-type fire detector and the receiving portion discriminates a fire in accordance with information supplied from the fire detector.

Another object of the present invention is to provide a fire alarm system capable of issuing a previous alarm from a receiving portion prior to issuing a usual fire alarm.

Another object of the present invention is to provide a fire alarm system adapted for a case in which a level signal received from a multi-signal-type fire detector among a plurality of terminal units is discriminated by a receiving portion and the multi-signal-type fire detector is used at a predetermined fire level (for example, the fire level 2) and capable of preventing delay in the process to be performed by the receiving portion due to an increase in the response signals supplied to the receiving portion when the multi-signal-type fire detector is repeatedly turned on and off at a smoke density (for example, the fire level 1) lower than a predetermined fire level.

Another object of the present invention is to provide a fire alarm system which is capable of preventing increases in the number of parts of a fire detector in a case where an accumulating function is exhibited at the detection of a fire and the memory capacity of the fire detector can be reduced.

Another object of the present invention is to provide a fire alarm system adapted for a case in which a plurality of terminal units are subjected to system polling, point polling and selecting, is capable of shortening the time required to call each address, and is able to overcome difficulty in performing a uniform process because incomplete bits must be used to form addresses in a case where the size of the fire alarm system is increased and, thus the number of the terminal units to which the addresses must be given is increased.

The first aspect of the present invention is adapted to a fire alarm system in which terminal units, such as fire detectors, are connected to the receiving portion and each terminal unit has an address. A terminal unit having a status change is detected, and the present invention has an arrangement such that system polling of a specific terminal unit, such as a transmitter, among the terminal units is performed prior to performing the system polling for other terminal units.

The second aspect of the present invention has an arrangement such that, in a case where a plurality of terminal units are subjected to system polling, point polling and selecting, a fire determined command is transmitted to a terminal unit, the operation of which has been determined, to cause the terminal unit to stop responding to the receiving portion.

The third aspect of the present invention has an arrangement such that a receiving portion discriminates the smoke level supplied from a multi-signal-type fire detector and, if the received level is a desired fire level, a discrimination is made such that a fire level has been realized and a required operation is performed.

A fourth aspect of the present invention is adapted to a fire alarm system in which a receiving portion, such as a fire receiver, and a plurality of fire detectors are connected by signal lines, the receiving portion calls the fire detector by polling, if the fire detector has a status change, the fire detector having the status change responds to the call from the receiving portion, and the receiving portion collects status information from only the fire detector that has made the response. The fourth aspect having an arrangement such that, if the fire detector detects an n−1 level in a case where the fire detector is a multi-signal-type fire detector and the receiving portion has n (n is an integer larger than 2) fire levels, the receiving portion issues a previous alarm.

A fifth aspect of the present invention has an arrangement such that a receiving portion, such as a fire receiver, discriminates the smoke level supplied from a multi-signal-type fire detector, if the received level is not a desired fire level, a level stop command for causing the multi-signal-type fire detector subsequent to stop transmission of a response signal of the received fire level, and the multi-signal-type fire detector that has received the level stop command does not respond to the receiving portion at the foregoing fire level.

The sixth aspect of the present invention is adapted to a fire alarm system in which a receiving portion, such as a fire receiver, and a plurality of fire detectors are connected by signal lines, the receiving portion calls the fire detector by polling, if the fire detector has a status change, the fire detector having the status change responds to the call from the receiving portion, and the receiving portion collects status information from only the fire detector that has made the response. The sixth aspect having an arrangement such that a timer means is provided which starts counting of a predetermined time when the receiving portion has collected fire alarm as status information from the fire detector and clears the counting of the predetermined time. A discrimination is made that an accumulating operation in the fire detector has completed and the fire alarm has been issued when the timer means completes the counting of the predetermined time.

A seventh aspect of the present invention has an arrangement such that, in a case where terminal units are divided into groups and the groups are subjected to system polling, the plurality of the groups are divided into a plurality of tracks, track information is included in a command and each track is subjected to the system polling.

Since the first aspect of the present invention is adapted to a fire alarm system in which terminal units, such as fire detectors, are connected to the receiving portion, each terminal unit has an address and a terminal unit having a status change is detected, and has an arrangement such that system polling of a specific terminal unit, such as a transmitter, among the terminal units is performed prior to the system polling for other terminal units, thus fire information from the transmitter or the like can be quickly received by the receiving portion in a large scale fire alarm system if the transmitter or the like is operated.

Since the second aspect of the present invention has an arrangement such that, in a case where a plurality of terminal units are subjected to system polling, point polling and selecting, a fire determined command is transmitted to a terminal unit, the operation of which has been determined, to cause the terminal unit to stop responding to the receiving portion. Thus, no response to the fire receiver is performed even if the detected level repeats rising and lowering in the vicinity of the fire level after the operation of the fire detector has been determined, and therefore the process to be performed by the fire receiver cannot be delayed.

Since the third aspect of the present invention has an arrangement such that the level supplied from the multi-signal-type fire detector is discriminated by the receiving portion, the fire level can easily be changed by changing data in the receiving portion. Furthermore, a fire detector can be disposed regardless of the discrimination level.

Since the fourth aspect of the present invention has the arrangement that, if the fire detector is a multi-signal-type fire detector and the receiving portion has n fire levels, the receiving portion issues a previous alarm when the fire detector detects n−1 level, the previous alarm can be issued in the polling selecting method prior to issuing a usual fire alarm.

Since the fifth aspect of the present invention has the arrangement such that a receiving portion discriminates the smoke level supplied from a multi-signal-type fire detector, if the received level is not a desired fire level, a level stop command for causing the multi-signal-type fire detector subsequent to stop transmission of a response signal of the received fire level, and the multi-signal-type fire detector that has received the level stop command does not respond to the receiving portion at the foregoing fire level, even if the multi-signal-type fire detector is repeatedly turned on and off at a smoke density lower than the predetermined fire level, the increase in the response signals to the receiving portion due to the repetition can be prevented. Therefore, delay in the process to be performed by the receiving portion can be prevented.

Since the sixth aspect of the present invention has an arrangement such that a timer means is provided which starts counting of a predetermined time when the receiving portion has collected fire alarm as status information from the fire detector and which clears the counting of the predetermined time, and a discrimination is made that an accumulating operation in the fire detector has completed, the accumulating function can be exhibited at the detection of a fire even if a fire detector having no accumulating function is used. Therefore, the number of parts of the fire detector cannot be increased if the accumulating function is exhibited at the time of the fire detection. Furthermore, the fire detector does not require a large memory capacity.

Since the seventh aspect of the present invention has an arrangement such that, in a case where terminal units are divided into groups and the groups are subjected to system polling, the plurality of the groups are divided into a plurality of tracks, system polling is performed for each track and the track information is included in a command, the time taken to call each address cannot be lengthened if the number of the terminal units, to each of which the address must be given, is increased. Furthermore, the difficulty in performing a uniform process occurring due to using incomplete number of bits for forming the addresses can be overcome.

BRIEF DESCRIPTION OF THE DRAWINGS

FIG. 7 is a flow chart showing the basic operation of a fire receiver RE according to the foregoing embodiment;

FIG. 14A shows the relationship between the operation levels and fire levels;

FIG. 17 is a flow chart showing an example of the control interruption that is performed by the fire receiver RE according to the foregoing embodiment and that is generated arbitrarily;

DESCRIPTION OF THE PREFERRED EMBODIMENTS

Figure 1:
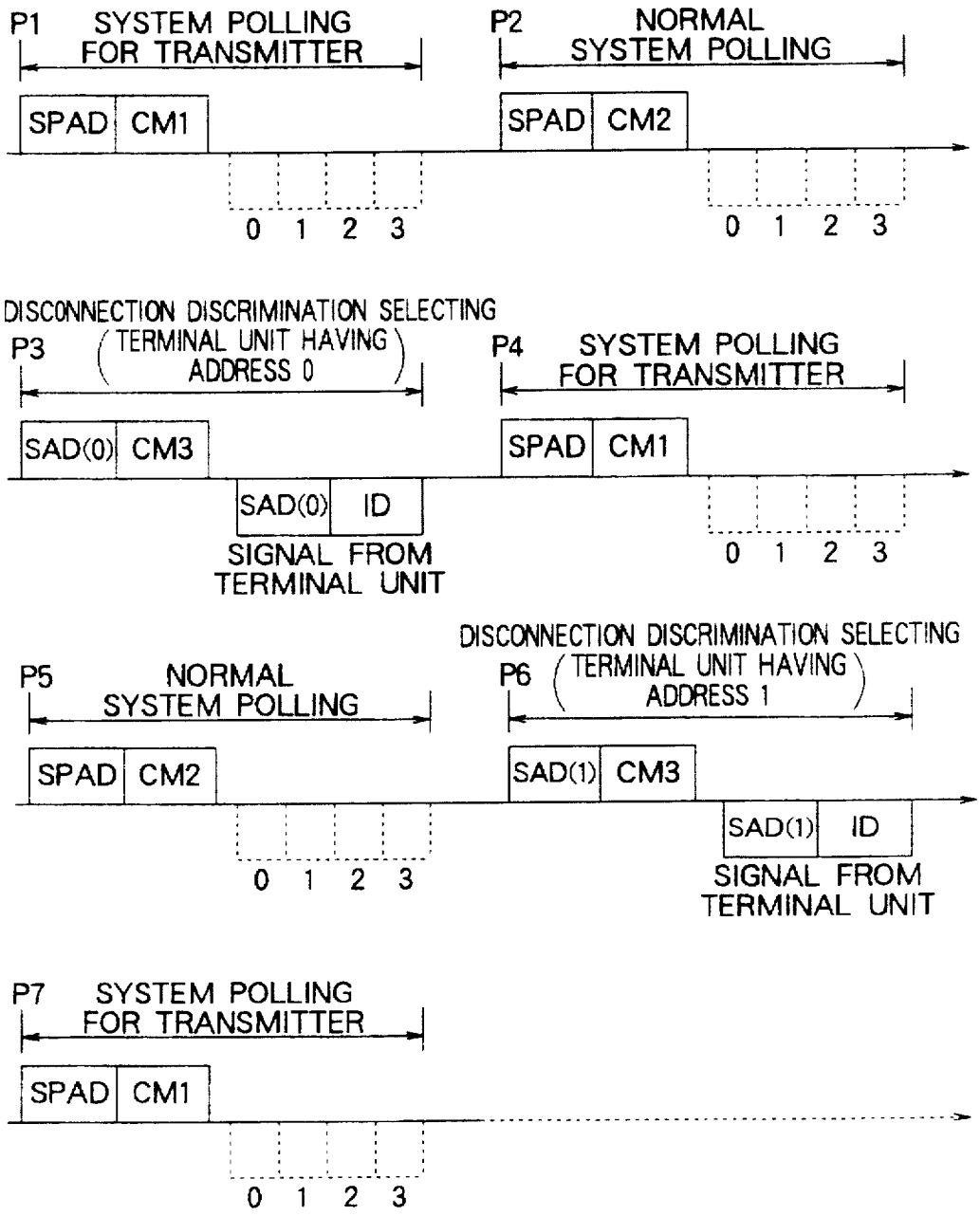
FIG. 1 is a timing chart showing an embodiment of the present invention.
Figure 2:
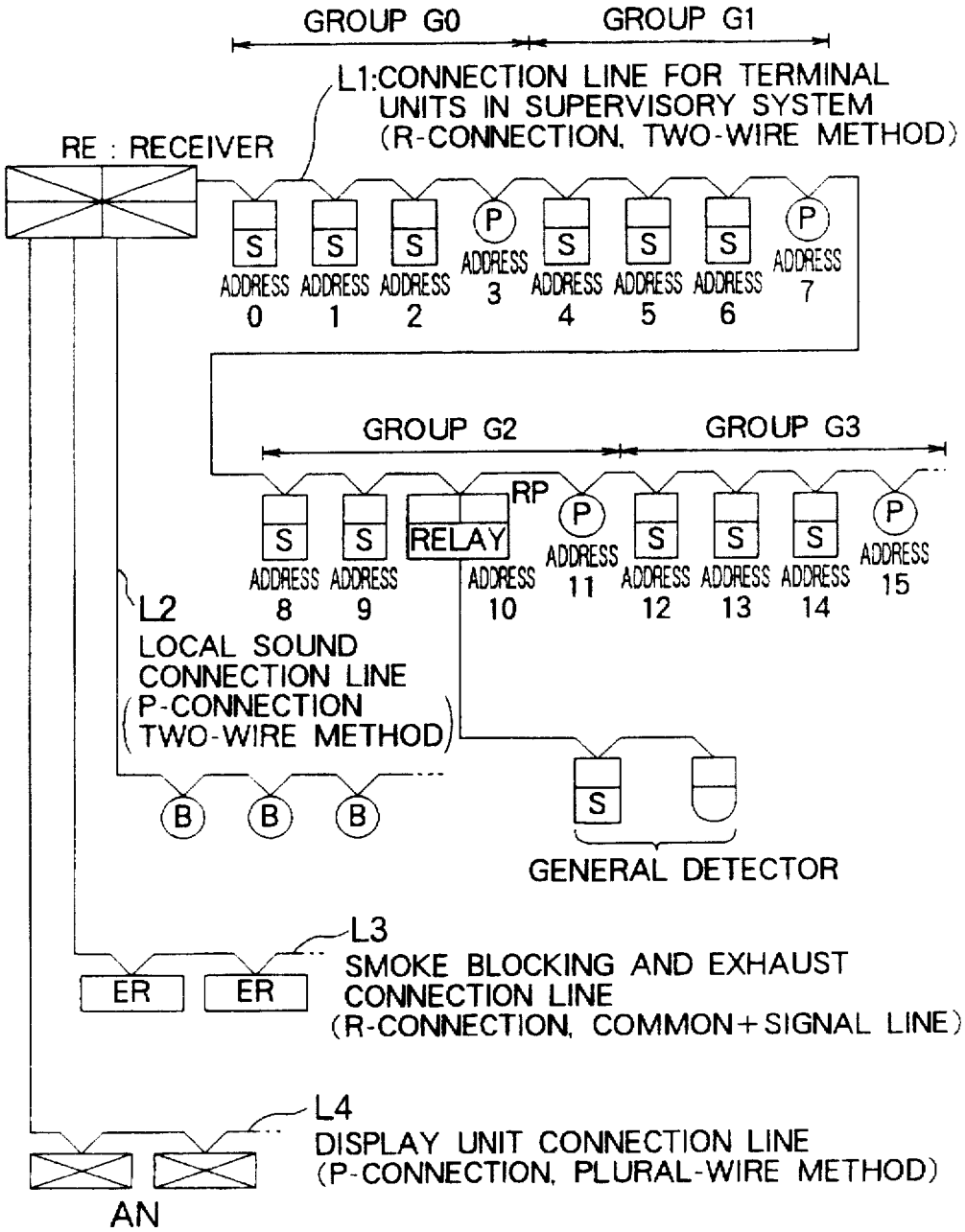
FIG. 2 is a diagram of a circuit for use in the fire alarm system to which the embodiment is applied.
Figure 3:
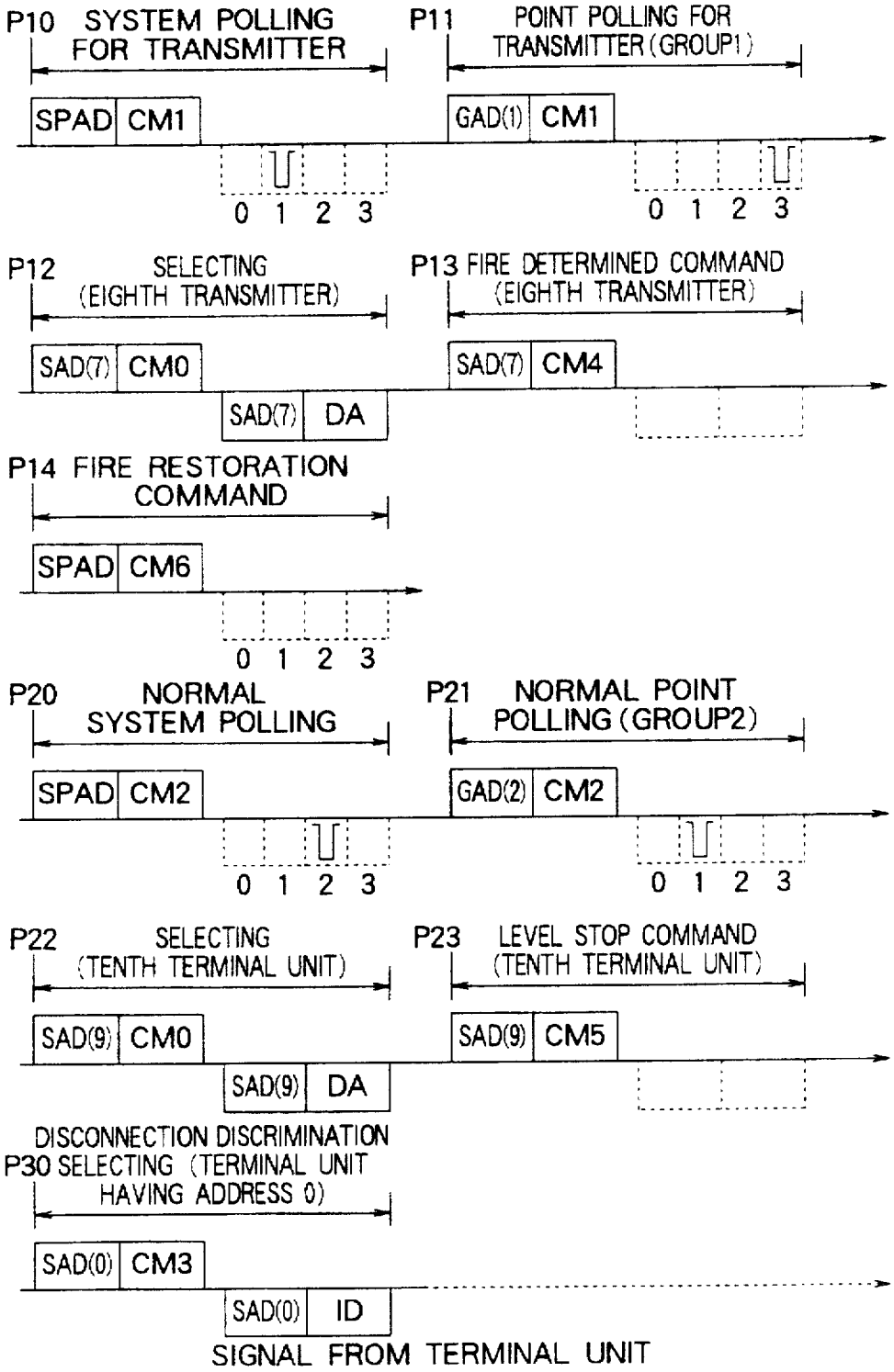
FIG. 3 is a timing chart showing another operation in the embodiment.

FIG. 1 is a timing chart showing an embodiment of the present invention. FIG. 2 is a circuit diagram for a fire alarm system to which the embodiment is adapted. FIG. 3 is a timing chart showing another operation of the foregoing embodiment.

Referring to FIG. 2, a variety of terminal units, such as smoke, heat, flame, gas or a smell type fire detectors S, transmitters P and relays RP, are connected to a fire receiver RE, which is an example of a receiving portion. The terminal units have individual addresses and are divided into four groups G0, G1, G2 and G3.

The group G0 includes three fire detectors S and one transmitter P, the group G1 includes three fire detectors S and one transmitter P, group G2 includes two fire detectors S, one relay RP and one transmitter P, and group G3 includes three fire detectors S and one transmitter P. The terminal units have corresponding addresses 0 to 15 such that the terminal unit in group G0 has an address 0, the address being increased sequentially. A plurality of general detectors (each having no address) of an on/off type detector that transmits a fire signal when circuits thereof are short-circuited are connected to the relay PR having address 10. Although four terminal units are included in one group in the foregoing group, the number of the terminal units is not limited to four. Also the number of the groups is not limited to four.

To the receiver RE, a plurality of local bells B are connected through local sound connection lines L2, a plurality of smoke blocking and exhausting units ER are connected through smoke blocking and exhausting lines L3, and a plurality of display units AN are connected through display unit connection lines L4.

In the foregoing embodiments, the local bells B, the smoke blocking and exhausting units ER and the display units AN in a controlled system do not have addresses. The foregoing units are controlled (connected in a so-called P-connection manner) by connecting/disconnecting the lines L2 to L4 for the corresponding terminal units or the systems. The address of each of the fire detectors S, the transmitters P and the relays RP in a supervisory system is appointed by serial transmission or the like through two common signal lines L1 also serving as power sources (see FIG. 4) so as to be controlled individually (connected in a so-called R-connection).

The receiver RE performs system polling for a transmitter, point polling for the transmitter and selecting prior to performing normal system polling, normal point polling and selecting.

The normal system polling is polling in which the terminal units are previously divided into a plurality of groups and a terminal unit having a status change is not specified, but each group is examined to determine whether or not a terminal unit having a status change is present. That is, the terminal unit groups have individual timings at which the group respond to the receiver RE and a terminal unit having a status change responds to the receiver RE (for example, by transmitting pulses) at the timing assigned to a group including the terminal that has the status change.

The normal point polling is polling for specifying a terminal unit that has responded to the normal system polling (that is, polling for specifying a terminal unit having a status change). In this polling, the receiver RE calls a terminal unit belonging to the group that has responded to the receiver RE in the normal system polling. The timings at which the respective terminal units in the foregoing group respond to the receiver RE are made to be different from one another (for example, the responding timings are made to be different from one another by transmitting pulses), and the terminal unit having the status change responds to the receiver RE (for example, by transmitting pulses) at the responding timing assigned to the terminal unit having the status change.

The selecting in the normal point polling is polling to be performed in a case where a terminal unit has responded to the receiver RE in the normal point polling, the selecting being performed in such a manner that the receiver RE calls a terminal unit of the terminal units in the subject group that has responded to the receiver RE in the normal point polling and the receiver RE collects specific information (for example, in the form of a code signal).

The system polling for a transmitter is polling in which only transmitters among the terminal units are previously divided into a plurality of groups, a transmitter having a status change is not specified, but each group is examined to determine whether or not a transmitter having a status change is present. That is, the transmitter groups have individual timings at which they respond to the receiver RE, and a transmitter having a status change responds to the receiver RE at the timing assigned to the group to which the transmitter having the status change belongs (for example, by transmitting pulses).

The point polling for a transmitter is polling for specifying a transmitter that has responded to the system polling for a transmitter. A transmitter belonging to a group that has responded to the receiver RE in the system polling for a transmitter is called, the transmitters in the group have different timings at which they respond to the receiver RE, and the transmitter having a status change responds to the receiver RE at the response timing assigned to the transmitter (for example, by transmitting pulses).

The selecting in the point polling for a transmitter is polling to be performed in a case where a transmitter P has responded to the receiver RE in the point polling for a transmitter, the selecting being performed in such a manner that the transmitter P among transmitters P in the subject group that has responded to the receiver RE in the point polling for a transmitter is called and the receiver RE collects specific information (for example, in the form of a code signal).

If the receiver RE has sequentially called a plurality of terminal units demanding them to transmit specific information and has received the specific information from a subject terminal unit, a discrimination is made that no disconnection has taken place between the receiver RE and the subject terminal unit. If type information is used as the specific information, the receiver RE collates type information supplied from the terminal unit and received by the receiver RE and type information of the subject terminal unit registered in the receiver RE. If the two types of information do not coincide with each other, a discrimination is made that the type of the terminal unit has been changed.

The operation of this embodiment will now be described.

Referring to FIGS. 1 and 3, the operation proceeds from the upper left portion toward the upper right portion, and then the operation proceeds from the foregoing right end to the left end below the foregoing step. The operation proceeds sequentially in the foregoing manner.

Referring to FIGS. 1 and 3, the operation of the receiver RE is shown above a horizontal line and the operation of the transmitter P or a terminal unit except the transmitter P is shown below the horizontal line. Also referring to FIGS. 1 and 3, the dashed-line columns show response timings of a signal denoting generation of status changes, omission of description in the dashed-line columns display that a signal changing a status change was not transmitted from the transmitter P or a terminal unit except the transmitter P (that is, no response to the polling was made). Pulse waveforms in the dashed-line columns show responses made to the receiver RE at the timings shown in the dashed-line columns, and continuous-line columns below the horizontal lines show signals returned from a transmitter P or the like to the receiver RE.

FIG. 1 is a timing chart in a case where a transmitter P or the like having a status change is not present (that is, it is a time chart in a normal state). FIG. 3 is a time chart in a case where a transmitter P or the like having a status change is present.

At P1 shown in FIG. 1, the system polling for a transmitter is performed prior to performing the normal system polling for determining whether or not there is a transmitter P that has been operated. That is, all terminal units are divided into groups (four in the structure shown in FIG. 1). The receiver RE transmits signal SPAD.CM1 denoting a status information return command in the system polling for a transmitter. Upon receipt of the signal SPAD.CM1, the transmitter (operated transmitter) P having the status change responds to this by transmitting a pulse denoting the status change at the response timing for any of the groups G0 to G3 (individual response timing is previously given to each group) to which the transmitter P belongs.

If there is no transmitter P having a status change in the system polling for a transmitter, the normal system polling is performed at P2 shown in FIG. 1 in order to determine whether or not a status change has occurred in any of all terminal units including the transmitter P. That is, the receiver RE transmits code SPAD.CM2 denoting status information return command in the normal system polling. Upon receipt of the code SPAD.CM2, a terminal unit responds to this by transmitting a pulse denoting the status change at the response timing assigned to any of the groups G0 to G3 (individual response timings have been previously given to the groups) to which the terminal unit belongs.

In the normal system polling, if there is no terminal unit having a status change, a terminal unit having address 0 is subjected to disconnection discrimination selecting at P3 shown in FIG. 1. That is, it is determined whether or not the terminal unit having address 0 has been encountered (that is, whether or not the connection has been established) by transmitting code SAD(n).CM3 (n is a number changing the address and is zero in this case) changing a type information return command. If the terminal unit having address 0 returns to the receiver RE code SAD(n).ID (ID is the type and n is zero) denoting the self-address and the type of the fire detector upon receipt of the code SAD(n).CM3, the receiver RE is able to confirm that no disconnection has taken place from the terminal unit having address 0.

Then, the system polling for a transmitter, which is the same as the system polling for a transmitter at P1 is again performed at P4 shown in FIG. 1. At P5 shown in FIG. 1, the normal system polling, which is the same as the normal system polling at P2, is again performed. At P6 shown in FIG. 1, a terminal unit having the next address 1 is subjected to the disconnection discrimination selecting similar to that performed at P3. At P7 shown in FIG. 1, the system polling for a transmitter similar to that at P1 is performed. The foregoing operations are repeated. That is, the system polling for a transmitter and the normal system polling are repeated and the next terminal unit having the address increased by one is subjected to the disconnection discrimination selecting whenever one cycle of the foregoing system polling operations is completed.

Since the system polling for a transmitter is, in this embodiment, always performed prior to performing the normal system polling even if the duration for completing the normal system polling and the ensuing normal point polling and the selecting is long, the receiver RE is able to quickly detect fire information transmitted from the transmitter P if the transmitter P, which is operated depending upon the judgment made by a person, is operated. Therefore, the greater the size of the fire alarm system, the greater the quality of results which are obtained.

In the foregoing embodiment, the fire alarm system, which comprises the terminal units in the supervisory system for supervising a fire phenomenon, the receiver and the terminal units in the controlled system to be controlled by the receiver has the arrangement such that the terminal units in the supervisory system have individual addresses, the terminal units in the supervisory system and the receiver communicate with each other (R-connected) by a serial transmission through the addresses, and the terminal units in the controlled system are connected (P-connected) to the receiver so as to be turned on/off through individual signal lines.

That is, all local bells B are connected to the two local sound connection lines L2 (see FIG. 4) so as to be collectively turned on/off. The smoke blocking and exhausting connection line L3 comprises a common line and individual signal lines connected to corresponding smoke blocking and exhausting units ER, that is, it comprises (the number of smoke blocking and exhausting units ER+1) signal lines which are not shown. Each smoke blocking and exhausting unit ER is individually turned on/off. The display unit connection line L4 comprises a plurality of signal lines determined to be adaptable to the contents to be displayed (not shown). All display units are connected among the foregoing signal lines. When a predetermined signal line is turned on/off, a common content is displayed on each display unit. The connection line L1 for the terminal unit in the supervisory system comprises two signal lines (see FIG. 4). All fire detectors S and transmitters P are connected between two signal lines in such a manner that the units have individual addresses. By transmitting/receiving signals with given addresses, information is individually transmitted/received. Although the foregoing embodiment employs a method in which the local bells B are simultaneously rung, a method may be employed in which the local bells B may be individually controlled like the smoke blocking and exhausting connection lines L3 so as to be rung simultaneously.

Since the terminal units in the supervisory system are R-connected and the terminal units in the control system are P-connected, the R-lines connected to the terminal units in the supervisory system can be minimized to two. Thus, the wiring space can be reduced. In the case of a small-size fire alarm system comprising a small number of terminal units in the control system, the number of P-lines connected to the terminal units in the control system can be decreased. Therefore, the wiring space can be reduced. Although a relay must be disposed for the case where the terminal units in the control system are R-connected, the P-connection of the terminal units in the control system enables the relay to be omitted. As a result, the space required for the relay can be used effectively and supervision of the fire can be performed quickly because the supervisory system and the control system both use individual lines. Furthermore, a process for transmitting command codes can be performed easily and the load that must be borne by the receiver RE can be reduced. Therefore, the discrimination can easily be made.

Similar to the terminal unit in the supervisory system, at least one of the fire detector, the relay and the transmitter is required to be connected. Similar to the terminal unit in the control system, at least one of units to be controlled, the local sound unit, a fire block door, a smoke blocking damper and the display unit, is required to be connected.

FIG. 3 is a timing chart showing the operation of the transmitter P having a status change or the operation to be performed in a case where the status of a terminal unit, except the transmitter P, has been changed.

At P10 shown in FIG. 3, the system polling for a transmitter is performed and a response of any transmitters P belonging to the group G1 (the status change of the transmitter P) is indicated because a pulse is returned from the transmitter P at the second timing. At P11 shown in FIG. 3, the group G1 is subjected to the point polling for a transmitter. That is, the receiver RE transmits to a terminal unit code GAD(g).CM1 (g is a number denoting the group) denoting the point polling for a transmitter for discriminating the transmitter P which belongs to the group G1 and which has made a response. Since a pulse is, at the fourth timing for the group G1, returned from the transmitter P in the group G1 in response to the foregoing polling, it means that the transmitter P (the eighth transmitter P) having address 7 which is the fourth address of the four transmitters P belonging to the group G1 has made the response. At P12, the receiver RE subjects the transmitter P having the address 7 to the selecting and requires data.

That is, the receiver RE transmits code SAD(n).CM0 (n is a number denoting the address which is 7 in this case) denoting a status information return command to be issued to the terminal unit having the address 7. Upon receipt of the code SAD(n).CM0, the transmitter P having the address 7 transmits to the receiver RE signal SAD(n).DA (DA is data required to be transmitted which is a fire signal set as the data in this case and n is 7) denoting the self-address and data required to be transmitted.

At P13 shown in FIG. 3, the receiver RE transmits to the eighth transmitter P code SAD(n).CM4 (n is a number denoting the address which is 7 in this case) denoting a fire determined command in accordance with the received data DA. Thus, the eighth transmitter P turns on a response lamp and the alarm issued from the eighth transmitter P can reliably be displayed.

The fire determined command is a command for inhibiting the terminal unit among the terminal units, the operation of which has been determined, to respond to the receiver RE. If the receiver RE has discriminated that the terminal unit has detected a fire in accordance with the status information collected by the receiver RE from the terminal unit by the selecting and alarm process such as display of a fire block or the like (that is, if a fire of the terminal unit has been determined), the fire determined state for the terminal unit is not suspended until a fire restoring operation is performed. If the terminal unit continues response to the system polling or the point polling after the fire has been determined, the receiver RE performs meaningless processes for the terminal unit though the fire determination is maintained. The meaningless processes delay the polling operation and the selecting operation for the other terminal units, the operation of which has not been determined.

The receiver RE, by selecting, transmits to the terminal unit that has been determined to be caught in a fire (that is, the terminal unit, the operation of which has been determined) the fire determined command so that the ensuing response of the terminal unit to the system polling and the point polling is inhibited. Although the foregoing description has been made for the case where a fire has been determined, a structure may be employed such that the response to the system polling and the point polling is inhibited in accordance with the fire determined command in also a case where the operation of the terminal unit has been determined due to breakdown of the fire detector (for example, impossible for its light emitting device to emit light) or disconnection of, for example, a secondary electricity passage of the relay.

In a case where the transmitter P has its button depressed, the receiver RE displays the fire block or the address to issue an alarm. Thus, the operation of the transmitter P is determined.

Therefore, the eighth transmitter P that has received the fire determined command SAD(7).CM4 from the receiver RE stops response to the ensuing system polling and point polling. When the receiver RE transmits fire restoring command SPAD.CM6 at P14 at the time of restoring the system after the process against the fire has been completed, the transmitter P that has received the fire determined command as described above is restored in response to a fire restoring signal.

After the system polling for a transmitter, the point polling for a transmitter and the selecting have been completed, the normal system polling, the normal point polling and the selecting are performed.

That is, the normal system polling is performed at P20 shown in FIG. 3, the status of the terminal units, such as the fire detector S, belonging to the group G2 is changed, and the normal point polling is performed at P21 shown in FIG. 3. Namely, the receiver RE, at P20, transmits code SPAD.CM2 denoting the status information return command in the normal system polling, a pulse is returned at the third timing, the status information return command GAD (g).CM2 (g is a number which denotes the group which is two in this case) in the normal point polling is transmitted to the terminal unit in the group G2 at P21. Since a pulse is returned from the terminal unit, it indicates that the status of the second terminal unit (the tenth terminal unit) among the four terminal unit belonging to the group G2 has changed. Thus, the receiver RE subjects the tenth terminal unit (having address 9) to the selecting at P22 shown in FIG. 3 to require data. That is, the receiver RE transmits the address of the terminal unit that has received the response signal and the status information return command SAD(n).CM0 (n is a number denoting the address which is 9 in this case). The terminal unit having the address 9 transmits code SAD(n) .DA (n is 9 in this case and DA is the data required to be transmitted) denoting the self-address and the data required to be transmitted to the receiver RE.

At P22 shown in FIG. 3, the receiver RE performs an operation required for the signal level of the data DA. The signal level will now be described. A fire detector usually has, in a case of a smoke detector, three levels from 1 to 3. Specifically, a smoke density converted into an obscuration ratio of 5% /m is determined to be at level 1, 10% /m is determined to be at level 2 and 15% /m is determined to be at level 3. A storage means of the receiver RE to be described later stores the fire discrimination levels at which the fire alarm must be issued. The fire discrimination levels at respective addresses are stored. Furthermore, linked information (information of, for example, the operation of a terminal unit to be controlled) for each level is stored. Thus, an operation corresponding to the level is performed. The receiver RE determines whether or not data transmitted from the terminal unit having the address 9 is a signal with which a fire alarm must be issued (for example, a signal of level 2). If the data received from the terminal unit is a signal of the level 1 for example, the receiver RE, at P23 shown in FIG. 3, transmits to the terminal unit having the address 9 a level stop command SAD(n).CM5 (n is 9 in this case) denoting that a signal of the foregoing level is not required.

The level stop command is a command for use such that a received level signal of smoke or the like transmitted from a fire detector in the selecting is discriminated, and if the received level signal is not the level signal of a desired fire discrimination level, the fire detector is stopped to transmit the response signal to the received level signal. Therefore, the fire detector S that has received the level stop command does not respond to the level, the response to which has been stopped.

Use of the foregoing level stop command is effective for a multi-signal-type fire detector which has a plurality of discrimination levels which makes a fire discrimination at each discrimination level and which transmits a corresponding level signal. The plurality of the discrimination levels consisting of, for example, a level equivalent to a fire of the level 1 (a level for discriminating the fire when the smoke density is 5%), a level equivalent to a fire of the level 2 (a level for discriminating the fire when the smoke density is 10%) and a level equivalent to a fire of the level 3 (a level for discriminating the fire when the smoke density is 15%). That is, the level of the signal received from the multi-signal-type fire detector is discriminated by the receiver RE. If the fire level of the received level signal is not the level signal corresponding to a desired fire level, a level stop command causing the multi-signal-type fire detector to stop ensuing transmission of the response signal to the received level signal. The multi-signal-type fire detector that has received the level stop command does not respond to the receiver RE in the system polling and the point polling at the foregoing fire level. Thus, even if the multi-signal-type fire detector repeats turning on and off at a smoke density of a level lower than the level which is discriminated by the receiver RE that a fire takes place, meaningless response signals are not transmitted to the receiver RE. Therefore, delay of the processes in the receiver RE can be prevented.

The foregoing embodiment has the arrangement such that a plurality of terminal units are subjected to the system polling, the point polling and the selecting in such a manner that the fire determined command is transmitted to the terminal unit, the operation of which has been determined and the response to the receiver RE in the system polling and the point polling is stopped. The terminal unit, the operation of which has been determined, is a storage type fire detector that has transmitted, to the receiver RE, a fire signal and a non-storage type fire detector, the storage of which has been completed by the receiver RE, as well as the transmitter P that has transmitted the fire signal to the receiver RE.

As described above, a plurality of the terminal units are subjected to the system polling, the point polling and the selecting in such a manner that the fire determined command is transmitted to the terminal unit, the operation of which has been determined, and thus the response to the receiving portion is stopped. Therefore, even if the detection level of smoke or the like repeats rise and fall in the vicinity of the fire level, no response to the receiver is performed. Thus, the process to be performed by the receiver cannot be delayed. When the system is restored, the receiving portion transmits a fire restoring command to the terminal unit. The terminal unit that has received the fire determined command is restored in accordance with the fire restoring command. Also the multi-signal-type fire detector that has received the level stop command is restored in accordance with the fire restoring command.

Figure 4:
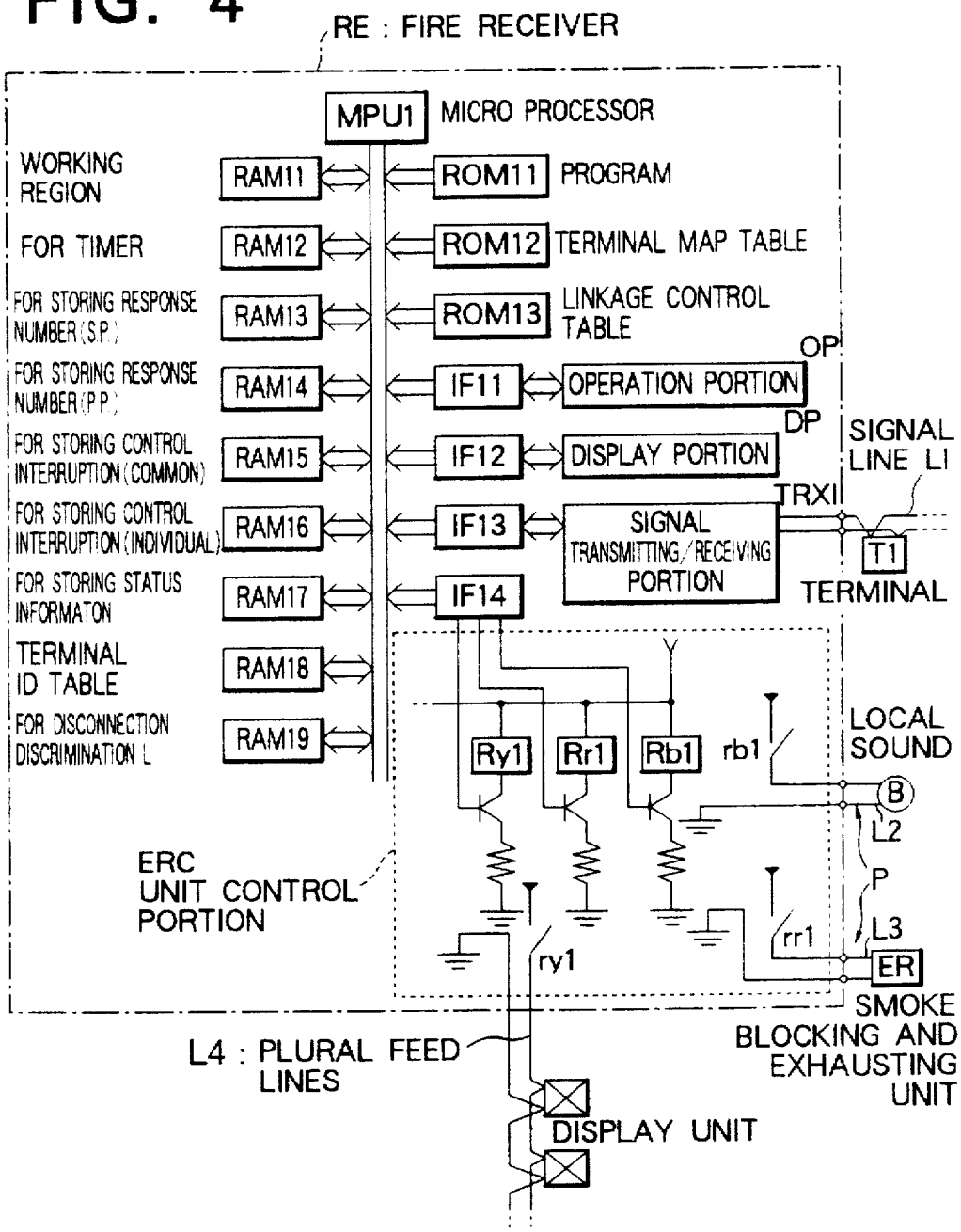
FIG. 4 is a block diagram showing an example of fire receiver RE and units connected to the receiver RE according to the foregoing embodiment.

FIG. 4 is a block diagram showing an example of the fire receiver RE and the units connected to the receiver RE in the foregoing embodiment.

The receiver RE comprises, a microprocessor MPU 1, RAM 11 to RAM 19, ROM 11 to ROM 13, interfaces IF 11 to IF 14, a signal transmitting/receiving portion TRX 1, an operation portion OP, a display portion DP and a unit control portion ERC.

The ROM 11 is for storing a program relating to the flow chart shown in FIGS. 10 to 17. The microprocessor MPU 1 and the ROM 11 are examples of a normal system polling means for performing the normal system polling, the normal point polling means for performing the normal point polling, a selecting means for performing the selecting, a system polling means for a transmitter for performing the system polling for a transmitter, and a point polling means for a transmitter for performing the point polling for a transmitter.

The ROM 12 is a region for storing a terminal unit map table that contains the address of each of the terminal units, such as the transmitters P, the fire detectors S and the relays RP. The table also stores the type and the like of the terminal units in the initial stage. The ROM 13 is for storing a linked-control table that linked-controls the terminal units, such as the smoke blocking and exhausting units ER, in response to the fire signal transmitted from the terminal unit.

The RAM 11 is a working region. The RAM 13 is a region for storing the group number g including the transmitter P or the terminal unit except the transmitter P that has transmitted the response signal in accordance with the pulse receipt timing in the system polling for a transmitter or the normal system polling. The RAM 14 is for storing the number m in the group of the transmitter P or the terminal unit, except the transmitter P that has transmitted the response signal in accordance with the timing at which the pulse has been received in the point polling for a transmitter or the normal point polling.

The RAM 15 is a storage region for storing the contents to be controlled at the system polling for a transmitter or the normal system polling. The RAM 16 is a region for storing the terminal unit number and the contents to be controlled (for example, a test command, the fire determined command and the level stop command) at the time of performing the selecting. The RAM 17 is a storage region for storing status information collected from each terminal unit. The RAM 18 is a region for storing the type (the ID) of the connected terminal units. That is, the numbers and the types of the terminal units stored in the ROM 12 are loaded upon initialization. Then, the contents are changed in accordance with the type information collected by the disconnection discrimination selecting. The RAM 19 is for storing the address of the terminal unit that has been discriminated to be in the disconnected state by the disconnection discrimination selecting. The RAM 12 is a memory region for a timer with which a storage function can be possessed, the RAM 12 being enabled to be omitted in a case where storage function is not required.

Figure 5:
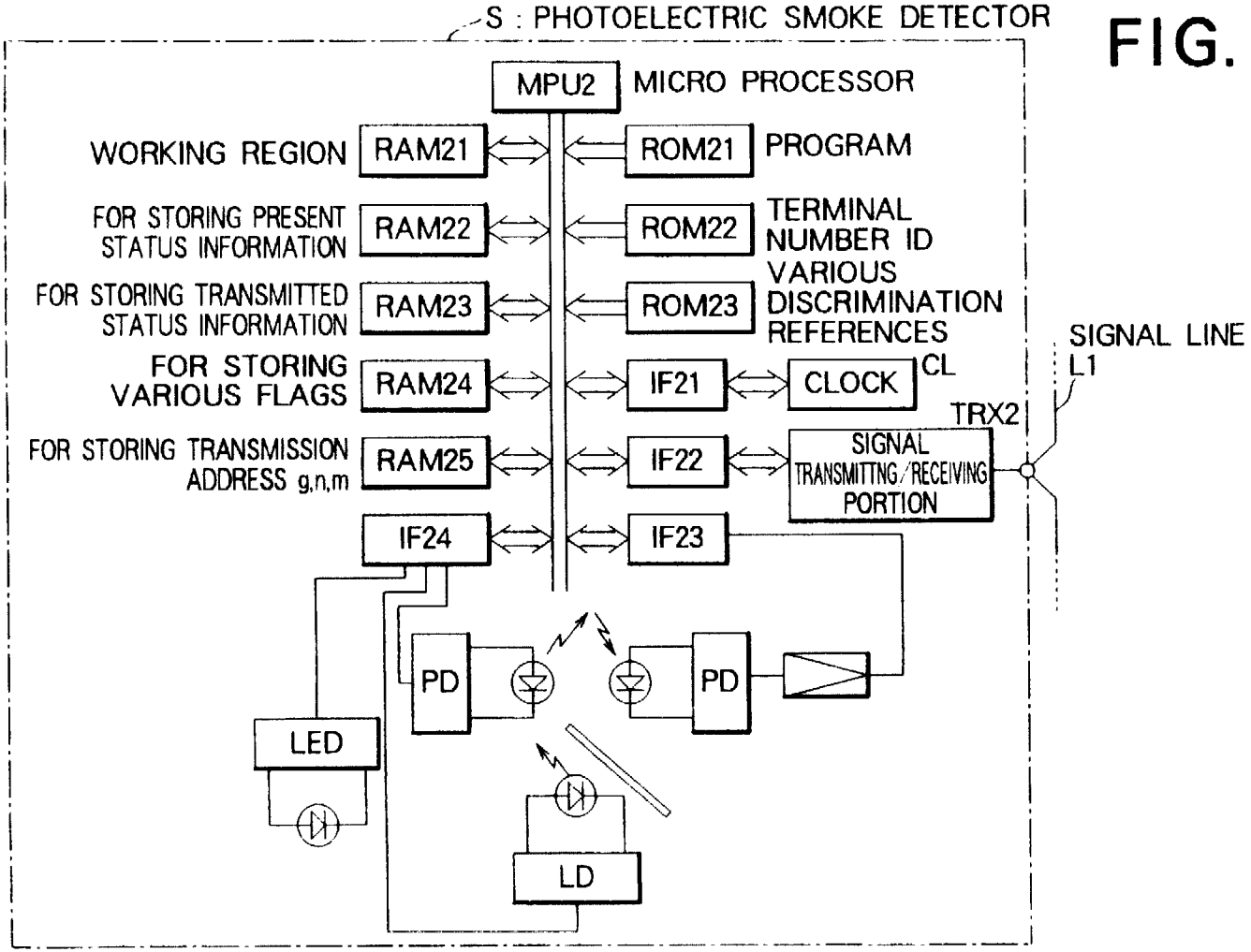
FIG. 5 is a block diagram showing a photoelectric smoke detector S according to the foregoing embodiment.

FIG. 5 is a block diagram showing a photoelectric smoke detector S for use in the foregoing embodiment.

The photoelectric smoke detector S comprises a microprocessor MPU 2, RAM 21 to RAM 25, ROM 21 to ROM 23, interfaces IF 21 to IF 24, a signal transmitting/receiving portion TRX 2, a clock generation source CL, a light emitting diode LD for detecting smoke, a photodiode PD, a test lamp TL and a light emitting diode LED serving as an operation confirming lamp.

The ROM 21 is for storing a program relating to the flow charts shown in FIGS. 8 and FIGS. 18 to 21. The ROM 22 is for storing the self-address number of the terminal unit and the type ID of the same and the like. The ROM 23 is for storing each discrimination reference for discriminating a fire and a breakdown and the like. Note that a dip switch or the like may be used in place of the ROM 22.

The RAM 21 is a working region. The RAM 22 is for storing the present status information. The RAM 23 is for storing the status information transmitted to the receiver RE. The RAM 24 is for storing a variety of flags. The RAM 25 is for storing the group number g, the number m in the group, and the address n of the terminal unit which are calculated from the self-terminal unit number upon initialization (S1) which will be described later and which are required to perform the transmission. The signal transmitting/receiving portion TRX 2 is a portion similar to the signal transmitting/receiving portion TRX 1.

Figure 6:
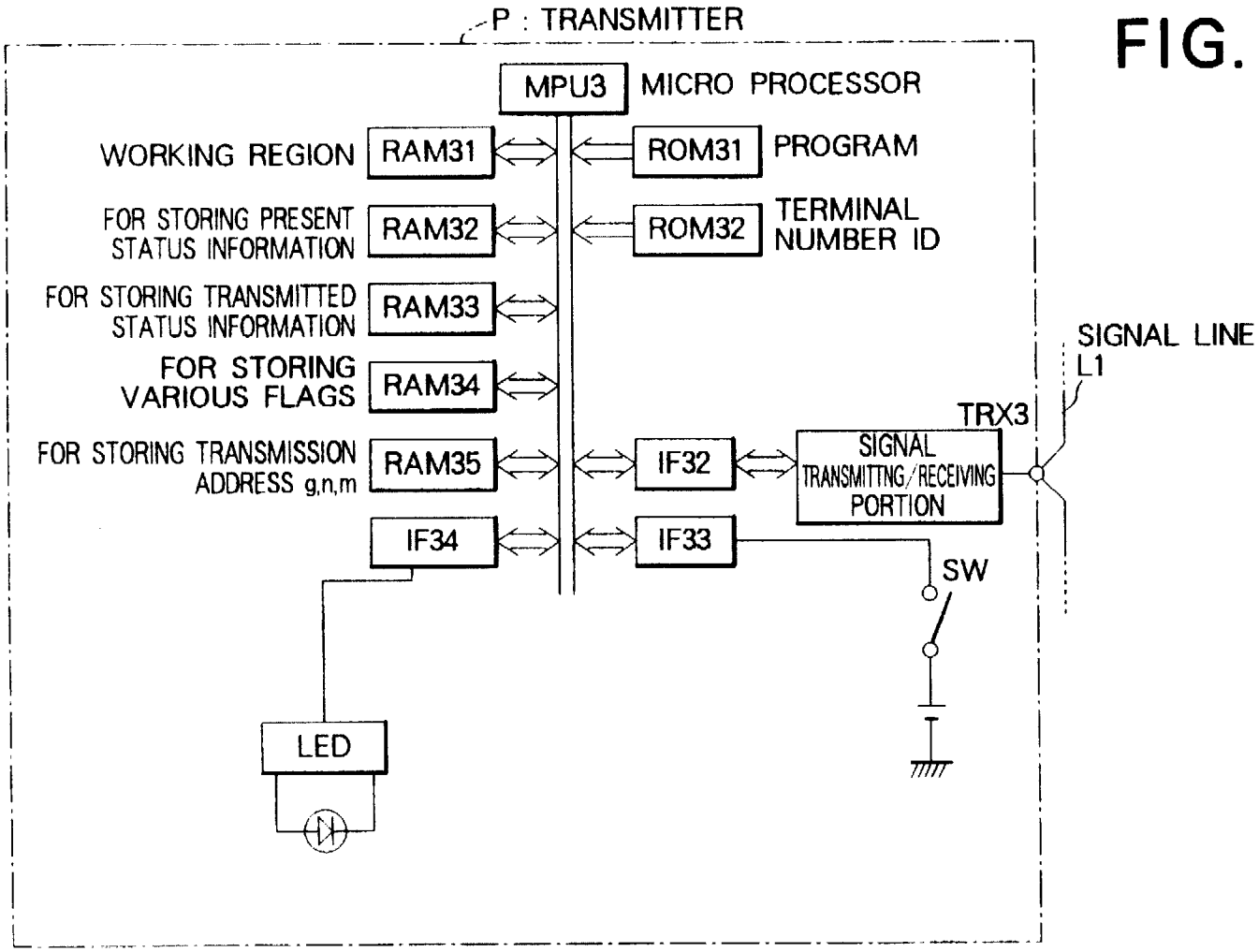
FIG. 6 is a block diagram showing a transmitter P according to the foregoing embodiment.

FIG. 6 is a block diagram showing the transmitter P for use in the foregoing embodiment.

The transmitter P comprises a microprocessor MPU 3, RAM 31 to RAM 35, a ROM 31, a ROM 32, interfaces IF 32 to IF 34, a signal transmitting/receiving portion TRX 3, a push-button-type switch SW to be depressed during a fire, and a light emitting diode LED serving as a response lamp.

The ROM 31 is for storing a program relating to the flow charts shown in FIGS. 9 and 22 to 25. The ROM 32 is for storing the self-address, the type and the like of the transmitter P. A dip switch or the like may be used in place of the ROM 32.

The RAM 31 is a working region. The RAM 32 is for storing the present status information. The RAM 33 is a region for storing the status information transmitted to the receiver RE. The RAM 34 is a region for storing a variety of flags. The RAM 35 is a region for storing the group number g, the number m in the group, and the address n of the transmitter P which are required to perform the transmission. The signal transmitting/receiving portion TRX 3 is a portion similar to the signal transmitting/receiving portion TRX 1.

FIG. 7 is a flow chart showing the basic operation of the receiver RE in the foregoing embodiment.

A case where the storage function is not present will now be described. The initialization is performed (S1), and address L for performing the disconnection discrimination selecting is set to zero (S2). Prior to the normal system polling, the system polling for a transmitter is performed (S3). If a response to the system polling for a transmitter has been made by the transmitter (S4), the group that has responded as described above is subjected to the point polling for a transmitter (S5). If a response to the point polling for a transmitter has been made by the terminal unit (S6), the transmitter that has made the response is subjected to the selecting (S7). If a control is interrupted, a control interruption process is performed (S8 and S9) and the operation returns to the system polling for a transmitter (S3).

If no response has been made by the transmitter P although the system polling for a transmitter has been performed (S4), this indicated that any of the transmitters P are not being operated and thus the normal system polling is performed (S11). If a response to the normal system polling is made by the terminal unit (S12), the group that has made the response is subjected to the normal point polling (S13). If a response to the normal point polling has been made by the terminal unit (S14), the terminal unit that has made the response is subjected to the selecting (S15) and the operation proceeds to step S8. If no response has been made to the point polling for a transmitter or the normal point polling (S6 and S14), a discrimination is made that an erroneous response has been made in the system polling due to noise or the like and the disconnection discrimination selecting is performed (S16). Thus, the operation proceeds to step S8. If no response has been made to the normal system polling (S12), the disconnection discrimination selecting is also performed (S16).

The MPU 1, the ROM 11, the RAM 12 and the RAM 17 constitute a timer means and an accumulation discrimination means. The timer means being arranged so as to start counting a predetermined time when the receiving portion has collected fire alarms as status information from the transmitter or the fire detector and clears the counting performed for the predetermined time when the receiving portion has collected alarm issue restoration as status information from the transmitter or the fire detector. The accumulation discrimination means discriminates that an accumulating operation in the transmitter or the fire detector has been completed and a fire alarm has been issued when the timer means has completed counting for the predetermined time.

In a case where the foregoing accumulating function is present, steps S8*a* to S8*c* are included between selecting steps S7, S16 and S15 and a control interruption step 8. If an accumulation flag is stored in the RAM 17 (S8*a*), discrimination (S8*b*) is made whether or not the timer time has passed. If the timer time has passed information that the accumulation completion is stored in the RAM 17 (S8*c*), then the operation proceeds to step S8.

Figure 8:
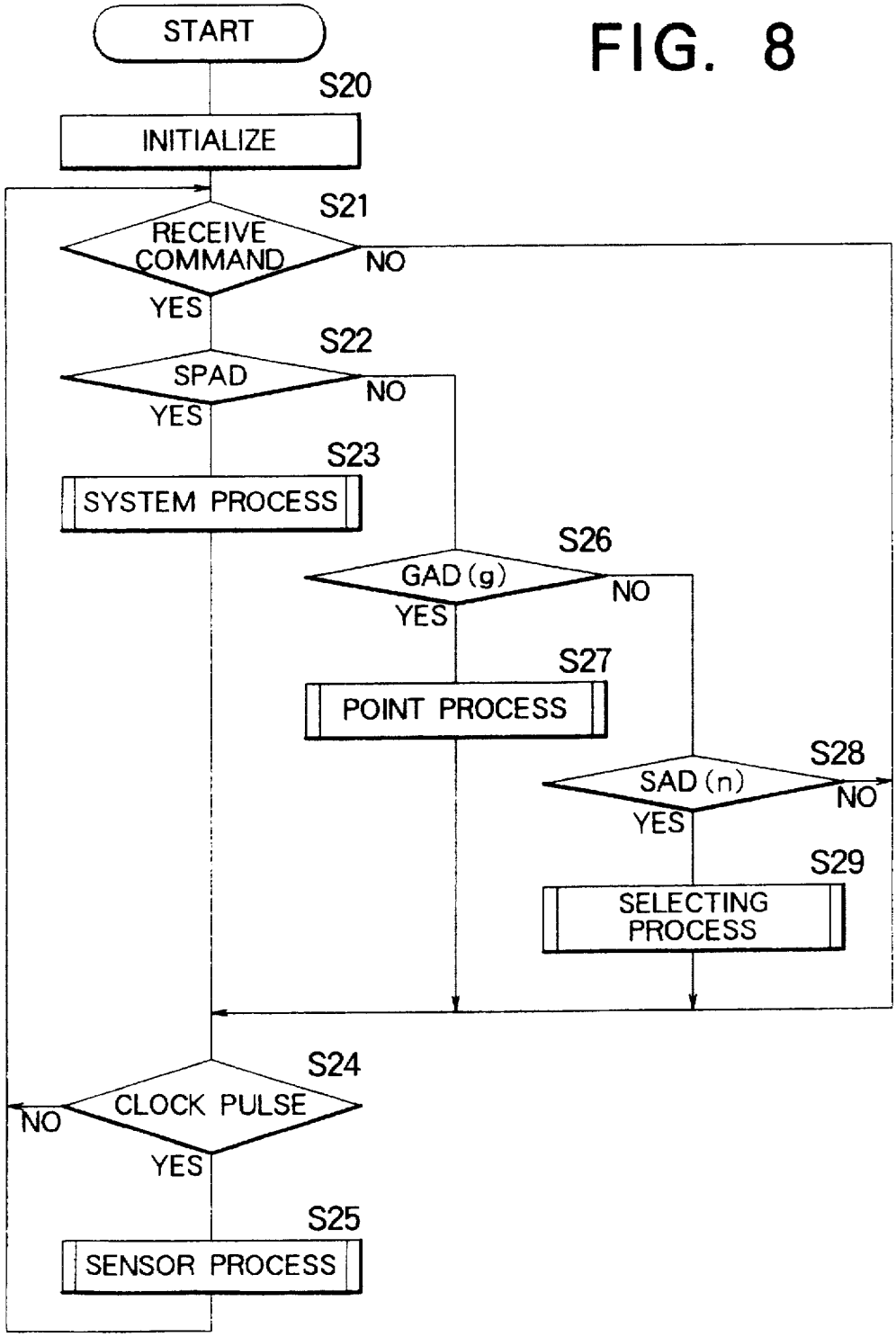
FIG. 8 is a flow chart showing the basic operation of the photoelectric smoke detector S which is one of terminal units according to the foregoing embodiment.

FIG. 8 is a flow chart showing the basic operation of the photoelectric smoke detector S which is one of terminal units in the foregoing embodiment.

Initialization is performed (S20). If a command received from the receiver RE has no appointed address and the subject portion is the command SPAD denoting the normal system polling (S21 and S22), a system process is performed (S23). If a clock pulse has been generated (S24), a sensor process (that is, a smoke detection operation), such as light emission and light receipt, is performed (S25) and the operation returns to step S21. If the command received from the receiver RE is not the SPAD but it is the command GAD(g) denoting the point polling that appoints the group to which the photoelectric smoke detector S belongs (S22 and S26), a point process is performed (S27). If the signal supplied from the receiver RE is not the command GAD(g) but it is the command SAD(n), denoting the selecting for appointing the address of the photoelectric smoke detector S (S28), the selecting process is performed (S29).

Figure 9:
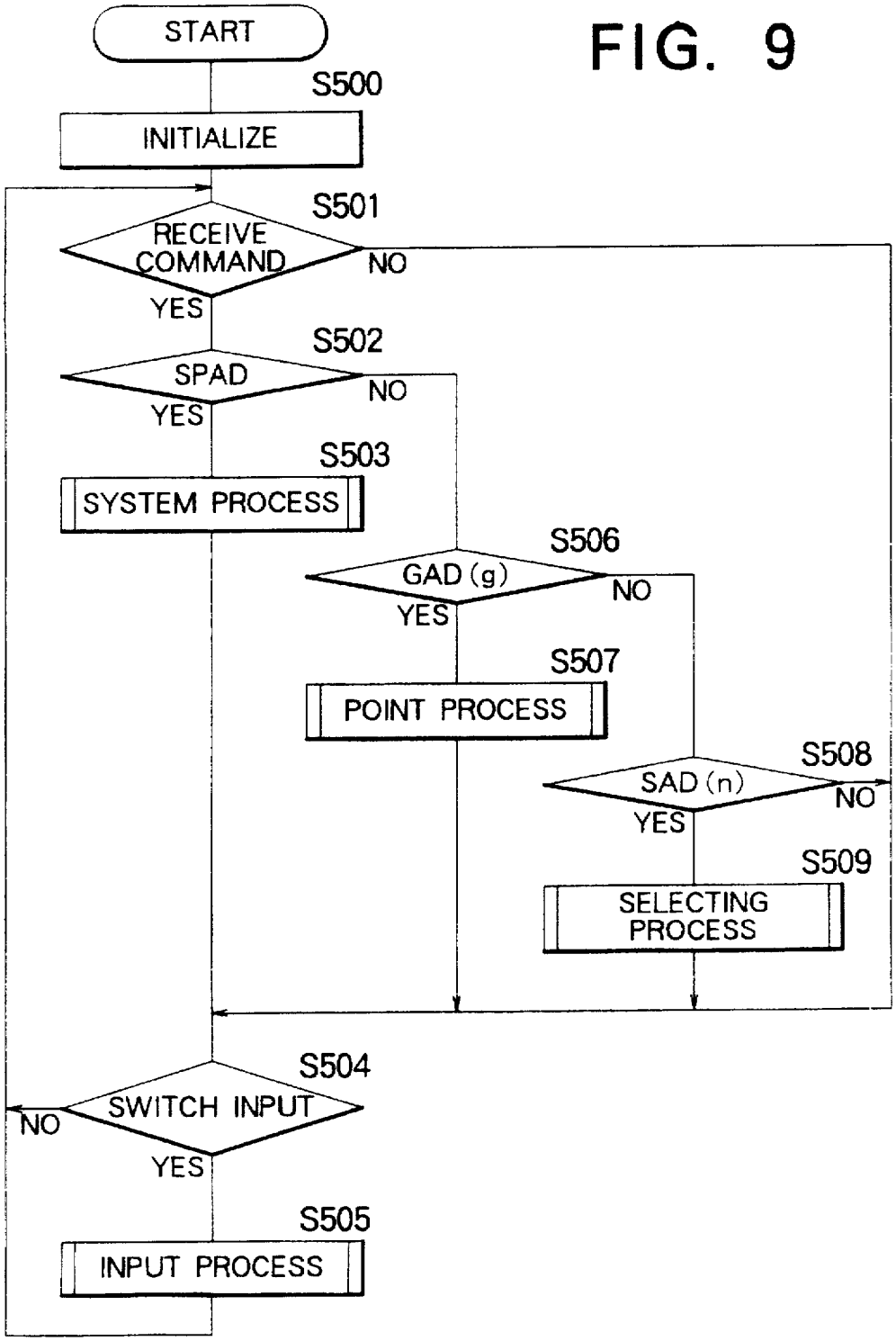
FIG. 9 is a flow chart showing the basic operation of the transmitter P according to the foregoing embodiment.

FIG. 9 is a flow chart showing the basic operation of the transmitter P.

Initialization is performed (S500). If the command received from the receiver RE has no appointed address and the subject portion is the command SPAD, denoting the system polling (S501 and S502), the system process is performed (S503). In a state where a signal has been generated from a switch SW when the push button is depressed (S504), an input process is performed (S505). Then, the flow returns to step S501. If the command received from the receiver RE is not the SPAD but it is the command GAD(g), denoting the point polling appointing the group to which the transmitter P belongs (S502 and S506), the point process is performed (S507). If the signal received from the receiver RE is not GAD (g) but it is the command SAD(n), denoting the selecting appointing the address of the transmitter P (S508), the selecting process is performed (S509).

Figure 10:
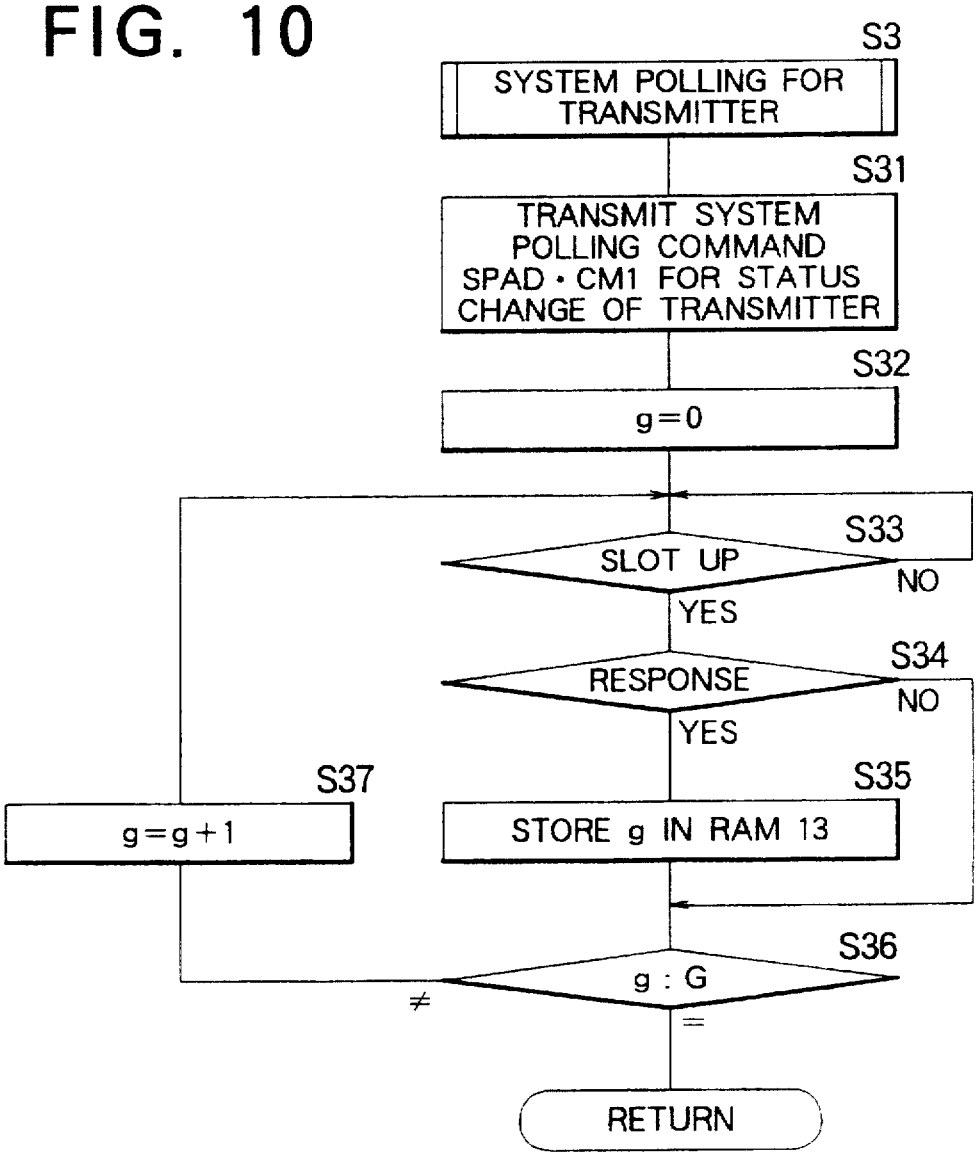
FIG. 10 is a flow chart showing an example of system polling (S3) for a transmitter that is performed by the fire receiver RE according to the foregoing embodiment.

FIG. 10 is a flow chart showing a specific example of the system polling for a transmitter (S3) and for the receiver RE according to the foregoing embodiment.

The receiver RE transmits a command SPAD.CM1 of the system polling for a transmitter that denotes the status information return command about the status change of the transmitter P (S31), the variable g denoting the group number is set to zero (S32) to store the number of the responded group. That is, when the responding time for the transmitter P belonging to the group G0 is present (S33), and when a response pulse is received from the transmitter P (S34), zero, which is the variable g at this time, is stored in the RAM 13 (S35). Then, the variable g is increased by one (S37) and the operations S33 to S37 are repeated until the variable g reaches final value G (S36). Then, the operation returns.

Figure 11:
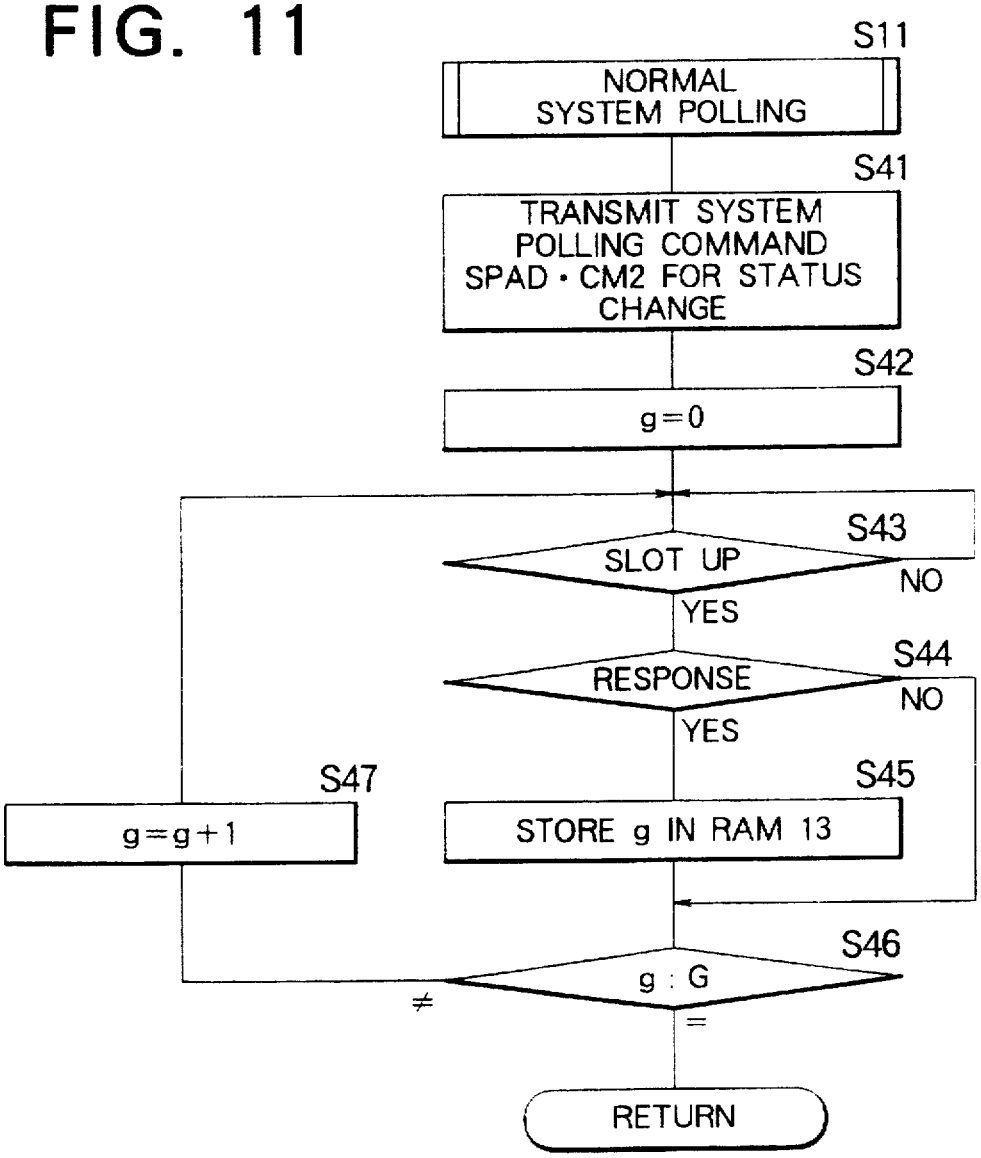
FIG. 11 is a flow chart showing an example of normal system polling (S11) that is performed by the fire receiver RE according to the foregoing embodiment.

FIG. 11 is a flow chart showing a specific example of the normal system polling (S11) for the fire receiver RE according to the foregoing embodiment.

The receiver RE transmits a command SPAD.CM2 of normal system polling that denotes the status information return command about the status change of the terminal unit (S41), and the variable g denoting the group number is set to zero (S42) to store the number of the group that has made the response. That is, when the responding time for the terminal unit belonging to the group G0 is present (S43) and when a response pulse from the terminal unit has been received (S44), zero, which is the variable g at this time, is stored in the RAM 13 (S45). Then, the variable g is increased by one (S47), and the foregoing operations S33 to S37 are repeated until the variable g reaches the final value G (S46). Then, the operation returns.

Figure 12:
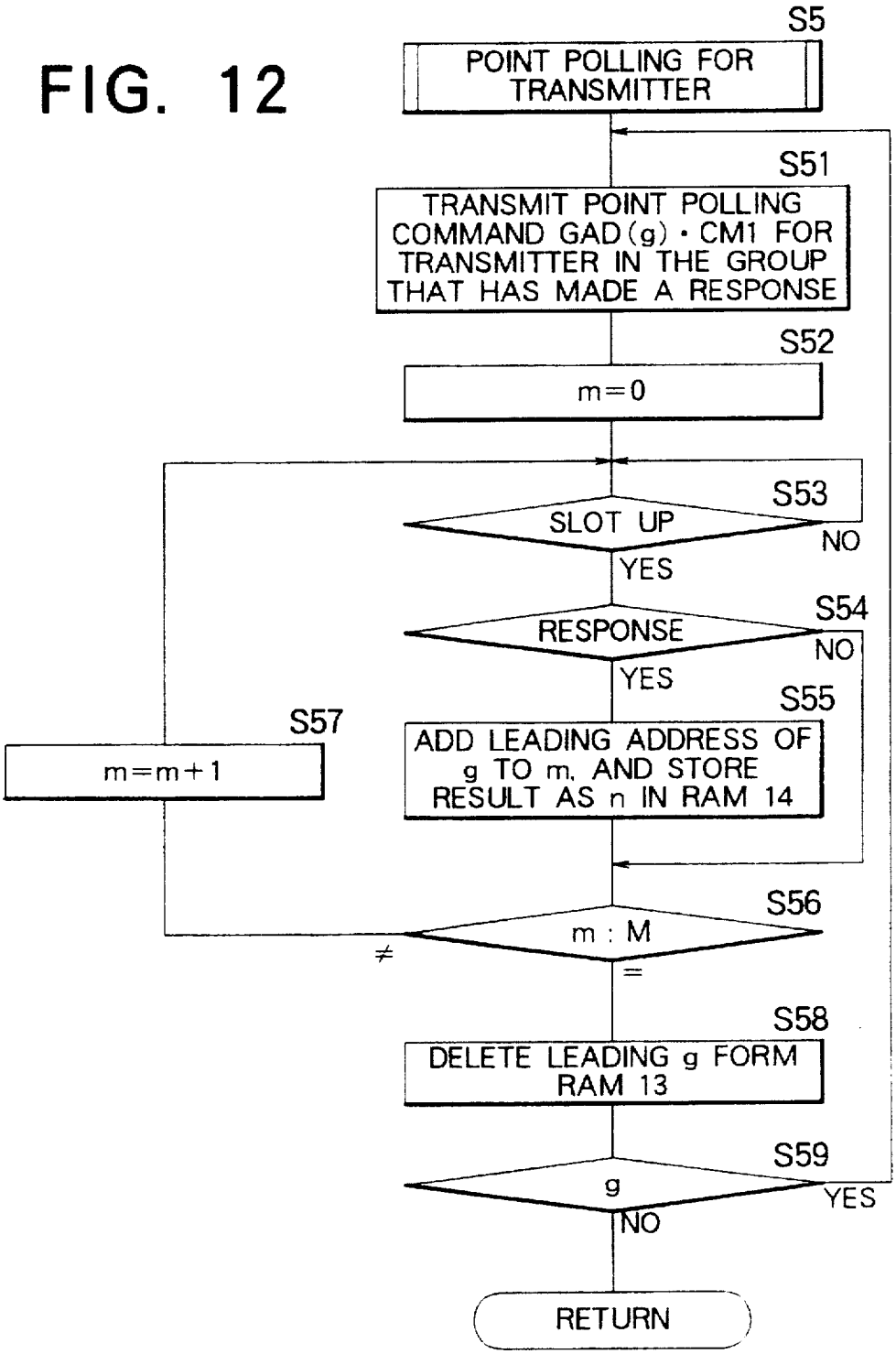
FIG. 12 is a flow chart showing an example of point polling for a transmitter (S5) that is performed by the fire receiver RE according to the foregoing embodiment.

FIG. 12 is a flow chart showing a specific example of the point polling for a transmitter (S5) for the receiver RE according to the foregoing embodiment.

The receiver RE transmits the command GAD(g).CM1 of the point polling for a transmitter that denotes the status information return command to be issued to the transmitter P in the group (stored in the RAM 13) to which the transmitter P that has responded to the system polling for a transmitter (S51) to set variable m denoting the number of the transmitter P which is the transmitter P in the group (S52). The number m of the transmitter P in the group that has made the response is converted into address n of the transmitter P and the address n is stored. That is, when the response timing for the m-th transmitter P is present and when a response pulse from the transmitter P has been received (S53 and S54), a value obtained by adding the variable m at this time to the leading address of the group is, as the address n of the transmitter P that has made the response, stored in the RAM 13 (S55). The variable m is increased by one (S57), and the foregoing operations S53 to S57 are repeated until the variable m reaches a final value M (S56). When the point polling for a transmitter for all groups g (the numbers of the groups g are stored in the RAM 13) that have responded to the system polling for a transmitter has been completed (S58 and S59), the operation returns.

Figure 13:
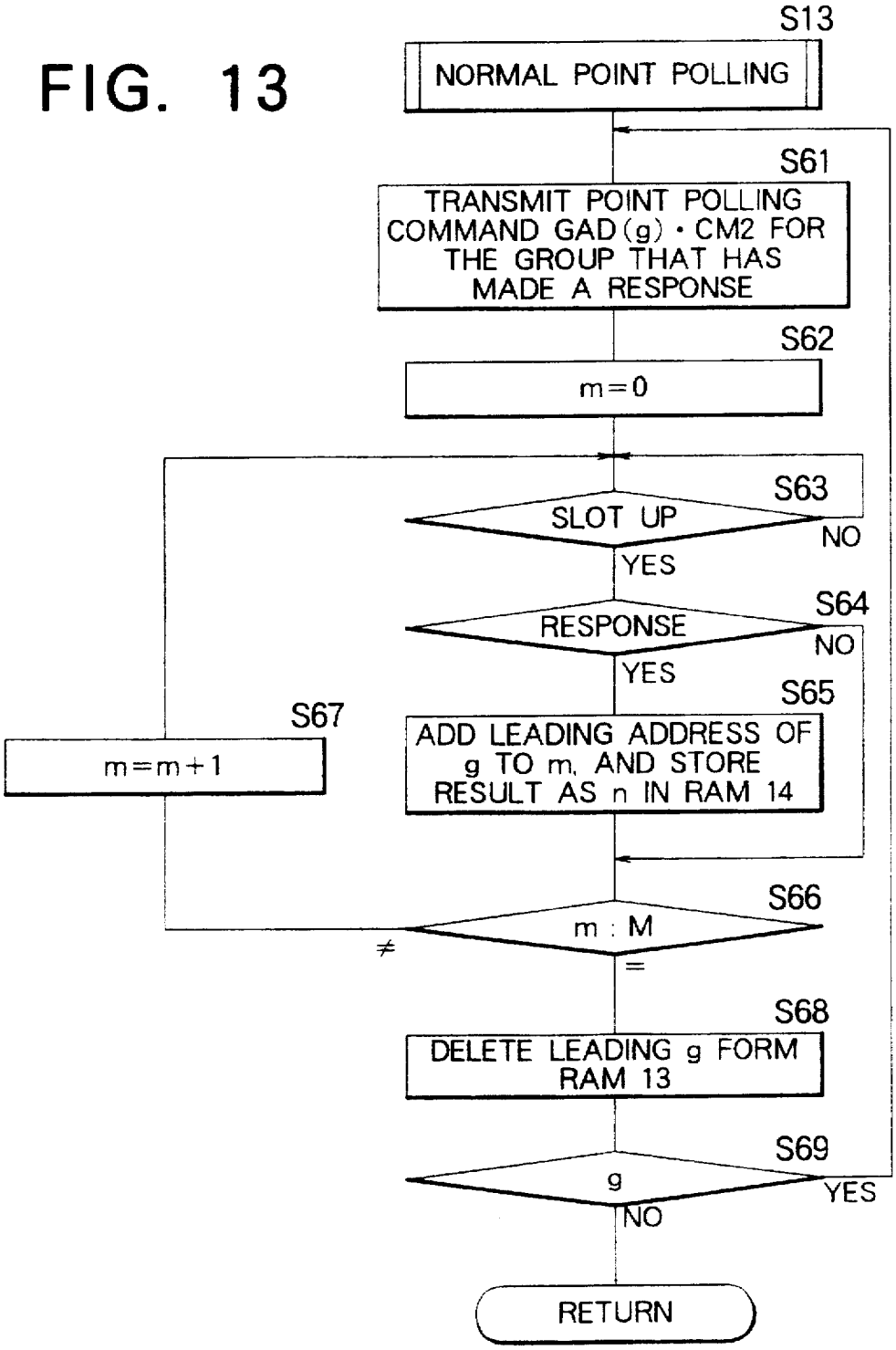
FIG. 13 is a flow chart showing an example of normal point polling (S13) that is performed by the fire receiver RE according to the foregoing embodiment.

FIG. 13 is a flow chart showing a specific example of the normal point polling (S13) for the fire receiver RE according to the foregoing embodiment.

The receiver RE transmits a command GAD(g).CM2 of the normal point polling that denotes the status information return command to be issued to the terminal unit in the group to which the transmitter P that has responded to the normal system polling (S11) belongs (S61). The variable m, denoting the number of the terminal units in the group, is set to zero (S62) and the number m of the terminal unit in the group that has made the response is converted into address n and is stored. When the response time for the m-th terminal unit is present and a response pulse from the terminal unit has been received (S63 and S64), a value obtained by adding the variable m at this time to the leading address of the group is, as the address n of the terminal unit to be selected, stored in the RAM 14, and the variable m is increased by one (S65 and S67). Then, the operations S63 to S67 are repeated until the variable m reaches the final value M (S69), and the operation returns.

Figure 14:
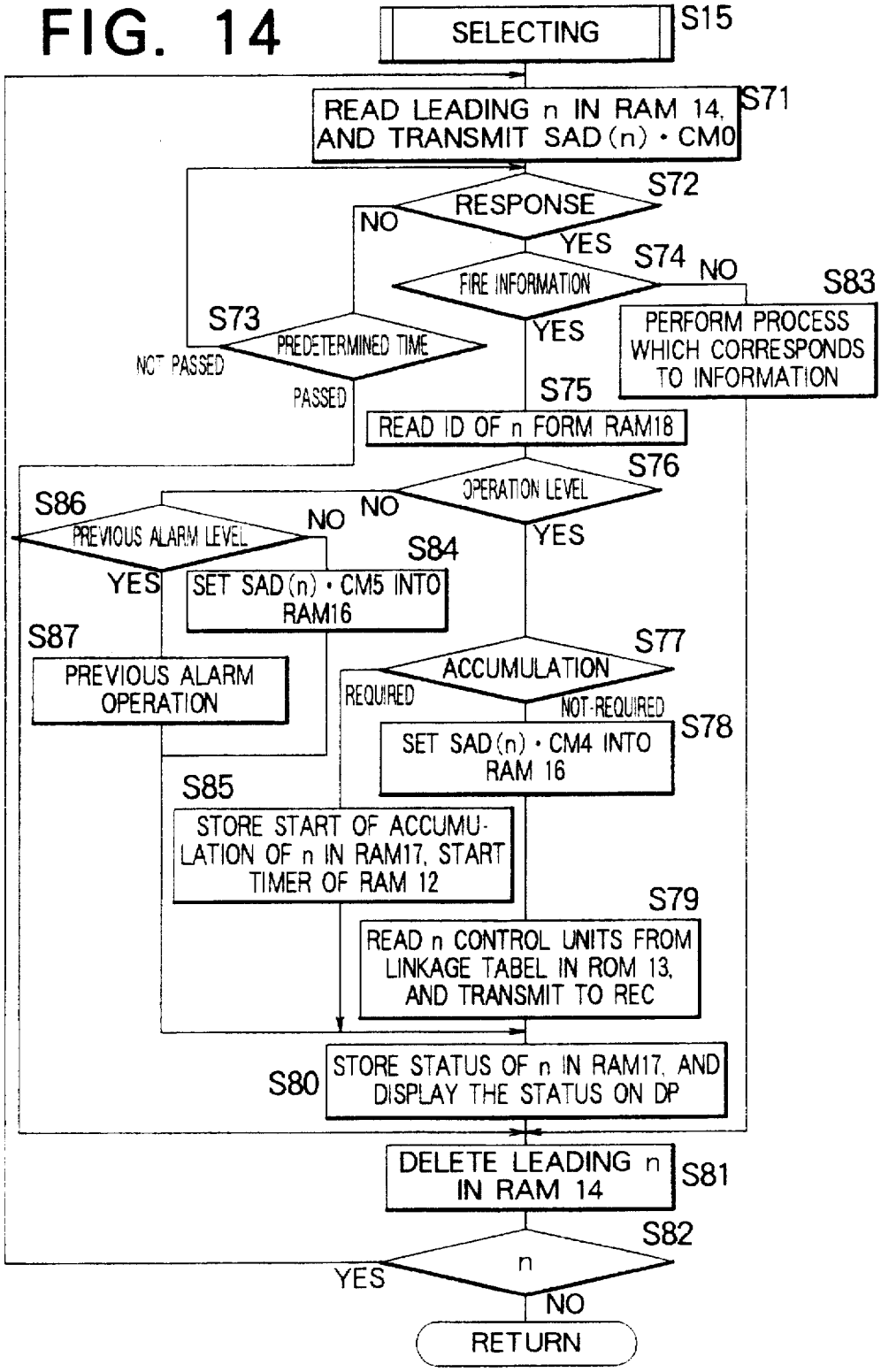
FIG. 14 is a flow chart showing an example of selecting (S7 and S15) that is performed by the fire receiver RE according to the foregoing embodiment.

FIG. 14 is a flow chart showing a specific example of the selecting (S7 and S15) for the fire receiver RE according to the foregoing embodiment.

The receiver RE makes a response by the point polling for a transmitter (S5) or the normal point polling (S13), appoints the address n read from the leading portion of the address of the transmitter P or the addresses of the terminal units except the transmitter P stored in the RAM 14 and transmits a selecting command SAD(n).CM0 denoting the status information return command (S71). When a receipt from the terminal unit having the appointed (that is, called by the selecting) address n has been made, and if it is fire information (a signal relating to change in the physical quantity of a fire phenomenon, for example, a level-2 signal or a signal relating to a fire operation, such as an operation signal of the transmitter P) (S72 and S74), type ID of the terminal unit having the address n is read from the RAM 18 (S75).

If the fire information has reached the fire discrimination level for the ID (in a case where the ID is a detector of the level 2 a signal of a fire level 2 has been transmitted) and if no accumulation is required (S76 and S77), a discrimination of fire occurrence can be made reliably. Therefore, fire of the terminal unit having the address n is determined. A command SAD(n).CM4, denoting the fire determined command for inhibiting the terminal unit having the address n to respond to the system polling and the point polling, is set into the RAM 16 (S78). A terminal unit to be controlled (the terminal units to be controlled and linked are previously set for each terminal unit, in a case of a multi-signal-type fire detector setting is previously made for each level of the level signal) in response to the fire signal for the address n is read from the linkage table in the ROM 13 and is transmitted to the unit control portion ERC (S79).

Then, the status of the terminal unit having the address n is stored in the RAM 17 and the foregoing status is displayed on the display portion DP (that is, the fire block or the address n is displayed). Furthermore, a main sound apparatus (not shown) is actuated (S80), and the leading n is deleted from the RAM 14 (S81).

In a case where the fire information received from the fire detector S has not reached the operation level set in the fire receiver RE (S76), fire discrimination (S86) is made whether or not the received fire information is a previous alarm level (S86). If the received fire information is the previous alarm level, that is, if the fire discrimination level for the receiver RE is set to the level 2 in a case where the operation level for the fire detector SE is level 1, there is a possibility that a fire has taken place. Therefore, a previous alarm operation is performed (for example, a lamp indicating a previous alarm is turned on, a chime sound is rung or the main sound is intermittently rung) (S87). The status of the terminal unit having the address n is stored in the RAM 17, and the status is display on the display portion DP (that is, the block or the address n that has issued the previous alarm is displayed). Then, the leading n is deleted from the RAM 24 (S81).

As a result, the previous alarm can be issued prior to issuing the normal fire alarm in the polling selecting method.

If the operation level for the fire detector S is level 2 in a case where the fire level set to the receiver RE is level 3, the previous alarm operation is performed (S87).

FIG. 14A shows the types of alarms to be issued in accordance with the level at which the fire detector S has been operated and the fire discrimination level set for the fire receiver RE. That is, FIG. 14A shows the operation level for the fire detector S which cause the fire receiver RE to issue the fire alarm and the operation level for the fire detector S which cause the fire receiver RE to issue the previous alarm.

In a case where fire information received from the fire detector S does not reach the set fire discrimination level (S76) and as well as the received fire information does not reach the previous alarm level (S86), the received level is not a required level. Thus, a level stop command SAD(n) .CM5 for stopping ON-OFF response at the non-required level (the command denoting the level stop command is canceled at the restoration to be performed after the fire has been extinguished) is set into the RAM 16 (S84), and the operation proceeds to step S80. If accumulation is required (S77), accumulation start is stored in the RAM 17 (S85), and the operation proceeds to step S80. If the address n is left in the RAM 14, the operations S71 to S81 are repeated until the left address n has been processed (S82).

Although the foregoing embodiment is adapted to a case where the fire detector S is the multi-signal-type fire detector S and the fire receiver RE has fire discrimination levels 2 and 3, the foregoing embodiment may be applied to a case where the fire receiver RE has fire discrimination levels except the levels 2 and 3. That is, it is necessary that the fire receiver RE issues the previous alarm if the fire detector S has detected level n−1 in a case where the fire receiver RE has n (n is an integer larger than 2) fire discrimination levels.

In a case where fire information received from a fire detector S having no accumulation function is a fire alarm reaching the operation level and as well as accumulation is required (S77), an accumulation flag denoting that the fire detector S has started the accumulation is, together with the address n of the fire detector S, stored in the RAM 17. Furthermore, the timer of the RAM 12 is started (S85). That is, the fire receiver RE performs the accumulation operation in place of the self-accumulation to be performed by the fire detector having the accumulation function. When the accumulation is started, the foregoing accumulation flag is stored in the RAM 17 and the RAM 12 of the fire receiver RE starts counting of a predetermined accumulation time simultaneously with the start of the storage.

In this case, the fire detector S is not required to respond to the fire receiver RE if the status is not changed (if the fire phenomenon higher than the operation level is continuously detected) after the fire detector S has transmitted the fire information to the fire receiver RE. The fire detector S is required to respond to the fire receiver RE only when the status has been changed (only when the fire phenomenon has been made to be lower than the operation level). That is, the fact that the status of the fire detector S is not changed means that the fire detector S continuously detects the fire alarm phenomenon higher than the operation level. The fire receiver RE continues the accumulation. If the status is then changed, it means that the fire phenomenon detected by the fire detector SE has been made lower than the operation level and thus the alarm issue and restoration has been made. In the case of the alarm issue and restoration, the fire receiver RE stops the accumulation. Therefore, a state as if the fire detector S performs the accumulating operation is entered. Furthermore, the fire alarm system is brought to a state where the fire detector S performs the accumulating operation if the fire detector S has not performed the accumulating function.

The foregoing embodiment enables the fire alarm system to perform the accumulating operation even if a fire detector has not performed the accumulating function. Therefore, even if the accumulation at the time of detecting a fire is performed, the number of parts of the fire detector can be decreased and the memory capacity of the fire detector can be reduced.

In the foregoing embodiment, the timer period is checked in step **S8*b* shown in FIG. 7 in order to examine whether or not the accumulating time has passed. Whenever one cycle composed of the system polling (S11), the point polling (S13) and the selecting (S15) is completed, checking of the timer time is performed. In a case where a multiplicity of terminal units must respond in a sequence of the foregoing operations, a long time is sometimes necessary in order to perform the selecting (S7 and S15). In this case, the time for checking of the timer can sometimes be longer. Accordingly, an MPU is disposed individually from the MPU 1** to check the timer time. Thus, the delay in time for checking the timer time can be prevented. By performing the checking of the timer time whenever the status information of one or more terminal units is returned in the selecting operation, the delay in time for checking the timer time can be prevented without disposing the individual MPU.

Although the foregoing embodiment is arranged to cause the fire receiver RE to count the accumulation time, another receiving portion, such as a relay, may count the accumulation time in place of the fire receiver RE.

Figure 15:
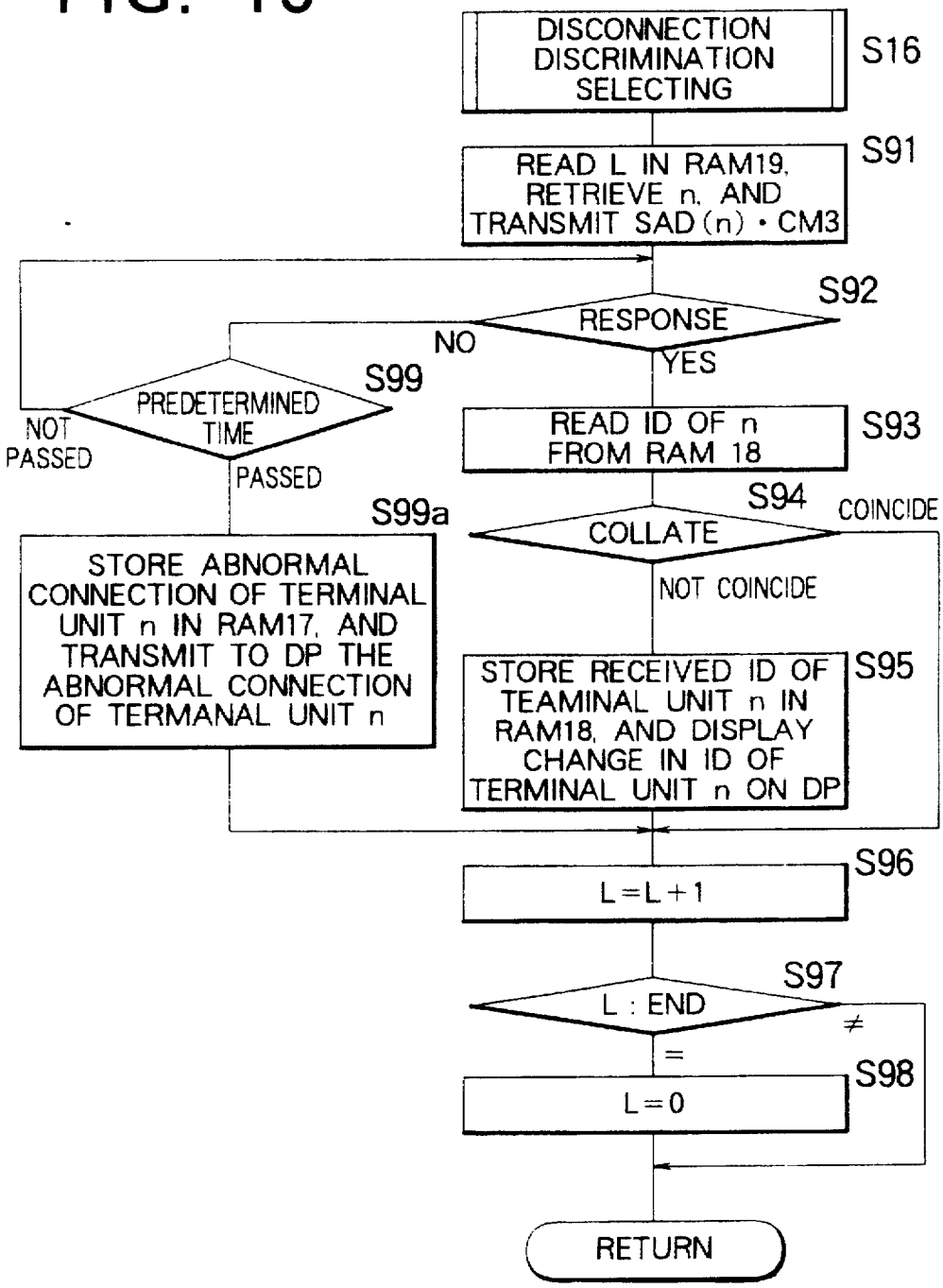
FIG. 15 is a flow chart showing an example of disconnection discrimination selecting (S16) that is performed by the fire receiver RE according to the foregoing embodiment.

FIG. 15 is a flow chart showing a specific example of the disconnection discrimination selecting (S16) to be performed by the fire receiver RE according to the foregoing embodiment.

The receiver RE reads, from the RAM 19, the address L (which is the same as the address n but which is individually provided because it must be stored individually) of a terminal unit to be subjected to a disconnection discrimination. Then, the receiver RE transmits a disconnection discrimination selecting command SAD(L).CM3 for requiring type information for discriminating disconnection (S91). When the receiver RE receives a signal from a terminal unit (S92), the receiver RE reads the type ID of the terminal unit having the address L from the RAM 18 (S93). If the type received from the terminal unit having the address L does not coincide with the type read from the RAM 18 (S94), the type received from the terminal unit having the address L is stored in the RAM 18 and the change in the type of the terminal unit having the address L is displayed on the display portion DP (S95).

The address L of the terminal unit is increased by one (S96). When the address L reaches the final address, the address L is returned to zero (S98). If no signal is received from the terminal unit within a predetermined time (S99), a discrimination is made that the terminal unit having the address L is connected abnormally and this fact is stored in the RAM 17. Furthermore, a signal denoting that the terminal unit having the address L is connected abnormally (that is, a signal denoting a disconnection state) is transmitted to the display portion DP (**S99*a***).

Figure 16:
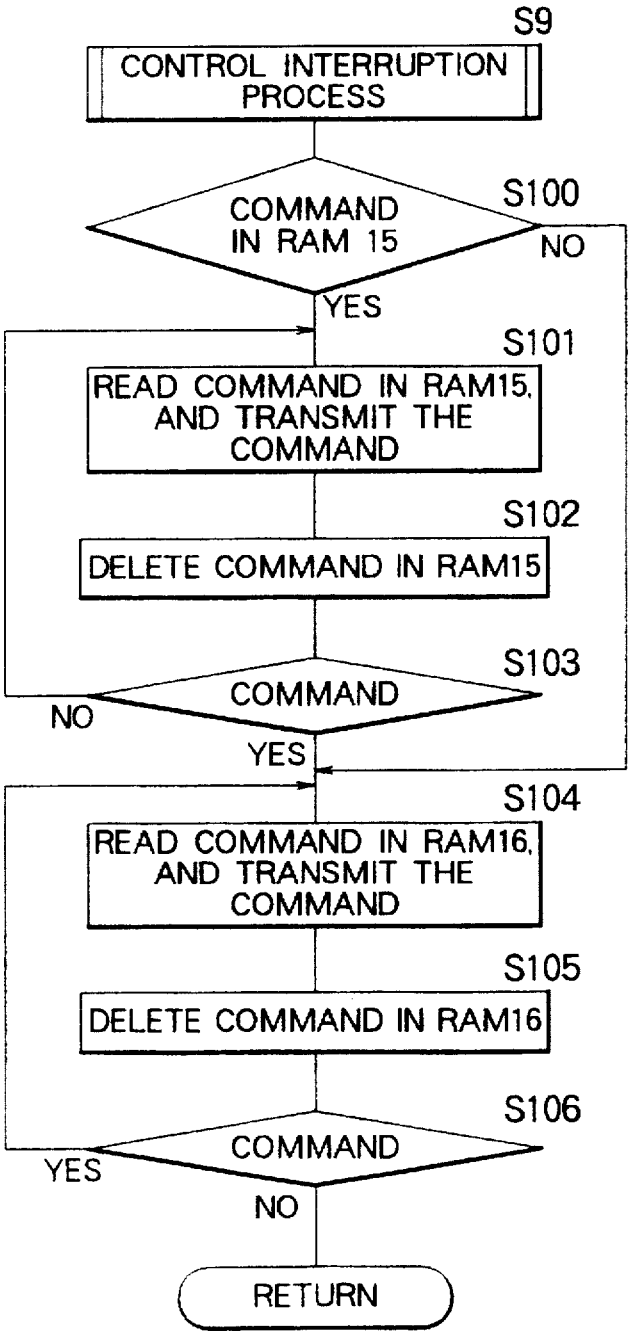
FIG. 16 is a flow chart showing an example of control interruption process (S9) that is performed by the fire receiver RE according to the foregoing embodiment.

FIG. 16 is a flow chart showing a control interruption process (S9) to be performed by the fire receiver RE according to the foregoing embodiment.

If a command common to all terminal units (for example, a restoration command) has been stored in the RAM 15 (S100), the common command is read, the command is transmitted by the normal system polling (S101), and the transmitted command is deleted from the RAM 15 (S102). If another common command to all terminal units is left in the RAM 15, reading, transmitting and deleting of the command are repeated (S103). Then, commands, such as the fire determined command and the level stop command, to be transmitted to the terminal unit appointed with the address, are read from the RAM 16. The commands are transmitted by the selecting operation (S104), and the transmitted commands are deleted from the RAM 16 (S105). If another command for appointing the terminal unit is left in the RAM 16, reading, transmitting and deleting the command are repeated (S106).

FIG. 17 is a flow chart showing a specific example of the control interruption to be performed by the fire receiver RE according to the foregoing embodiment and which is generated arbitrarily.

The control interruption to be performed by the fire receiver RE is an operation for processing input information from the operation portion OP. The control interruption is also generated in a case where the accumulation of the fire detector has been completed by the internal process. In a case where the accumulation of the fire detector has been completed (S111), fire determined command SAD(n).CM4 to be issued to the terminal unit having the address n, determined to be a fire due to the completion of the accumulation, is set to RAM 16. Information of the terminal unit to be controlled that must be link-controlled to correspond to the terminal unit having the address n is read from the linkage table in the ROM 13, and an operation command signal is transmitted to the unit control portion ERC (S115). The status of the terminal unit having the address n is stored in the RAM 17 and the fire block or the address n is displayed on the display portion DP (S116). Then, the operation is returned.

If the accumulation has not been completed (S111), input information from the operation portion OP is read (S112) because the interruption was made by the input from the operation portion OP. If a fire restoration input in a case where the system is restored from the fire alarm state to the supervised state is made (S113), all status information in the RAM 17 is cleared to restore the supervised state, the command SPAD.CM6 denoting the fire restoration command is set to RAM 15, the fire display made on the display portion DP is deleted, and a restoration signal is transmitted to the unit control portion ERC (S114). Then, the operation is returned.

If the input information from the operation portion OP is accumulation restoration input for suspending the accumulation of the terminal unit (the fire detector) brought into the accumulated state (S117), all terminal units that are being accumulated in the RAM 17 are changed to the supervised state and the command SPAD.CM7 denoting the accumulation restoration command is set into the RAM 15 (S118). Then, the operation is returned.

If the input information from the operation portion OP is local sound stop input for stopping the local sound (S119), a local sound stop signal is transmitted to the unit control portion ERC (S120), and the operation is returned. If the input information from the operation portion OP is remote test input for starting a test of the terminal unit, such as the fire detector (S121), command SAD(n).CM8 denoting a remote test command to be issued to the terminal unit having the address n is set to the RAM 16 (S122), and the operation is returned. If the input information from the operation portion OP is automatic test input for automatically testing the terminal unit (S123), all terminal units are automatically subjected to a remote test process, and the test result is displayed on the display portion DP (S124). Then, the operation is returned. If the input information from the operation portion OP is another input, a process corresponding to the input from the operation portion OP is performed (S125).

Figure 18:
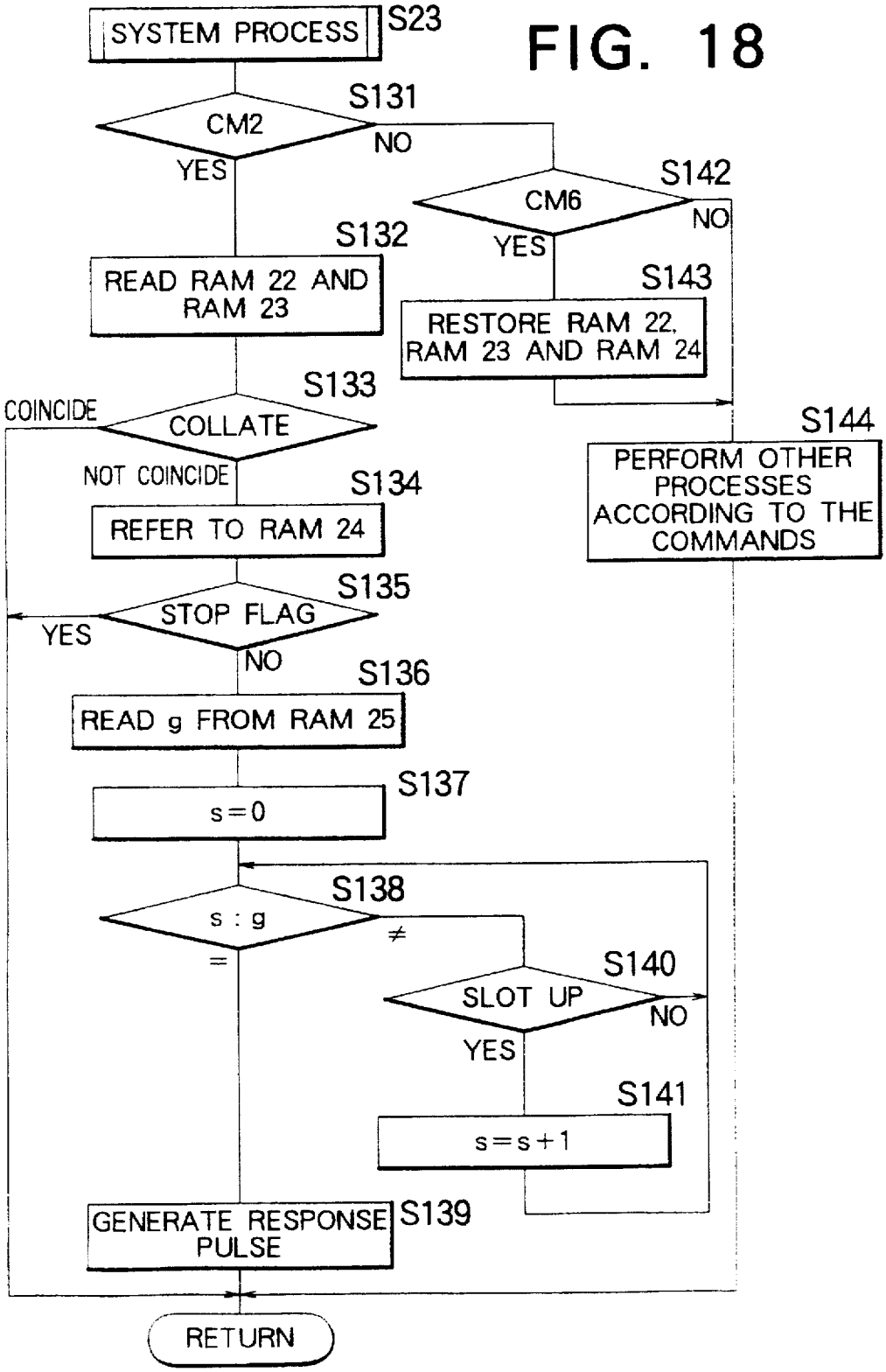
FIG. 18 is a flow chart showing an example of a system process (S23 shown in FIG. 8) that is performed by the photoelectric smoke detector S according to the foregoing embodiment.

FIG. 18 is a flow chart showing a specific example of a system process (S23 shown in FIG. 8) to be performed by the photoelectric smoke detector S according to the foregoing embodiment.

If the command received from the receiver RE is command SPAD, denoting the system polling (S22), and it is the status information return command CM2 that requires status change information (S131), the present status information is read from the RAM 22 and status information that has been transmitted is read from the RAM 23 (S132). If the two status information items do not coincide with each other, it indicates that the status of the photoelectric smoke detector S has been changed. At this time, a reference to the RAM 24 is made (S133 and S134). If response stop flags, such as a level stop flag and the fire determined flag, are not present in the system polling and the point polling (S135), the number g of the group to which the photoelectric smoke detector S belongs is read from the RAM 25 (S136) and the slot number s denoting the response timing to the system p is set to zero (S137).

The moment the slot number s and the group number g coincide with each other (S138), the response time is present. At this time, a response pulse is transmitted (S139) and a response to the receiver RE is made. If the slot number s and the group number g do not coincide with each other (S138), the slot number is increased by one when the transmission timing of the number s (S140 and S141) to collate the slot number s and the group number g (S138).

If the command received from the receiver RE is not the status information return command CM2 (S131), but is the fire restoration command CM6 (S142), the present status information, the status information that has been transmitted and the various flags are deleted. If the command is another command, a process corresponding to the other command is performed (S144).

Figure 19:
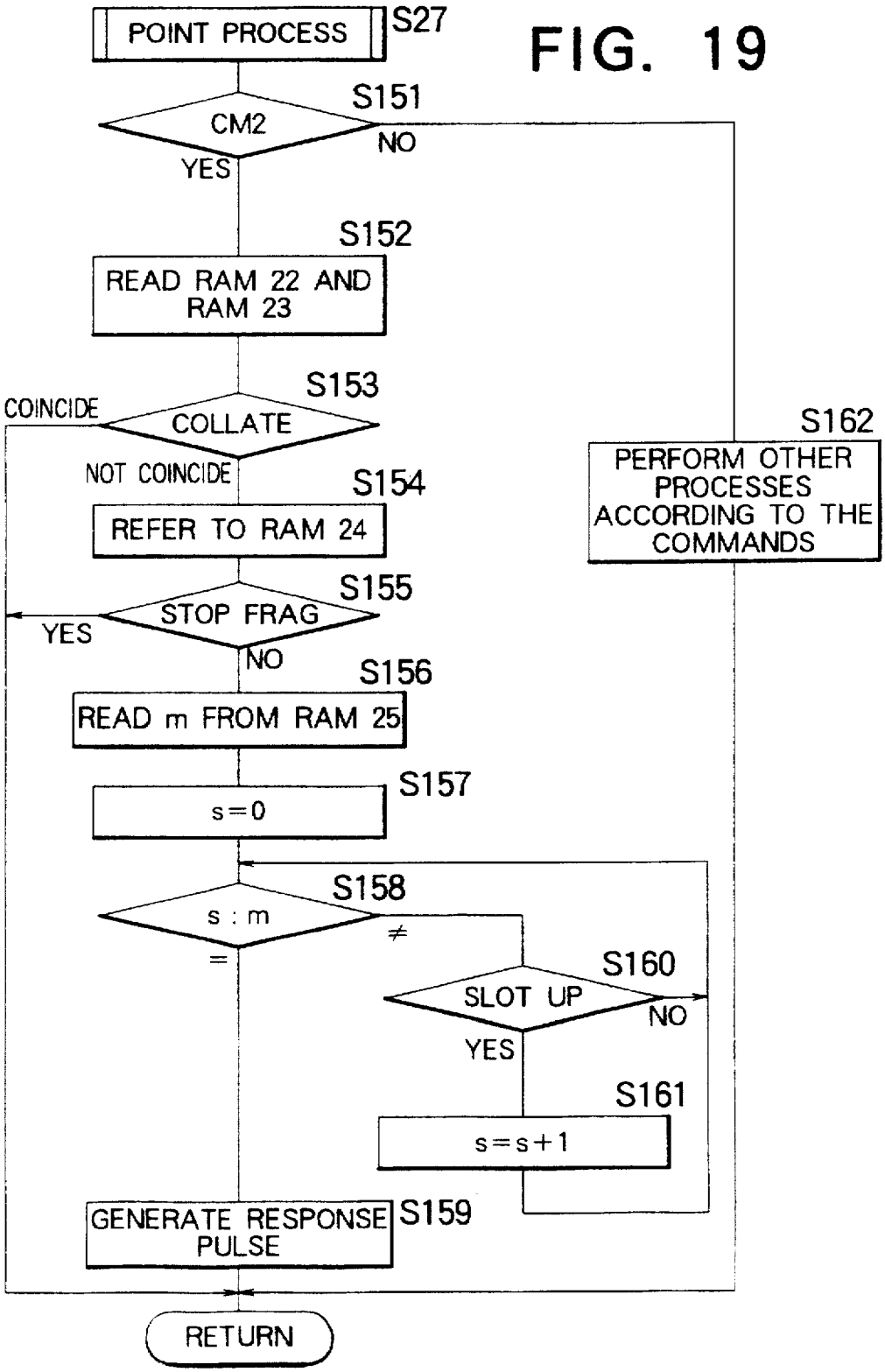
FIG. 19 is a flow chart showing an example of a point process (S27) that is performed by the photoelectric smoke detector S according to the foregoing embodiment.

FIG. 19 is a flow chart showing a specific example of the point process (S27) to be performed by the photoelectric smoke detector S according to the foregoing embodiment.

If the command received from the receiver RE is code GAD(g) of the point polling appointing the group g to which the photoelectric smoke detector S belongs (S26) and is the status information return command CM2 that requires the status change information (S151), the present status information is read from the RAM 22 and the status information that has been transmitted is read from the RAM 23 (S152). If the two status information items do not coincide with each other, it indicates that the status of the photoelectric smoke detector S has been changed. At this time, a reference to the RAM 24 is made (S153 and S154). If the response stop flag is not stored (S155), a state that the status information in the RAM 22 can be transmitted to the receiver RE is realized. Therefore, the number m of the photoelectric smoke detector S in the group is read from the RAM 25 (S156) and the slot number s is set to zero (S157)

When the slot number s and the number m in the group coincide with each other (S158), a response pulse is transmitted to the receiver RE (S159) to respond to the receiver RE. If the slot number s and the number m in the group do not coincide with each other (S158), the slot n umber s is increased by one when the transmission timing of the slot number s has passed (S160 and (S161). The slot number s and the number m in the group are collated (S158). If the command received from the receiver RE is not CM2 (S151) but is another command, a process corresponding to the command is performed (S162).

Figure 20:
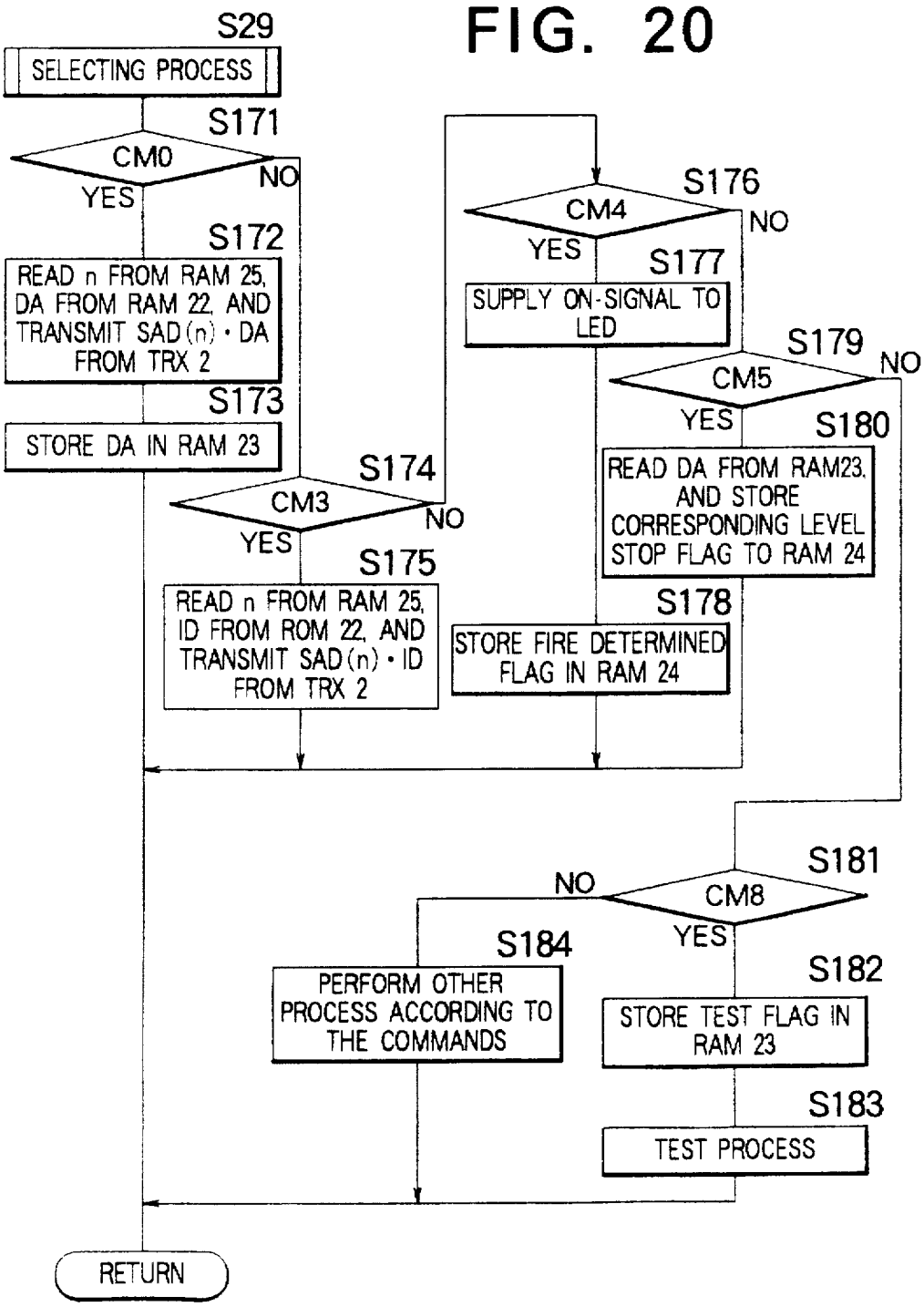
FIG. 20 is a flow chart showing an example of a selecting process (S29) that is performed by the photoelectric smoke detector S according to the foregoing embodiment.

FIG. 20 is a flow chart showing a specific example of the selecting process (S29) to be performed by the photoelectric smoke detector S according to the foregoing embodiment.

If the command received from the receiver RE is command SAD(n) appointing the address n of the fire detector S (S28 shown in FIG. 8) and is status information return command CM0 in the selecting (S171), the address n of the terminal unit is read from the RAM 25, and data DA (for example, a level 2 signal) denoting the present status information is read from the RAM 22. Furthermore, code SAD (n).DA denoting the status change of the photoelectric smoke detector S is transmitted from the signal transmitting/receiving portion TRX 2 (S172), and data DA that has been transmitted to the RAM 23 is stored (S173). If the command received from the receiver RE is not the status information return command CM0 but is the command CM3 (that is the disconnection discrimination selecting) that requires the type information (S171 and S174), the address n of the terminal unit is read from the RAM 25, the type information ID of the detector S is read from the ROM 22, and code SAD(n).ID denoting the type information is transmitted from the signal transmitting/receiving portion TRX 2 (S175).

If the command received from the receiver RE is the fire determined command CM4 (S176), a turning-on signal is transmitted to the operation confirmation lamp LED to turn on the LED (S177). Furthermore, a fire determined flag for stopping the responses to the receiver RE in the system polling and the point polling in accordance with the ensuing status information is stored in the RAM 24 (S178). If the command received from the receiver RE is the command CM5 denoting the level stop command (S179), data DA (for example, a level 1 signal) of the status to be stopped is read from the RAM 23, and a level stop flag for stopping responses to the receiver RE in the system polling and the point polling in only the foregoing state is stored in the RAM 24 (S180).

If the command received from the receiver RE is the command CM8 denoting the remote test command (S181), a test flag is stored in the RAM 23 (S182), and the test process is performed (S183). If the command is not the CM8 command, a process corresponding to the received command is performed (S184).

Figure 21:
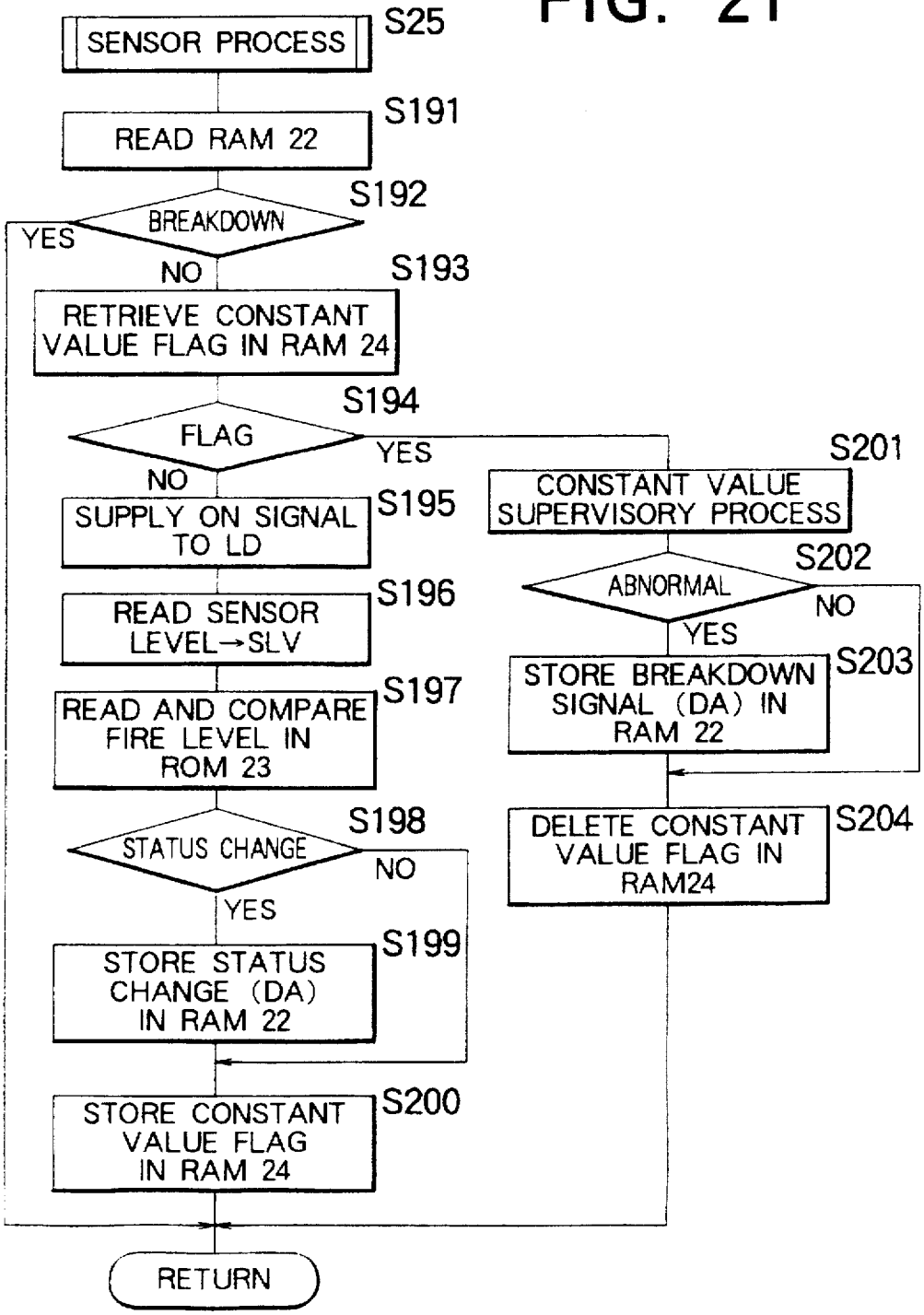
FIG. 21 is a flow chart showing an example of a sensor process (S25) that is performed by the photoelectric smoke detector S according to the foregoing embodiment.

FIG. 21 is a flow chart showing a specific example of a sensor process (S25) to be performed by the photoelectric smoke detector S according to the foregoing embodiment.

The present status information is read from the RAM 22. If the state is not the breakdown state (S191 and S192) and is not a constant value flag, denoting that a constant value supervisory process being performed is not stored in the RAM 24 (S193 and S194), a fire discrimination process is performed. The fire discrimination process is performed in a manner such that a turning on signal is transmitted to the light emitting diode LD (S195), the sensor level is read from the interface IF 23 to make it as SLV (S196), the fire discrimination reference stored in the ROM 23 is read and SLV is subjected to a comparison with the fire discrimination reference (S197). In a case where the photoelectric smoke detector S is a multi-signal type detector, it has a plurality of fire levels from level 1 to level 3 as the fire discrimination reference.

The photoelectric smoke detector S discriminates that the state is fire state level 1, level 2 or level 3. If the state detected by the photoelectric smoke detector S has been changed (S198), data DA (for example, the level 1 signal) denoting the present state is stored in the RAM 22 (S199). Then, a constant value flag for causing the constant value supervisory process to be performed is stored in the RAM 24 (S200).

In a case where the constant value flag is stored in the RAM 24 (S194), the fire discrimination process is not performed but a constant value (which is the quantity of noise light in a normal state and which is the noise light quantity that is changed due to contamination and deterioration) for confirming the function of the photoelectric smoke detector S is detected to perform the constant value supervisory process for confirming whether or not the constant value is included in a predetermined range (S201). If the value is not included in the range, a discrimination is made that the state is abnormal. If an abnormal state has been confirmed (S202), breakdown data is stored in the RAM 22 (S203) and the constant value flag stored in the RAM 24 is deleted (S204).

Figure 22:
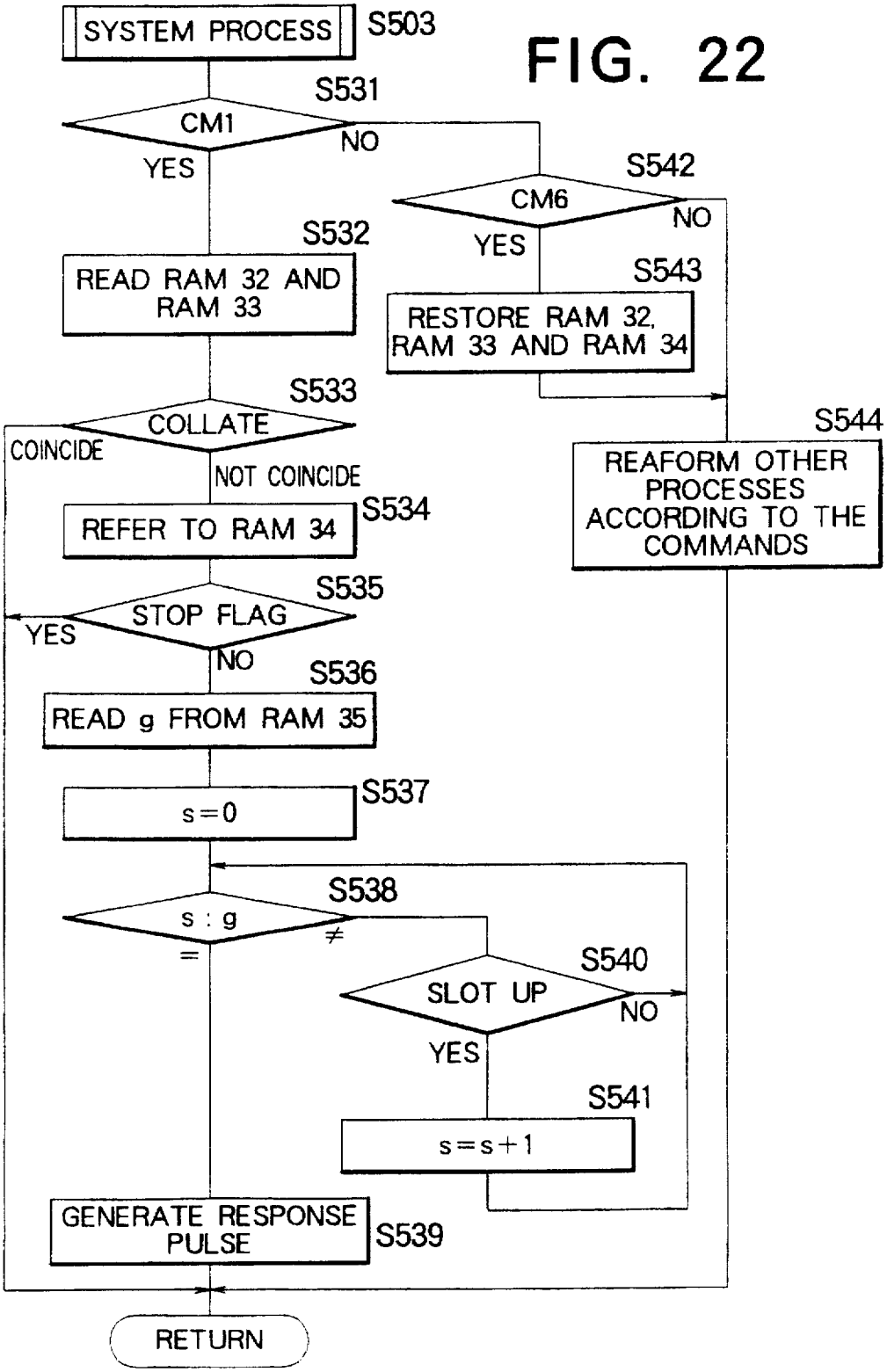
FIG. 22 is a flow chart showing an example of a system process (S503) that is performed by the transmitter P according to the foregoing embodiment.

FIG. 22 is a flow chart showing a specific example of the system process (S503) to be performed by the transmitter P according to the foregoing embodiment.

If the command received from the receiver RE is the system polling command SPAD (S502 shown in FIG. 9) and is the status information return command CM1 that requires only the transmitter P to supply the status change information (S531), the present status information is read from the RAM 32, and the status information that has been transmitted is read from the RAM 33 (S532). If the two status information items do not coincide with each other, it indicates that the state of the transmitter P has been changed. Thus, a reference to the RAM 34 is made (S533 and S534). If response stop flags, such as the fire determined flag, for the system polling and the point polling is not stored (S535), the number g of the group to which the transmitter P belongs is read from the RAM 35 (S536). Furthermore, slot number s denoting the response timing to the system polling is set to zero (S537).

If the slot number s and the group number g coincide with each other (S538), a response pulse is transmitted (S539) to respond to the receiver RE. If the slot number s and the group number g do not coincide with each other (S538), the slot number s is increased by one when the transmission timing for the number s has passed (S540 and S541) to collate the slot number s and the group number g (S538).

If the command received from the receiver RE is not the status information return command CM1 (S531) but is the fire restoration command CM6 (S542), the present status information, the status information that has been transmitted and the various flags stored in the RAMs 32, 33 and 34, are deleted (S543). If the command received is another command, a process corresponding to the command is performed (S544).

In the system process (S503), a response to the status information return command that requires normal status change information is permitted as well as the response to the status information return command CM1. In this case, the transmitter P is brought into the fire determined state simultaneously with the alarm issue. If the fire determination has been made, no response to the receiver RE is permitted. Therefore, a problem of the double response can be prevented.

Figure 23:
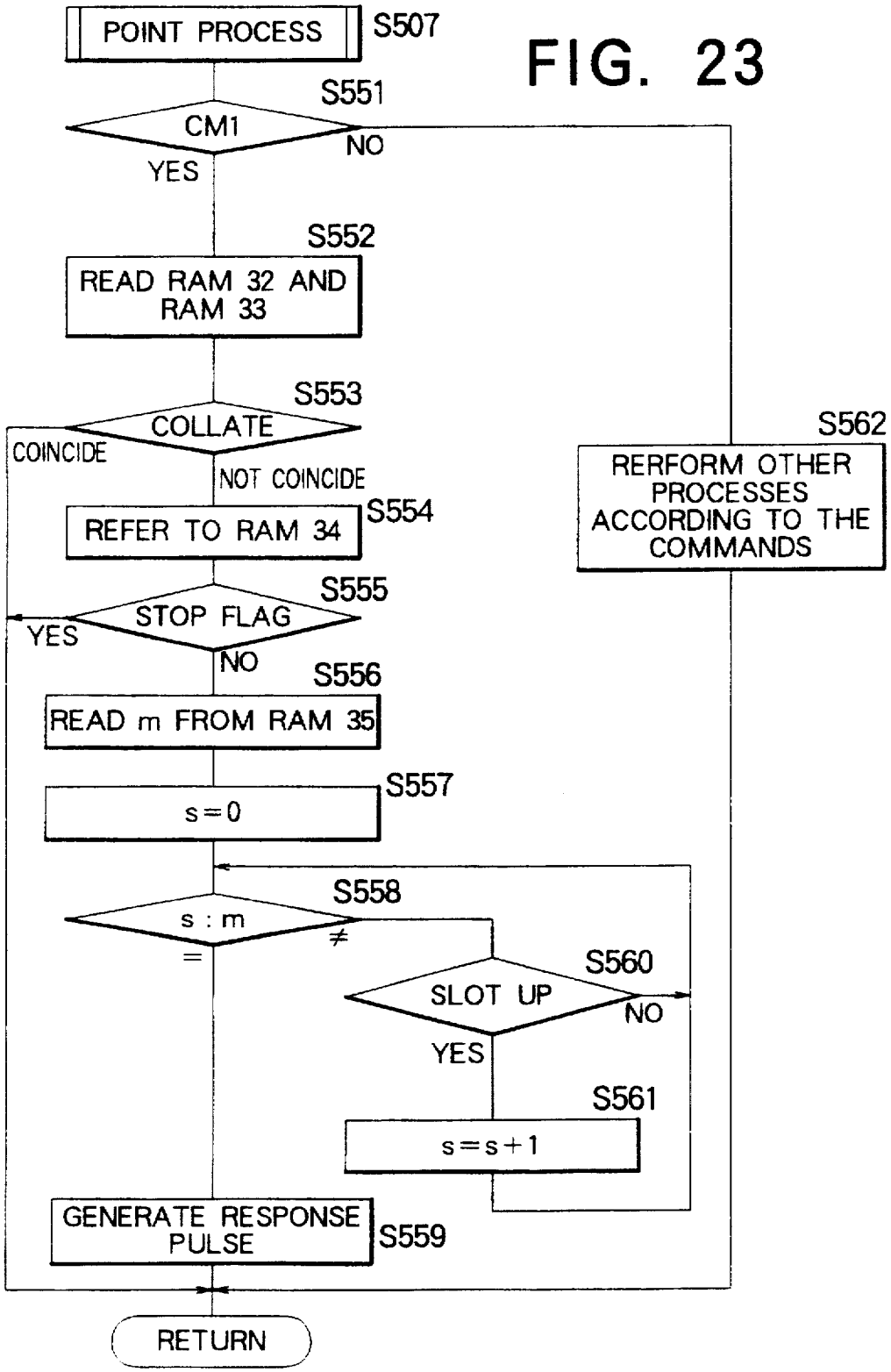
FIG. 23 is a flow chart showing an example of a point process (S507) that is performed by the transmitter P according to the foregoing embodiment.

FIG. 23 is a flow chart showing a specific example of the point process (S507) to be performed by the transmitter P according to the foregoing embodiment.

If the command received from the receiver RE is the command GAD(g) for the point polling for appointing the group g to which the transmitter P belongs (S506 shown in FIG. 9) and is the status information return command CM1 that requires the status change information for only the transmitter P (S551), the present status information is read from the RAM 32 and the status information that has been transmitted is read from the RAM 33 (S552). If the two status information items do not coincide with each other, it indicates that the state of the transmitter P has been changed and a reference to the RAM 34 is made (S553 and S554). If no response stop flag is present (S555), it indicates that the status information in the RAM 32 is information that can be transmitted to the receiver RE. Therefore, the number m of the transmitter P in the group is read from the RAM 35 (S556) and as well as the slot number s is set to zero (S557).

If the slot number s and the number m in the group coincide with each other (S558), a response pulse is transmitted (S559) to respond to the receiver RE. If the slot number s and the number m in the group do not coincide with each other (S558), the slot number is increased by one when the response timing to the number s has been completed (S560 and S561) to collate the slot number s and the number g in the group (S558). If the command received from the receiver RE is not the status information return command CM2 for transmitting the status change (S551) but is another command, a process corresponding to the command is performed (S562).

Also in the point process (S507), response to the status information return command CM2 for requiring the normal status change information is permitted similarly to the system process (S503) as well as the response to the status information return command CM1 for requiring the status change information for only the transmitter P.

Figure 24:
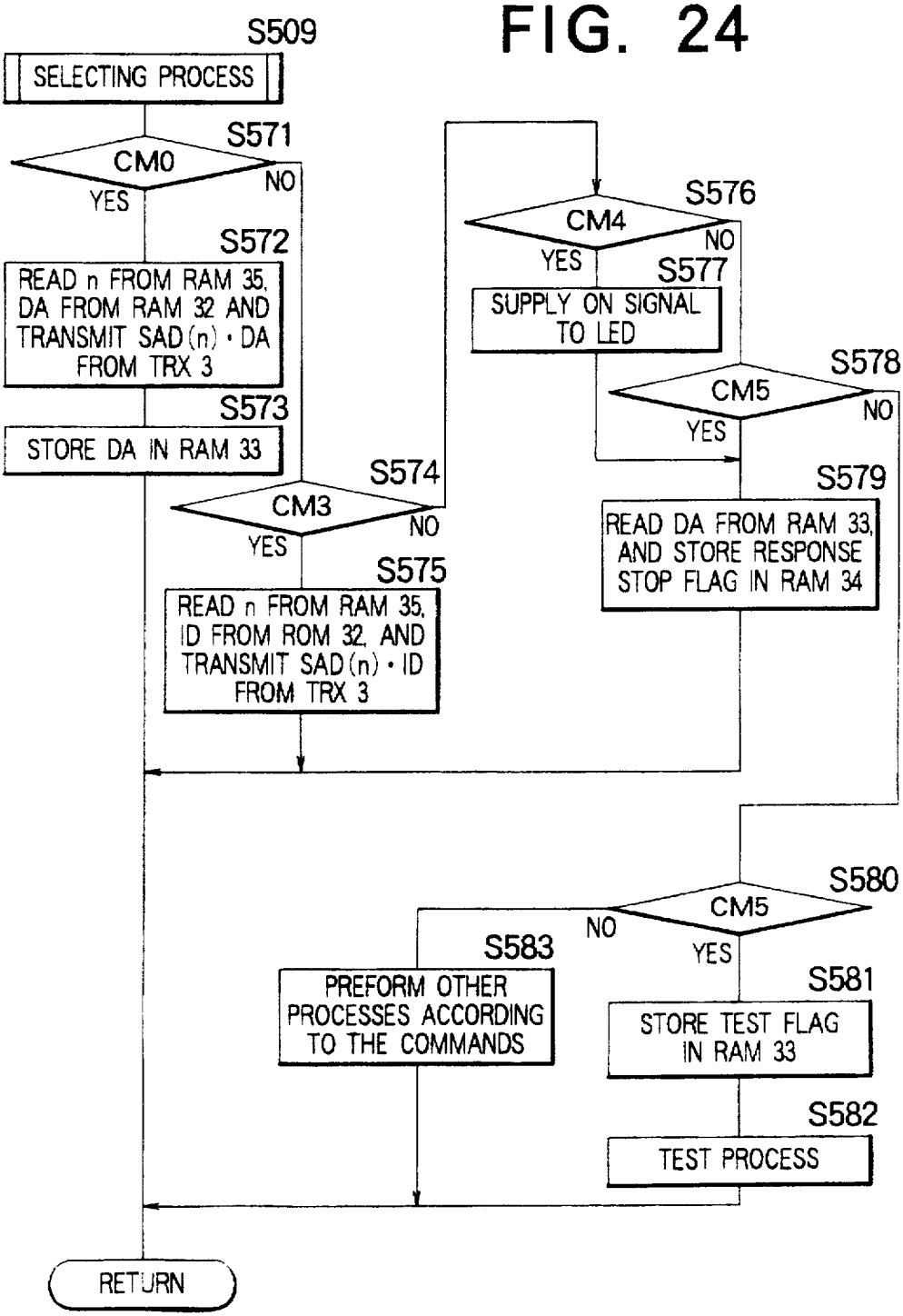
FIG. 24 is a flow chart showing an example of a selecting process (S509) that is performed by the transmitter P according to the foregoing embodiment.

FIG. 24 is a flow chart showing a specific example of the selecting process (S509) to be performed by the transmitter P according to the foregoing embodiment.

If the command received from the receiver RE is the selecting command SAD(n) for appointing the address n of the transmitter P (S508 shown in FIG. 9) and is the status information return command CM0 in the selecting (S571), the address n of the terminal unit is read from the RAM 35, data DA denoting the present status information is read from the RAM 32, command SAD(n).DA denoting the status change of the transmitter P is transmitted from the signal transmitting/receiving portion TRX 3, and data DA that has been transmitted is stored in the RAM 33 (S573). If the command received from the receiver RE is not the status information return command CM0 but is the command CM3 (that is, the disconnection discrimination selecting) for requiring the type information (S571 and S574), the address n of the terminal unit is read from the RAM 35, the type information ID of the transmitter P is read from the ROM 32, and the command SAD(n).ID, denoting the type information, is transmitted from the signal transmitting/receiving portion TRX 3 (S575).

If the command received from the receiver RE is the fire determined command CM4 (S576), a turning on signal is transmitted to the response lamp LED to turn it on (S577). Furthermore, the fire determined flag for inhibiting the response to the system polling and the point polling in accordance with the ensuing status information is stored in the RAM 34 (S579). If the command received from the receiver RE is the remote test command CM8 (S580), the test flag is stored in the RAM 33 (S581), and the test process is performed (S582). If the command is another command, a process corresponding to the command is performed (S583).

Figure 25:
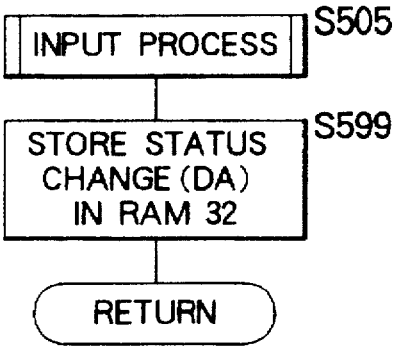
FIG. 25 is a flow chart showing an example of an input process (S505) that is performed by the transmitter P according to the foregoing embodiment.

FIG. 25 is a flow chart showing a specific example of the input process (S505) to be performed by the transmitter P according to the foregoing embodiment.

If a person who has detected the fire depresses the push-button switch SW provided for the transmitter P, a switch input is made from the switch SW (S504 shown in FIG. 9). At this time, data DA denoting the operation of the switch SW is stored in the RAM 32 (S599) and the operation is returned.

Figure 26:
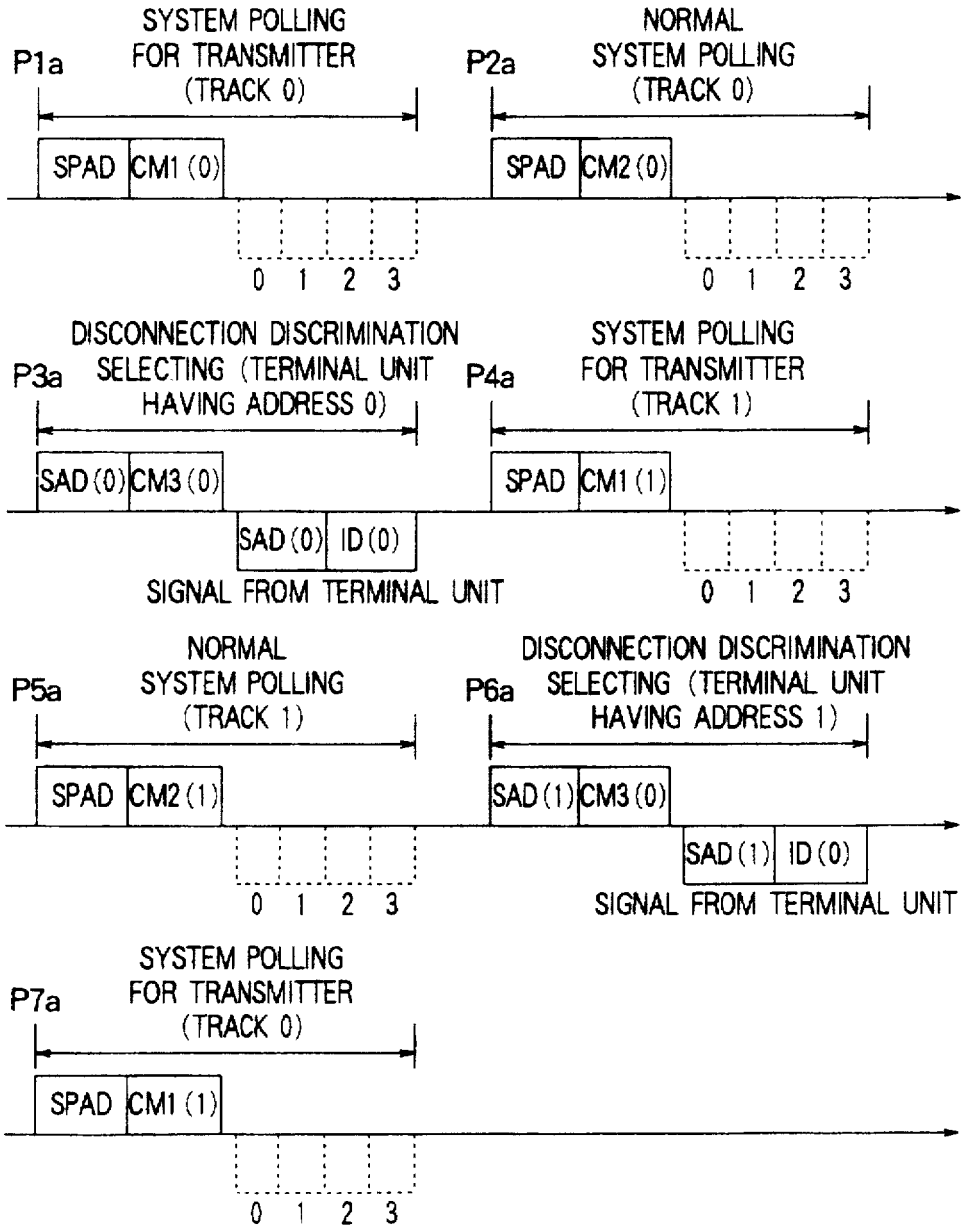
FIG. 26 is a time chart showing another example of the present invention.

FIG. 26 is a timing chart showing another embodiment of the present invention.

The timing chart shows an example in which a multiplicity of groups of the terminal units are divided into a plurality of tracks in a case where a very large number of terminal units, such as transmitters P and fire detectors S, are used, and the tracks are used to perform system polling.

Figure 27:
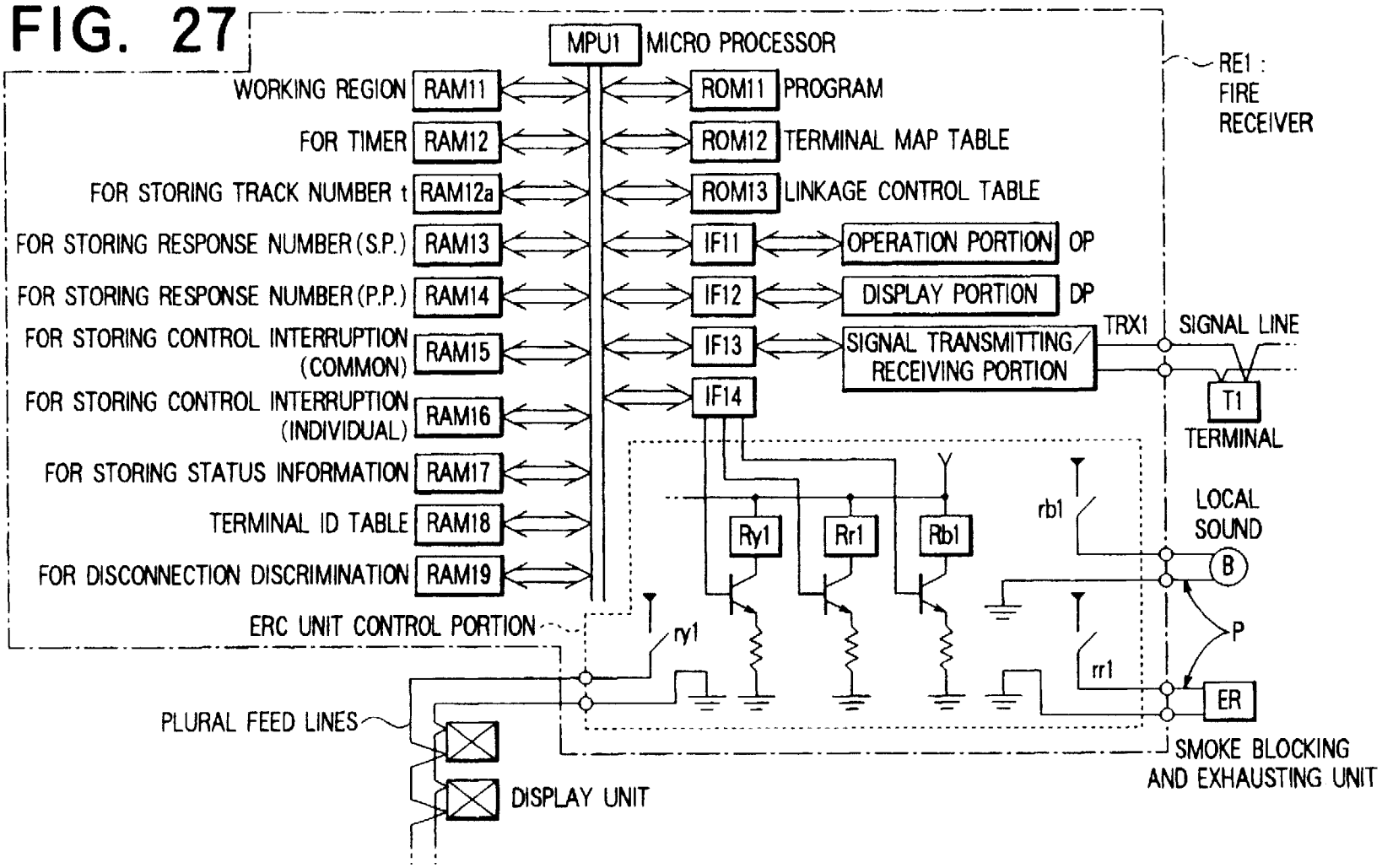
FIG. 27 is a diagram showing a circuit for use in a fire receiver RE1 for use in the embodiment shown in FIG. 26.

FIG. 27 is a circuit diagram for a fire receiver RE1 used in the embodiment shown in FIG. 26.

Although the fire receiver RE1 is basically structured similarly to the receiver RE shown in FIG. 4, the difference is that a RAM 12*a* is added. The RAM 12*a* is a region for storing the number t given to a plurality of tracks into terminal units which are divided in order to perform the system polling for a transmitter, the normal system polling, the point polling for a transmitter and the normal point polling.

Although the fire detectors and the transmitters for use in the embodiment shown in FIG. 26 and ensuing figures have the same structures of the fire detectors S and the transmitters P shown in FIGS. 5 and 6, the fire detectors for use in the embodiment shown in FIGS. 26 and ensuing figures are different from the fire detector S shown in FIG. 5 in that the RAM 25 also stores the track number t. The transmitters for use in the embodiment shown in FIG. 26 and ensuing figures are different from the transmitter P shown in FIG. 6 in that the RAM 35 also stores the track number t.

The embodiment shown in FIG. 26 includes eight terminal unit groups arranged such that the first four groups belong to track 0, the residual four groups belong to track 1 and such that four terminal units belong to each group.

At P1*a* shown in FIG. 26, the terminal units belonging to track 0 are subjected to the system polling for a transmitter. A command for the system polling for a transmitter to which the transmitters belonging to track 0 respond is SPAD.CM1 (0).

The "SPAD" in the command including the foregoing command is composed of, for example 8 bits, while "CM1 (0)" is composed of 8 bits. That is, the structure of the command for appointing the group and the address is appointed with the 8 forward bits of the command and a portion of the following 8 bits of the command is used to appoint the track t. Command CM1 (0) is a status return command for a transmitter that relates to track 0 (note that CM1 is a normal status information return command for a transmitter). Command CM2 (1) is a normal status information return command that relates to track 1 (note that CM2 is a normal status information return command).

At P2*a*, the terminal units belonging to track 0 is subjected to the normal system polling. The command for the normal system polling is SPAD.CM2 (0) for the terminal units belonging to track 0. Then, terminal units belonging to track 0 are subjected to the disconnection discrimination selecting at P3*a*.

The polling of the transmitters belonging to track 0 and polling of the terminal units belonging to track 0 are completed, and then polling of the transmitters belonging to track 1 and polling of terminal units belonging to track 1 are performed. That is, the transmitter belonging to track 1 is subjected to the system polling for a transmitter at P4*a*. Command for the system polling for a transmitter to which the transmitter belonging to track 1 is subjected is SPAD.CM1 (1). At P5*a*, the terminal units belonging to track 1 are subject to the normal system polling. Command for the system polling for a transmitter to which the terminal units belonging to track 1 are subjected is SPAD.CM2 (1).

Then, a terminal unit having address 1 is, at P6*a*, subjected to the disconnection discrimination selecting.

After the system polling of the transmitters and the terminal units belonging to tracks 0 and 1 has been completed, the foregoing operation is repeated (the disconnection discrimination selecting is performed by sequentially increasing the address by one). That is, the system polling for a transmitter for track 0 is performed at P7*a* similarly to P1*a*. Then, the normal system polling for the track 0 is performed similarly to P2*a*. Thus, the foregoing operation is repeated.

If the multiplicity of groups of the transmitters and the terminal units are divided into a plurality of tracks to perform the system polling by using the tracks, a great advantage can be obtained in situations where a very large number of transmitters or terminal units are present and only a very small number of address setting regions can be used. That is, one of the plurality of tracks is appointed with a command so that the track is enabled to substantially serve as an address. Thus, the address can be substantially multiplied.

Figure 28:
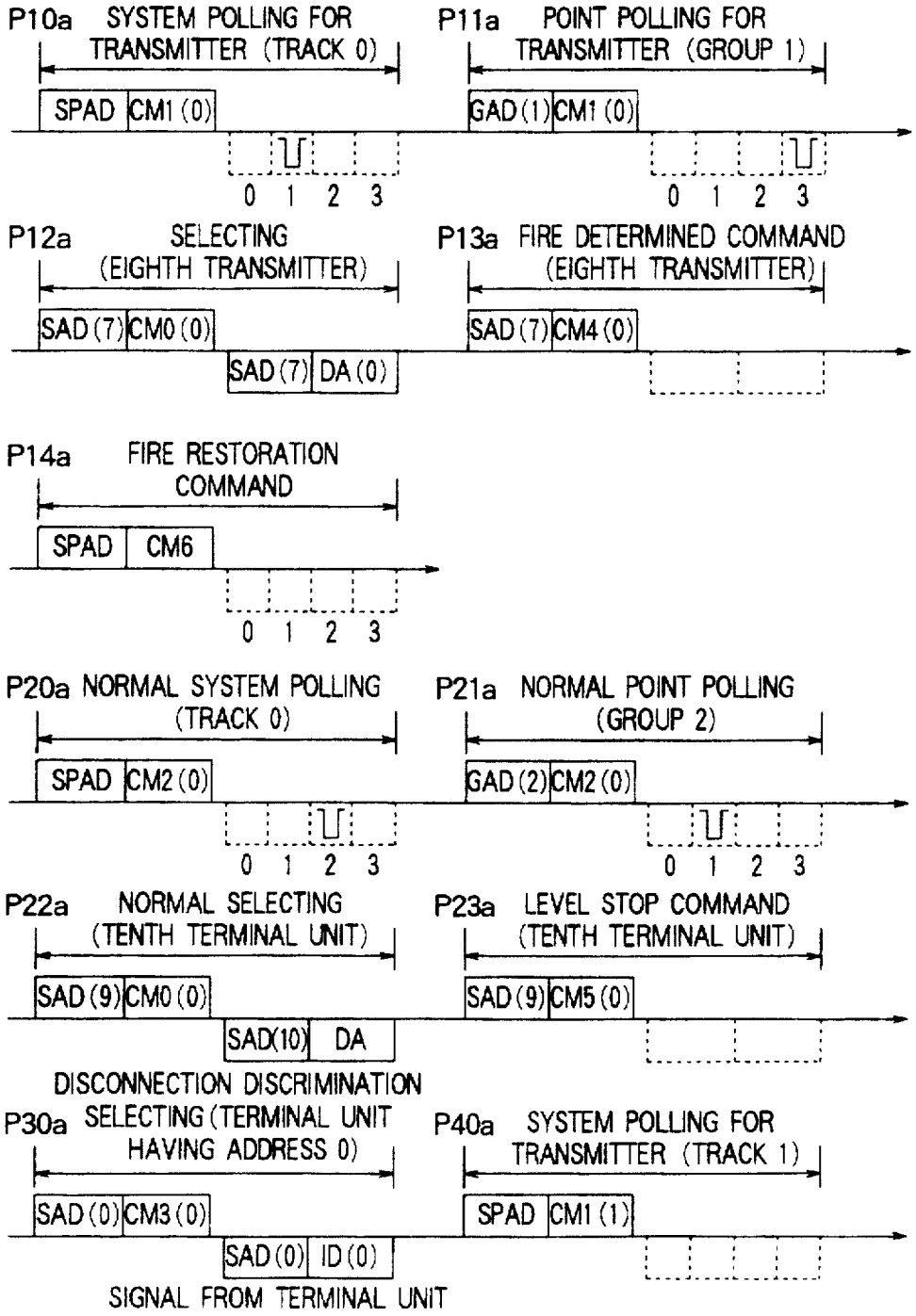
FIG. 28 is a timing chart showing the operation to be performed in a case where a transmitter or a terminal unit having a status change is present in the system polling for a transmitter and the normal system polling.

FIG. 28 is a time chart showing the operation to be performed in a case where there exists a transmitter and a terminal unit having a changed state in the system polling for a transmitter and the normal system polling according to the embodiment shown in FIG. 26.

If the transmitter responds at the response timing for the group G1, (any of the transmitters belonging to group G1 is depressed) when the code SPAD.CM1 (0) denoting the system polling for a transmitter for track 0 has been transmitted from the receiver RE1 at P10*a* shown in FIG. 28, the receiver RE1 transmits to the group G1 the code GAD (1).CM1 (0) denoting the point polling for a transmitter at P11*a*. If a fourth transmitter responds at this time, the receiver RE1 transmits to the eighth transmitter (having address 7) the status information return command SAD (7).CM0 (0) at P12*a*.

As a result, the receiver RE1 transmits to the transmitter that has made a response the fire determined command SAD (7).CM4 (0) at P13*a*. As a result, response for the eighth transmitter to the receiver RE1 is, in the system polling and the point polling, inhibited. Further, the transmitter turns on the response lamp. When the receiver RE1 transmits the fire restoration command SPAD.CM6 to all terminal units at P14*a* after the fire extinguishing operation has been performed and thus the fire has been extinguished, the transmitter, to which the fire determined command has been issued, is restored and the response to a novel issue of the alarm is permitted.

When the receiver RE1 has transmitted to the terminal units belonging to track 0 the command SPAD.CM2 (0) for performing the normal system polling and the terminal unit responds to it at the response timing for the group G2 (if any of the terminal units belonging to group G2 of the track 0 has a status change), the second terminal unit responds to this when the command GAD (2).CM2 (0) for performing the normal point polling has been transmitted to the group G2 at P21*a*. Therefore, the command SAD (9).CM0 (0) denoting the status information return command is transmitted to the thirty-sixth terminal unit (address 9 of track 0 since 16 terminal units belong to one track) at P22*a*. Furthermore, the thirty-sixth terminal unit transmits information DA of the status change. Thus, the receiver RE1 is able to confirm the contents of the status change.

An assumption is made that the receiver RE1 has transmitted level stop command SAD(9).CM5 (0) to its terminal unit at P23*a*. This indicates that the fire level used when the response signal has been transmitted is an unnecessary fire level. Thus, the thirty-sixth terminal unit is then inhibited from transmitting the response signal for the foregoing fire level. At P30*a*, the terminal unit having address 0 is subjected to the disconnection discrimination selecting. At P40*a*, the receiver RE1 subjects the track 1 to the system polling for a transmitter. Then, the receiver RE1 subjects the track 1 to the normal system polling. Then, the foregoing operation is repeated.

Figure 29:
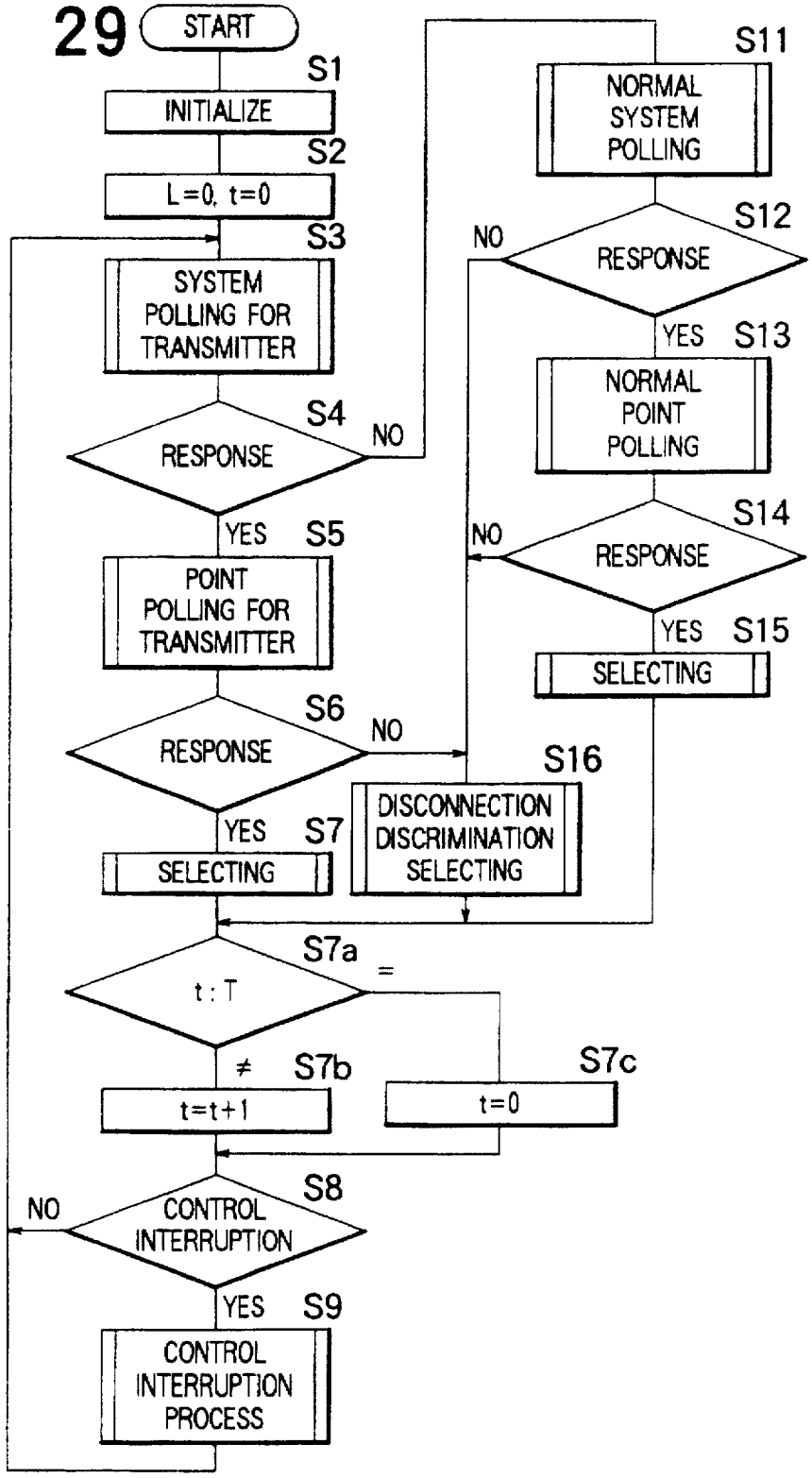
FIG. 29 is a flow chart showing the basic operation of the fire receiver RE1.

FIG. 29 is a flow chart showing the basic operation of the fire receiver RE1.

Although the operation in the foregoing flow chart is basically the same as the operation of the receiver RE shown in FIG. 7, it is different from the basic operation of the receiver RE shown in FIG. 7 in that steps S7*a*, S7*b* and S7*c* are added. Furthermore, the accumulation function is omitted from the description in order to simplify the description.

Referring to FIG. 29, if the track number t does not reach the final number T (in the foregoing embodiment the final number T of the track is 1) (S7*a*) after the selecting (S7) or the disconnection discrimination selecting (S16), the receiver RE1 increases the track number t by one (S7*b*). When the track number t reaches the final number T (S7*a*), the track number t is reset to zero (S7*c*) and the operation is shifted to the control interruption process (S8 and S9).

The polling for a transmitter (at least the system polling for a transmitter or the point polling for a transmitter) may be performed during one cycle of the normal polling (the cycle being composed of the normal system polling, normal point polling and the selecting). For example, the polling for a transmitter may be performed between the normal system polling and the normal point polling. The polling for a transmitter may be performed between one normal point polling and the next normal point polling.

By performing the polling for a transmitter during one cycle of the normal polling, the receiver is able to detect a fact that the button of a transmitter is depressed more quickly than the embodiments shown in FIGS. 1 to 29 if the transmitter is depressed immediately after the polling for a transmitter has been performed.

Note that terminal units, such as the bells B, to be controlled may be connected to the same signal line for the smoke blocking and exhausting unit ER, the fire detector S and the transmitter P and the terminal units to be controlled may be given addresses to similarly collect information and control commands.

As an alternative to the system polling for a transmitter, system polling for a specific terminal unit to which a specific terminal unit, such as a terminal unit in a supervisory system, is subjected, may be performed. In place of the point polling for a transmitter, point polling for a specific terminal unit to which a specific terminal unit, such as a terminal unit in a supervisory system, is subjected, may be performed. In this case, the specific terminal unit in the supervisory system is a transmitter, a fire detector or a gas leakage detector.

Each of the foregoing embodiments have the arrangement such that the group consisting of a plurality of the terminal units is specified by the system polling regardless of the system polling for a transmitter or the normal system polling. Furthermore, the transmitter or the terminal unit is specified by the point polling to which only the transmitter or the terminal unit in the group, which has responded to the system polling, is allowed to respond. By performing the selecting operation, information is collected from the specified transmitter or the terminal unit. The characteristics of the foregoing embodiments may be employed in the methods shown in FIGS. 30 and 31.

Figure 30:
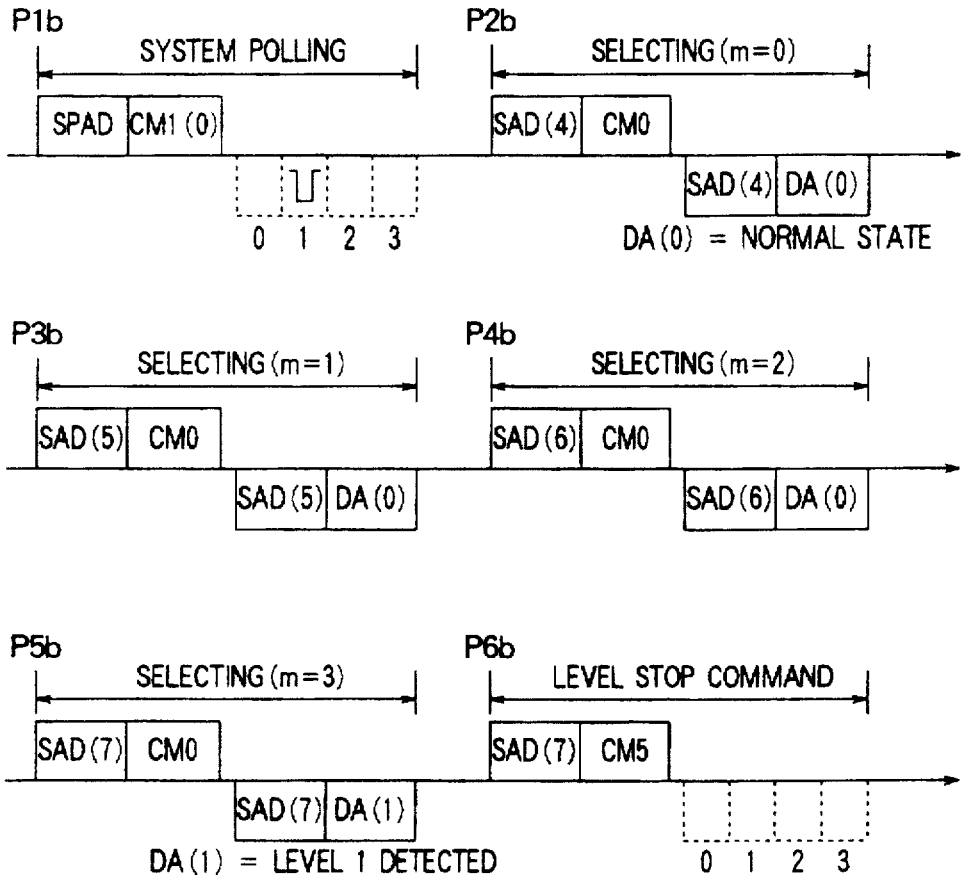
FIG. 30 is a timing chart of an operation that, by system polling, specifies one group consisting of a plurality of terminal units and collects information by selecting each of the terminal units belonging to the specified group.

FIG. 30 is a timing chart of a method in which one of groups, each of which consists of a plurality of terminal units, is specified by the system polling and each of the terminal units belonging to the specified group is subjected to the selecting so as to collect information.

The timing chart has a structure such that the point polling of the embodiments shown in FIGS. 1 to 29 is omitted and all of the terminal units belonging to the group that has responded to the system polling are subjected to the selecting.

All terminal units belonging to the group, which has responded to the system polling performed at P1*b*, are subjected to the selecting to be performed at P2*b*, P3*b*, P4*b*, P5*b* and P6*b*. Furthermore, the point polling is omitted.

Figure 31:
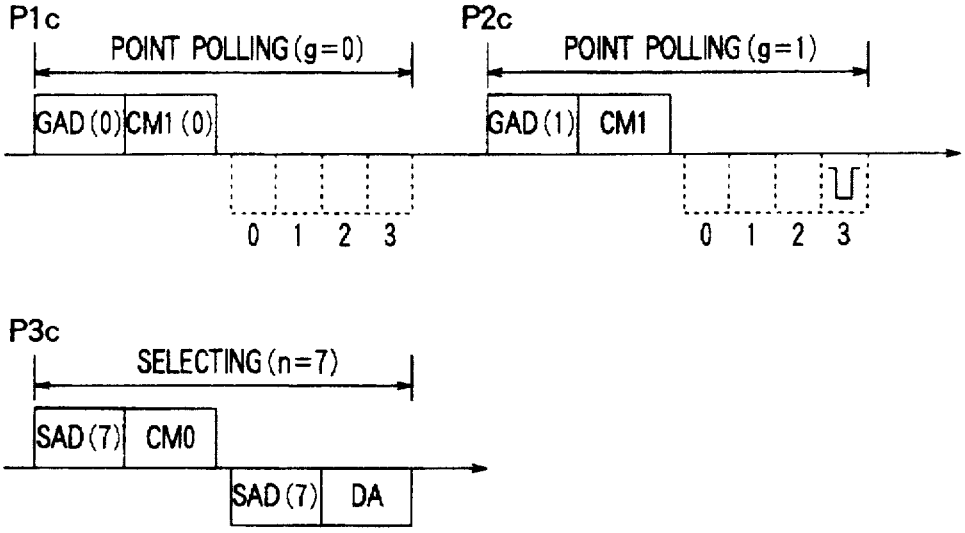
FIG. 31 is a timing chart of an operation that subjects all terminal units to point polling and that subjects only a terminal unit that has made a response in the point polling to selecting to collect information.

FIG. 31 is a timing chart of a method in which the system polling is omitted, all terminal units are subjected to the point polling, and only terminal units that have responded to the point polling are subjected to the selecting so that information is collected.

That is, the timing chart shows the operation in which the system polling is omitted, all terminal units are subjected to the point polling as shown in P1*c* and P2*c*, and only the terminal units that have responded to the point polling are subjected to the selecting as shown in P3*c* so that information is collected.

In each of the foregoing embodiments, the system polling for a transmitter is performed such that the receiving portion is able to quickly recognize the type information when a terminal unit, such as a transmitter, given priority has been operated. Thus, the fire information of the transmitter can be quickly recognized by the receiving portion. Therefore, the system polling, in which a plurality of variable terminal units, such as a plurality of transmitters, a plurality of fire detectors and a plurality of smoke blocking and exhausting units having addresses and connected to the receiving portion are divided into a plurality of groups and the group to which a terminal unit having a changed status belongs is detected in accordance with the response timing, is arranged in such a manner that the system polling for a specific terminal unit is performed prior to the normal system polling. The system polling for a specific terminal unit is polling to which a specific type terminal unit responds, such as only the transmitter, or only the transmitter and the fire detector (only units that supervises fire). A point polling in which the terminal unit having a changed status in a group that has responded to the system polling is specified in accordance with the response timing is arranged in such a manner that the system polling for a specific terminal unit to which only the specified type terminal unit responds is performed prior to the normal point polling. As an alternative to this, the foregoing methods are performed while being combined so that fire information of a terminal unit, such as the transmitter, of a type to be recognized immediately is enabled to be quickly recognized by the receiving portion even if a large number of terminal units are present.

Since each of the foregoing embodiments has the arrangement such that the fire determined command for stopping response to the receiving portion is, after the operation of the terminal unit has been determined, transmitted from the receiving portion to the terminal unit, the operation of which has been determined. Therefore, even if the detection level is repeatedly raised or lowered in the vicinity of the fire discrimination level, the frequent response of the terminal unit to the receiving portion can be prevented. Therefore, the receiving portion does not collect needless information and information of a terminal unit that is operated newly can quickly be collected.

When the system polling, the point polling and the selecting are performed, the fire determined command transmitting means (the means for transmitting the fire determined command for causing the terminal unit among the terminal units, the operation of which has been determined, to stop response to the receiving portion) is used. As an alternative to this, another method may be employed in which the fire determined command transmitting means is used in a case where the selecting for collecting a predetermined information from a terminal unit in a group to which the terminal unit that has responded to the receiving portion in the system polling belongs and system polling are performed and the point polling is not performed. The fire determined command transmitting means may be used in a case where the point polling and the selecting are performed and the system polling is not performed.

Each of the foregoing embodiments has the arrangement such that the receiving portion transmits to the fire detector the level stop command when the fire information received from the multi-signal-type fire detector by the receiving portion is not a desired fire discrimination level. Therefore, the receiving portion does not further collect signals of unnecessary levels from the multi-signal-type fire detector. Thus, non-required responses to the receiving portion can be decreased. That is, the fire receiver has a level stop means for transmitting the level stop command for stopping unnecessary levels. The fire detector has a level stop means for stopping response of the level that is the subject of the supplied level stop command.

The level stop means of the fire detector is a means which reads the reference level from a predetermined storage means when it receives the level stop command from the receiving portion, which subjects the detected level and the read reference level to a comparison and which inhibits response to the receiving portion that the status change has taken place if a discrimination has been made that the detected level is higher than the reference level. As an alternative to this, a means may be used which inhibits the operation of reading the reference level from the predetermined storage means when the level stop command has been received from the receiving portion. Also the foregoing structure enables the operation that is the same as the foregoing operation for inhibiting the response that the status change has taken place to be performed as for the reference level, the reading of which has been stopped.

In a case where a discrimination is made as a result of the discrimination made by the receiving portion that the level is an unnecessary level, the receipt of the fire information about the unnecessary level from the multi-signal-type fire detector enables the discrimination to be made that the level received by the receiving portion is the unnecessary level. Therefore, storage of the fire detector, the level of which has been stopped, by the fire receiver enables the line about the detector that has made a response was free from disconnection can be confirmed afterwards. The fire detector may comprise a detection means that detects the environmental change occurring due to a fire phenomenon to transmit the sensor level, a fire discriminating means that subjects the sensor level transmitted from the detection means and a plurality of different levels to a comparison to discriminate fire, a response means for responding the status change, which is the result of the discrimination made by the discriminating means, to the receiving portion at the time of polling made from the receiving portion, and a level stop means which is address-appointed by the receiving portion to receive the level stop command and which stops the response about the level appointed by the received level stop command.

Each of the foregoing embodiments has the arrangement such that the system polling is performed in such a manner that the group is divided into a plurality of tracks, information for identifying the tracks is stored in the command and the system polling is performed for each track. Therefore, even if the number of the terminal units that must be disposed is larger than the number of the terminal units corresponding to the addresses for one track, the address length is the same. That is, the number of the terminal units that can be disposed can be increased without lengthening the address past a predetermined length.

Usually, the microprocessor processes information in units of four bits or eight bits. In a case where 8 bits are used as the address, an increase in the number of the terminal units causes the address to be, for example, 9 bits which is an incomplete number for the microprocessor. Thus, the process to be performed by the microprocessor becomes difficult. However, the present invention is able to eliminate the necessity of lengthening the address length past a predetermined length. Therefore, the foregoing difficulty for the microprocessor to complete the process can be eliminated.

In the case where the system polling and the selecting are performed and the point polling is not performed, the plural groups may be divided into a plurality of tracks and the system polling may be performed for each track. In the case where the point polling and the selecting are performed and the system polling is not performed, the plural terminal units may be divided into a plurality of tracks and the point polling may be performed for each track.

In the foregoing embodiments, the plural groups consisting of the terminal units (the system polling for a specific terminal unit, the normal system polling, the point polling for a specific terminal unit and the normal point polling) are divided into a plurality of tracks and each track has the number t. As an alternative to this, only the groups consisting of specific terminal units, such as the transmitters, may be divided into a plurality of tracks and the number t may be given to each track. Only the groups consisting of terminal units that do not include the specific terminal unit, may be divided into a plurality of tracks and the number t may be stored for each track.

In the foregoing embodiments, the group that has responded to the system polling is subjected to the point polling to specify the terminal unit and information is collected by the selecting. The normal point polling may be omitted and all terminal units in the group that have responded in the normal system polling may be sequentially subjected to the selecting. The normal system polling may be omitted and the respective groups may be sequentially subjected to the point polling to subject the terminal unit having a changed status to the selecting. The point polling for a specific terminal unit may be omitted and all specific terminal units in the group that has made a response in the system polling for a specific terminal unit may be sequentially subjected to the selecting. The system polling for a specific terminal unit may be omitted and the respective groups may be sequentially subjected to the point polling for a specific terminal unit to subject the specific terminal unit having a changed status to the selecting. Also in the foregoing case, the receiving portion is able to quickly recognize the fact that the transmitter was depressed. Furthermore, the foregoing level stop and the fire determination may be adapted to the foregoing case.

The terminal unit or the specific terminal unit may be specified by the combination of the normal system polling, the normal point polling, the selecting and the point polling for a specific terminal unit (that is, the system polling for a specific terminal unit may be omitted). The terminal unit or the specific terminal unit may be specified by the combination of the system polling for a specific terminal unit, the normal point polling and the selecting. Also in the foregoing case, the receiving portion is able to quickly recognize the fact that the transmitter was depressed. Furthermore, the foregoing level stop and the fire determination may be adapted to the foregoing case. The normal point polling in the case where the terminal unit or the specific terminal unit is specified by the combination of the normal system polling, the system polling for a specific terminal unit, the normal point polling and the selecting is polling in which the times at which the terminal unit in a group to which the terminal unit that has responded to the receiving portion in the normal system polling or the system polling for a specific terminal unit responds to the receiving portion is made to be different among the terminal units and the terminal unit having a changed status responds to the receiving portion at the time at which the terminal unit makes a response.

According to the first aspect of the present invention, an effect can be obtained in that the receiving portion is able to quickly receive fire information from a transmitter or the like if a specific terminal unit has been operated even in a large-size fire alarm system.

According to the second aspect of the present invention, an effect can be obtained in that no response to the receiving portion is made even if the detected level is repeatedly raised and lowered in the vicinity of the fire level after the operation of the fire detector has been discriminated and therefore the process to be performed by the receiving portion cannot be delayed.

Since the third aspect of the present invention has an arrangement such that the level supplied from the multi-signal-type fire detector is discriminated by the receiving portion, the fire level can easily be changed by changing the data in the receiving portion. Furthermore, a fire detector can be attached while eliminating the necessity of considering the fire discrimination level of the fire detector.

According to the fourth aspect of the present invention, an effect can be obtained in that a previous alarm can be issued prior to issuing a usual fire alarm in a polling selecting method.

According to the fifth aspect of the present invention, an effect can be obtained in that, in a case where a plurality of terminal units are subjected to the system polling, point polling and the selecting, the smoke level supplied from the multi-signal-type fire detector is discriminated by the receiving portion and the multi-signal-type fire detector is used as a fire detector having a predetermined fire level, the delay in the process to be performed by the receiving portion due to increase in the response signals to the receiving portion can be prevented even if a fire signal of smoke or heat having a level different from the predetermined fire level is detected and the multi-signal-type fire detector is thus repeatedly turned on and off.

According to the sixth aspect of the present invention, the accumulating operation can be performed as the fire alarm system even if a fire detector having no accumulating function is used. Therefore, an increase in the number of parts of the fire detector can be prevented even if the accumulation, at the time of detecting a fire, is performed. Furthermore, the fire detector does not require a large memory capacity.

According to the seventh aspect of the present invention, an effect can be obtained in a case where a plurality of terminal units are subjected to the system polling, point polling and the selecting and the fire alarm system is enlarged and the number of the terminal units that must be given addresses is increased, the time required to call each address cannot be lengthened. Furthermore, a difficulty in performing a uniform process due to using incomplete number of bits for the purpose of forming the address space can be overcome.

What is claimed is:

1. A fire alarm system comprising:

a plurality of terminal units;

a receiver portion, connected to said terminal units, for addressing each of said terminal units and detecting terminal units among said terminal units that have status changes;

means for operating in a normal system polling mode in which said plurality of terminal units are divided into a plurality of groups and in which each of said groups is assigned a different response timing to respond to said receiver, wherein a terminal unit having a changed status responds to said receiver at said response timing for a group containing said terminal unit having the changed status;

means for operating in a normal point polling mode in which each of the terminal units contained in said group having said terminal unit having the changed status is assigned a different response timing to respond to said receiver, wherein said terminal unit having the changed status responds to said receiver at a response timing assigned to said terminal unit;

means for operating in a specific system polling mode in which only specific terminal units among said terminal units are divided into a plurality of groups, and in which each group is assigned a different response timing to respond to said receiver, wherein a specific terminal unit having a status change responds to said receiver at said response timing assigned to a group containing said specific terminal unit having the status change;

means for operating in a specific point polling mode in which each of the specific terminal units contained in the group having said specific terminal unit having the status change is assigned a different response timing to respond to said receiver, wherein only said specific terminal unit having the changed status responds to said receiver at said response timing assigned to said specific terminal unit; and selecting means which selects said terminal unit that has responded to said receiver during said normal point polling mode and said specific point polling mode and which causes said receiver to collect a predetermined information from said terminal unit, wherein a one of said specific terminal system polling mode and said point polling mode are performed prior to performing said normal system polling mode.

2. A fire alarm system comprising:

a plurality of terminal units;

a receiver portion, connected to said terminal units, for addressing each of said terminal units and detecting terminal units among said terminal units that have status changes;

means for operating in a normal system polling mode in which said plurality of terminal units are divided into a plurality of groups and in which each of said groups is assigned a different response timing to respond to said receiver, wherein a terminal unit having a changed status responds to said receiver at said response timing for a group containing said terminal unit having the changed status;

means for operating in a specific system polling mode in which only specific terminal units among said terminal units are divided into a plurality of groups, and in which each group is assigned a different response timing to respond to said receiver, wherein a specific terminal unit having a status change responds to said receiver at said response timing assigned to a group containing said specific terminal unit having the status change;

selecting means which performs a selecting operation for sequentially collecting a predetermined information from each terminal unit in a group containing said terminal unit that has responded to said receiver in a case where a response is made in said normal system polling or said specific system polling mode, wherein said specific system polling mode and any corresponding selecting of said selecting means are performed prior to performing said normal system polling mode.

3. A fire alarm system comprising:

a plurality of terminal units;

a receiver, connected to said terminal units, for addressing each of said terminal units and detecting terminal units among said terminal units that have status changes;

means for operating in a normal point polling mode in which each of the terminal units is assigned a different response timing to respond to said receiver, wherein a terminal unit having the changed status responds to said receiver at a response timing assigned to said terminal unit;

means for operating in a specific point polling mode in which each of specific terminal units among said terminal units is assigned a different response timing to respond to said receiver, wherein only a specific terminal unit having the changed status responds to said receiver at said response timing assigned to said specific terminal unit; and selecting means which selects said terminal unit that has responded to said receiver during said normal point polling mode and said specific point polling mode and which causes said receiver to collect a predetermined information from said terminal unit, wherein said specific point polling mode and any corresponding selection of said selecting means are performed prior to performing said normal point polling mode.

4. A fire alarm system comprising:

a plurality of terminal units;

a receiver portion, connected to said terminal units, for addressing each of said terminal units and detecting terminal units among said terminal units that have status changes;

means for operating in a normal system polling mode in which said plurality of terminal units are divided into a plurality of groups and in which each of said groups is assigned a different response timing to respond to said receiver, wherein a terminal unit having a changed status responds to said receiver at said response timing for a group containing said terminal unit having the changed status;

means for operating in a normal point polling mode in which each of the terminal units contained in said group having said terminal unit having the changed status is assigned a different response timing to respond to said receiver, wherein said terminal unit having the changed status responds to said receiver at a response timing assigned to said terminal unit;

means for operating in a specific point polling mode in which each of specific terminal units among said terminal units is assigned a different response timing to respond to said receiver, wherein only a specific terminal unit having the changed status responds to said receiver at said response timing assigned to said specific terminal unit; and selecting means which selects said terminal unit that has responded to said receiver during said normal point polling mode and said specific point polling mode and which causes said receiver to collect a predetermined information from said terminal unit, wherein said specific point polling mode and any corresponding selecting of said selecting means are performed prior to performing any said normal system polling mode.

5. A fire alarm system comprising:

a plurality of terminal units;

a receiver portion, connected to said terminal units, for addressing each of said terminal units and detecting terminal units among said terminal units that have status changes;

means for operating in a normal system polling mode in which said plurality of terminal units are divided into a plurality of groups and in which each of said groups is assigned a different response timing to respond to said receiver, wherein a terminal unit having a changed status responds to said receiver at said response timing for a group containing said terminal unit having the changed status;

means for operating in a specific system polling mode in which only specific terminal units among said terminal units are divided into a plurality of groups, and in which each group is assigned a different response timing to respond to said receiver, wherein a specific terminal unit having a status change responds to said receiver at said response timing assigned to a group containing said specific terminal unit having the status change;

means for operating in a normal point polling mode in which each of the terminal units contained in said group having said terminal unit having the changed status is assigned a different response timing to respond to said receiver, wherein said terminal unit having the changed status responds to said receiver at a response timing assigned to said terminal unit;

selecting means which select said terminal unit that has responded to said receiver during said normal point polling mode and which causes said receiver to collect a predetermined information from said terminal unit, wherein said specific system polling mode and any corresponding selecting of said selecting means are performed prior to performing said normal system polling mode.

6. A fire alarm system comprising:

a plurality of terminal units;

a receiver portion, connected to said terminal units, for addressing each of said terminal units and arranged to detect terminal units among said terminal units that have status changes;

means for operating in a normal system polling mode in which said plurality of terminal units are divided into a plurality of groups and in which each of said groups is assigned a different response timing to respond to said receiver, wherein a terminal unit having a changed status responds to said receiver at said response timing for a group containing said terminal unit having the changed status;

means for operating in a normal point polling mode in which each of the terminal units contained in said group having said terminal unit having the changed status is assigned a different response timing to respond to said receiver, wherein said terminal unit having the changed status responds to said receiver at a response timing assigned to said terminal unit;

selecting means for performing a selecting operation that causes said receiver to collect predetermined information from said terminal unit that has responded to said receiver during said normal point polling mode, wherein said plurality of groups are divided into a plurality of tracks in said normal system polling mode and said normal system polling mode is performed for each track.

7. A fire alarm system comprising:

a plurality of terminal units;

a receiver portion, connected to said terminal units, for addressing said terminal units and arranged to detect terminal units among said terminal units that have status changes;

means for operating in a normal system polling mode in which said plurality of terminal units are divided into a plurality of groups and in which each of said groups is assigned a different response timing to respond to said receiver, wherein a terminal unit having a changed status responds to said receiver at said response timing for a group containing said terminal unit having the changed status;

selecting means for performing a selecting operation that causes said receiver to sequentially collect predetermined information from said terminal unit in a group containing said terminal unit that has responded to said receiver during said normal point polling mode, wherein said plurality of groups are divided into a plurality of tracks in said normal system polling mode and said normal system polling mode is performed for each track.

8. A fire alarm system comprising:

a plurality of terminal units;

a receiver portion, connected to said terminal units, for addressing said terminal units and detecting terminal units among said terminal units that have status changes;

means for operating in a normal point polling mode in which each of the terminal units is assigned a different response timing to respond to said receiver, wherein a terminal unit having the changed status responds to said receiver at a response timing assigned to said terminal unit;

selecting means for performing a selecting operation that causes said receiver to collect specific information from said terminal unit that has responded to said receiver during said normal point polling mode, wherein said plurality of terminal units are divided into a plurality of groups in said normal point polling mode, and wherein said plurality of groups are divided into a plurality of tracks, said normal point polling mode being performed for each track.

9. A fire alarm system comprising:

a plurality of fire detectors including multi-signal-type fire detectors;

a receiving portion connected to each of said fire detectors and arranged to give an address to each of said fire detectors and acting to detect said fire detector having a status change;

level discriminating means for discriminating whether or not a level signal received from said multi-signal-type fire detector among said fire detectors is a desired level signal for discriminating fire occurrences in accordance with said address;

fire detector status change determining means for sequentially calling said fire detectors detected by said receiving portion, and confirming the status changes of said fire detectors on the basis of data returned from the called fire detectors and determining the status changes; and level stop command transmitting means for transmitting a level stop command for causing said fire detector to stop response at said received level if said received signal is not said desired level signal, wherein said fire detector that has received said level stop command does not make a response at said level, the response of which has been stopped.

10. A fire alarm system comprising:

a plurality of fire detectors;

a receiving portion, connected to said fire detectors, arranged to call said fire detectors to detect status changes by polling, said fire detectors responding only when said fire detectors have the status change, wherein said receiving portion collects information only from said fire detectors that have made a response;

timer means which starts counting of a predetermined time when said receiving portion has collected the status information with which a fire occurrence is discriminated from said fire detectors and wherein said timer means clears said counting of said predetermined time when said receiving portion has collected a restoration signal as the status information from said fire detectors, wherein said timer means continues counting when said status information from said fire detectors is not a restoration signal; and accumulation discrimination means which discriminates that an accumulating operation of said fire detectors has been completed when said timer means has completed said counting of said predetermined time.

11. A fire alarm system comprising:

a plurality of fire detectors including multi-signal-type fire detectors;

a receiving portion connected to each of said fire detectors and arranged to give an address to each of said fire detectors and acting to detect said fire detector having a status change;

level discriminating means for discriminating whether or not a level signal received from said multi-signal-type fire detector among said fire detectors is a desired level signal for discriminating fire occurrence in accordance with said address; and a previous alarm discriminating means for issuing a previous alarm if the level is n−1 in a case where said desired level is n (n is an integer larger than 2).

12. A fire alarm system according to claim 9 wherein said receiving portion transmits a restoration signal to said fire detector at the time of restoring said system and said fire detector that has received said level stop command is restored in response to said restoration signal.

13. A fire alarm system according to claim 1, wherein said specific polling mode or said specific point polling mode and any corresponding selection of said selecting means are performed prior to performing said normal point polling mode and any corresponding selection of said selecting means.

14. A fire alarm system according to claim 2, wherein said specific system polling mode and the corresponding selecting of said selecting means are performed prior to performing said selecting corresponding to said normal system polling mode.

15. A fire alarm according to claim 3, wherein said specific point polling mode and any corresponding selecting of said selecting means are performed prior to performing said normal point polling mode and any corresponding selecting of said selecting means.

16. A fire alarm according to claim 4, wherein said specific point polling mode and any corresponding selecting of said selecting means are performed prior to performing said normal point polling mode and any corresponding selecting of said selecting means.

17. A fire alarm according to claim 5, wherein said specific point polling mode and any corresponding selecting of said selecting means are performed prior to performing said normal point polling mode and any corresponding selecting of said selecting means.

18. A fire alarm system according to any one of claim 1 to 17, wherein said terminal units are transmitters, fire detectors and/or gas detectors.

19. A fire alarm system according to any one of claims 6 to 8, wherein information of said tracks is set in a command among addresses and commands which are transmitted by said receiver to said terminal unit.

20. A fire alarm system according to any one of claims 12, 11, 9, or 10, further comprising:

means for operating in a normal system polling mode in which said plurality of fire detectors are divided into a plurality of groups and in which each of said groups is assigned a different response timing to respond to said receiver, wherein a fire detector having a changed status responds to said receiver at said response timing for a group containing said fire detector having the changed status;

means for operating in a normal point polling mode in which each of the fire detectors contained in said group having said fire detector having the changed status is assigned a different response timing to respond to said receiver, wherein said fire detector having the changed status responds to said receiver at a response timing assigned to said fire detector;

selecting means for causing said receiver to collect predetermined information from said fire detector that has responded to said receiver during said normal point polling mode.

21. A fire alarm system according to any one of claims 12, 11, 9, or 10, further comprising:

means for operating in a normal system polling mode in which said plurality of fire detectors are divided into a plurality of groups and in which each of said groups is assigned a different response timing to respond to said receiver, wherein a fire detector having a changed status responds to said receiver at said response timing for a group containing said fire detector having the changed status;

selecting means for performing a selecting operation that causes said receiver to sequentially collect predetermined information from each fire detector in a group containing fire detector that has responded to said receiver during said normal system polling mode.

22. A fire alarm system according to any one of claims 12, 11, 9, or 10, further comprising:

means for operating in a normal system polling mode in which said plurality of fire detectors are divided into a plurality of groups and in which each of said groups is assigned a different response timing to respond to said receiver, wherein a fire detector having a changed status responds to said receiver at said response timing for a group containing said fire detector having the changed status;

means for operating in a normal point polling mode in which each of the fire detectors is assigned a different response timing to respond to said receiver, wherein a fire detector having the changed status responds to said receiver at a response timing assigned to said fire detector;

selecting means for performing a selecting operation that causes said receiver to collect predetermined information from said fire detector that has responded to said receiver during said normal point polling mode.

23. A fire alarm system comprising:

a plurality of terminal units;

a receiver portion, connected to said terminal units, for addressing each of said terminal units and detecting terminal units among said terminal units that have status changes;

terminal unit status change determining means for sequentially calling said terminal units detected by said receiver portion, and confirming the status changes of said terminal units on the basis of data returned from the called terminal units and determining the status changes;

fire determined command transmitting means for sequentially transmitting fire determined commands only to said terminal units determined to have the status changes by said terminal unit status change determining means, and stopping responses to said receiver portion only for said terminal units which have received the fire determined command;

means for operating in a normal system polling mode in which said plurality of terminal units are divided into a plurality of groups and in which each of said groups is assigned a different response timing to respond to said receiver portion, wherein a terminal unit having a changed status responds to said receiver portion at said response timing for a group containing said terminal unit having the changed status;

means for operating in a normal point polling mode in which each of the terminal units contained in said group having said terminal unit having the changed status is assigned a different response timing to respond to said receiver portion, wherein said terminal unit having the changed status responds to said receiver portion at a response timing assigned to said terminal unit; and selecting means for causing said receiver portion to collect predetermined information from said terminal unit that has responded to said receiver portion during said normal point polling mode;

wherein each of said terminal units is an accumulative-type fire detector, a fire detector, the accumulating operation of which has been completed in said receiver portion, and/or a transmitter that has transmitted a fire signal to said receiver portion.

24. A fire alarm system comprising:

a plurality of terminal units;

a receiver portion, connected to said terminal units, for addressing each of said terminal units and detecting terminal units among said terminal units that have status changes;

terminal unit status change determining means for sequentially calling said terminal units detected by said receiver portion, and confirming the status changes of said terminal units on the basis of data returned from the called terminal units and determining the status changes;

fire determined command transmitting means for sequentially transmitting fire determined commands only to said terminal units determined to have the status changes by said terminal unit status change determining means, and stopping responses to said receiver portion only for said terminal units which have received the fire determined command;

means for operating in a normal system polling mode in which said plurality of terminal units are divided into a plurality of groups and in which each of said groups is assigned a different response timing to respond to said receiver portion, wherein a terminal unit having a changed status responds to said receiver portion at said response timing for a group containing said terminal unit having the changed status; and selecting means for performing a selecting operation that causes said receiver portion to sequentially collect predetermined information from each terminal unit in a group containing said terminal unit that has responded to said receiver portion during said normal system polling mode;

wherein each of said terminal units is an accumulative-type fire detector, a fire detector, the accumulating operation of which has been completed in said receiver portion, and/or a transmitter that has transmitted a fire signal to said receiver portion.

25. A fire alarm system comprising:

a plurality of terminal units;

a receiver portion, connected to said terminal units, for addressing each of said terminal units and detecting terminal units among said terminal units that have status changes;

terminal unit status change determining means for sequentially calling said terminal units detected by said receiver portion, and confirming the status changes of said terminal units on the basis of data returned from the called terminal units and determining the status changes;

fire determined command transmitting means for sequentially transmitting fire determined commands only to said terminal units determined to have the status changes by said terminal unit status change determining means, and stopping responses to said receiver portion only for said terminal units which have received the fire determined command;

means for operating in a normal system polling mode in which said plurality of terminal units are divided into a plurality of groups and in which each of said groups is assigned a different response timing to respond to said receiver portion, wherein a terminal unit having a changed status responds to said receiver portion at said response timing for a group containing said terminal unit having the changed status;

means for operating in a normal point polling mode in which each of the terminal units is assigned a different response timing to respond to said receiver portion, wherein a terminal unit having the changed status responds to said receiver portion at a response timing assigned to said terminal unit; and selecting means for performing a selecting operation that causes said receiver portion to collect predetermined information from said terminal unit that has responded to said receiver portion during said normal point polling mode;

wherein each of said terminal units is an accumulative-type fire detector, a fire detector, the accumulating operation of which has been completed in said receiver portion, and/or a transmitter that has transmitted a fire signal to said receiver portion.

26. A fire alarm system comprising:

a plurality of terminal units;

a receiver portion, connected to said terminal units, for addressing each of said terminal units and detecting terminal units among said terminal units that have status changes;

terminal unit status change determining means for sequentially calling said terminal units detected by said receiver portion, and confirming the status changes of said terminal units on the basis of data returned from the called terminal units and determining the status changes;

fire determined command transmitting means for sequentially transmitting fire determined commands only to said terminal units determined to have the status changes by said terminal unit status change determining means, and stopping responses to said receiver portion only for said terminal units which have received the fire determined command;

means for operating in a normal system polling mode in which said plurality of terminal units are divided into a plurality of groups and in which each of said groups is assigned a different response timing to respond to said receiver portion, wherein a terminal unit having a changed status responds to said receiver portion at said response timing for a group containing said terminal unit having the changed status;

means for operating in a normal point polling mode in which each of the terminal units contained in said group having said terminal unit having the changed status is assigned a different response timing to respond to said receiver portion, wherein said terminal unit having the changed status responds to said receiver portion at a response timing assigned to said terminal unit; and selecting means for causing said receiver portion to collect predetermined information from said terminal unit that has responded to said receiver portion during said normal point polling mode;

wherein said receiver portion transmits a restoration signal to each of said terminal units which has received the fire determined command when the system is restored and each of said terminal units is respectively restored in response to said restoration signal.

27. A fire alarm system comprising:

a plurality of terminal units;

a receiver portion, connected to said terminal units, for addressing each of said terminal units and detecting terminal units among said terminal units that have status changes;

terminal unit status change determining means for sequentially calling said terminal units detected by said receiver portion, and confirming the status changes of said terminal units on the basis of data returned from the called terminal units and determining the status changes;

fire determined command transmitting means for sequentially transmitting fire determined commands only to said terminal units determined to have the status changes by said terminal unit status change determining means, and stopping responses to said receiver portion only for said terminal units which have received the fire determined command;

means for operating in a normal system polling mode in which said plurality of terminal units are divided into a plurality of groups and in which each of said groups is assigned a different response timing to respond to said receiver portion, wherein a terminal unit having a changed status responds to said receiver portion at said response timing for a group containing said terminal unit having the changed status; and selecting means for performing a selecting operation that causes said receiver portion to sequentially collect predetermined information from each terminal unit in a group containing said terminal unit that has responded to said receiver portion during said normal system polling mode;

wherein said receiver portion transmits a restoration signal to each of said terminal units which has received the fire determined command when the system is restored and each of said terminal units is respectively restored in response to said restoration signal.

28. A fire alarm system comprising:

a plurality of terminal units;

a receiver portion, connected to said terminal units, for addressing each of said terminal units and detecting terminal units among said terminal units that have status changes;

terminal unit status change determining means for sequentially calling said terminal units detected by said receiver portion, and confirming the status changes of said terminal units on the basis of data returned from the called terminal units and determining the status changes;

fire determined command transmitting means for sequentially transmitting fire determined commands only to said terminal units determined to have the status changes by said terminal unit status change determining means, and stopping responses to said receiver portion only for said terminal units which have received the fire determined command;

means for operating in a normal system polling mode in which said plurality of terminal units are divided into a plurality of groups and in which each of said groups is assigned a different response timing to respond to said receiver portion, wherein a terminal unit having a changed status responds to said receiver portion at said response timing for a group containing said terminal unit having the changed status;

means for operating in a normal point polling mode in which each of the terminal units is assigned a different response timing to respond to said receiver portion, wherein a terminal unit having the changed status responds to said receiver portion at a response timing assigned to said terminal unit; and selecting means for performing a selecting operation that causes said receiver portion to collect predetermined information from said terminal unit that has responded to said receiver portion during said normal point polling mode;

wherein said receiver portion transmits a restoration signal to each of said terminal units which has received the fire determined command when the system is restored and each of said terminal units is respectively restored in response to said restoration signal.

29. A fire alarm system comprising:

a plurality of terminal units;

a receiver portion, connected to said terminal units, for addressing each of said terminal units and detecting terminal units among said terminal units that have status changes;

terminal unit status change determining means for sequentially calling said terminal units detected by said receiver portion, and confirming the status changes of said terminal units on the basis of data returned from the called terminal units and determining the status changes;

fire determined command transmitting means for sequentially transmitting fire determined commands only to said terminal units determined to have the status changes by said terminal unit status change determining means, and stopping responses to said receiver portion only for said terminal units which have received the fire determined command;

means for operating in a normal system polling mode in which said plurality of terminal units are divided into a plurality of groups and in which each of said groups is assigned a different response timing to respond to said receiver portion, wherein a terminal unit having a changed status responds to said receiver portion at said response timing for a group containing said terminal unit having the changed status;

means for operating in a normal point polling mode in which each of the terminal units contained in said group having said terminal unit having the changed status is assigned a different response timing to respond to said receiver portion, wherein said terminal unit having the changed status responds to said receiver portion at a response timing assigned to said terminal unit; and selecting means for causing said receiver portion to collect predetermined information from said terminal unit that has responded to said receiver portion during said normal point polling mode.

30. A fire alarm system comprising:

a plurality of terminal units;

a receiver portion, connected to said terminal units, for addressing each of said terminal units and detecting terminal units among said terminal units that have status changes;

terminal unit status change determining means for sequentially calling said terminal units detected by said receiver portion, and confirming the status changes of said terminal units on the basis of data returned from the called terminal units and determining the status changes;

fire determined command transmitting means for sequentially transmitting fire determined commands only to said terminal units determined to have the status changes by said terminal unit status change determining means, and stopping responses to said receiver portion only for said terminal units which have received the fire determined command;

means for operating in a normal system polling mode in which said plurality of terminal units are divided into a plurality of groups and in which each of said groups is assigned a different response timing to respond to said receiver portion, wherein a terminal unit having a changed status responds to said receiver portion at said response timing for a group containing said terminal unit having the changed status; and selecting means for performing a selecting operation that causes said receiver portion to sequentially collect predetermined information from each terminal unit in a group containing said terminal unit that has responded to said receiver portion during said normal system polling mode.

31. A fire alarm system comprising:

a plurality of terminal units;

a receiver portion, connected to said terminal units, for addressing each of said terminal units and detecting terminal units among said terminal units that have status changes;

terminal unit status change determining means for sequentially calling said terminal units detected by said receiver portion, and confirming the status changes of said terminal units on the basis of data returned from the called terminal units and determining the status changes;

fire determined command transmitting means for sequentially transmitting fire determined commands only to said terminal units determined to have the status changes by said terminal unit status change determining means, and stopping responses to said receiver portion only for said terminal units which have received the fire determined command;

means for operating in a normal system polling mode in which said plurality of terminal units are divided into a plurality of groups and in which each of said groups is assigned a different response timing to respond to said receiver portion, wherein a terminal unit having a changed status responds to said receiver portion at said response timing for a group containing said terminal unit having the changed status;

means for operating in a normal point polling mode in which each of the terminal units is assigned a different response timing to respond to said receiver portion, wherein a terminal unit having the changed status responds to said receiver portion at a response timing assigned to said terminal unit; and selecting means for performing a selecting operation that causes said receiver portion to collect predetermined information from said terminal unit that has responded to said receiver portion during said normal point polling mode.

* * * * *